US005851752A

United States Patent [19]

Uchida et al.

[11] Patent Number: 5,851,752

[45] Date of Patent: Dec. 22, 1998

[54] SILVER HALIDE PHOTOGRAPHIC MATERIAL COMPRISING HOLE-INJECTION-TYPE SENSITIZING DYE(S) AND SUPERSENSITIZING COMPOUND(S)

[75] Inventors: Mitsuhiro Uchida; Shunji Takada, both of Minami Ashigara, Japan

[73] Assignee: Fuji Photo Film Co., Ltd., Kanagawa, Japan

[21] Appl. No.: 499,187

[22] Filed: Jul. 7, 1995

[30] Foreign Application Priority Data

Jul. 11, 1994 [JP] Japan ..... 6-180430

[51] Int. Cl.[6] ..... G03C 1/29; G03C 1/34

[52] U.S. Cl. ..... 430/572; 430/573; 430/574; 430/575; 430/576; 430/577; 430/583; 430/585; 430/586

[58] Field of Search ..... 430/572, 576, 430/583, 585, 586, 573, 574, 575, 577

[56] References Cited

U.S. PATENT DOCUMENTS

| | | | |
|---|---|---|---|
| 3,622,316 | 11/1971 | Bird et al. | 430/574 |
| 4,571,380 | 2/1986 | Noguchi et al. | 430/409 |
| 4,960,689 | 10/1990 | Nishikawa et al. | 430/583 |
| 5,384,234 | 1/1995 | Ueda et al. | 430/583 |
| 5,436,121 | 7/1995 | Suga et al. | 430/583 |
| 5,472,839 | 12/1995 | Missfeldt | 430/585 |
| 5,476,758 | 12/1995 | Suga et al. | 430/585 |

OTHER PUBLICATIONS

A Novel Form of Chemical Sensitization . . . , T.A. Babcock et al., Photographic Sci. Eng., vol. 19(1), 49 (1975).

Spectral sensitization of mobile . . . , R.W. Berriman et al., Photographic Sci. Eng., vol. 17(2), pp. 235–243 (1973).

*Primary Examiner*—Thorl Chea

*Attorney, Agent, or Firm*—Birch, Stewart, Kolasch & Birch, LLP

[57] ABSTRACT

Disclosed is a silver halide photographic material comprising a support having provided thereon at least one silver halide emulsion layer comprising a substantially surface-latent-image-type silver halide emulsion which comprises hole-injection-type sensitizing dye(s) in an amount of $4\times10^{-4}$ mol or more per mol of silver in the emulsion and further comprises supersensitizing compound(s), wherein the hole-injection-type sensitizing dye and the supersensitizing compound satisfy the requirements defined herein. The photographic material, thus comprising at least one silver halide emulsion that has been spectrally sensitized with a large amount of sensitizing dyes in a wavelength range longer than 545 nm and has been further sensitized by reduction sensitization, has a much increased sensitivity, while being fogged poorly, and has excellent storage stability.

19 Claims, No Drawings

SILVER HALIDE PHOTOGRAPHIC MATERIAL COMPRISING HOLE-INJECTION-TYPE SENSITIZING DYE(S) AND SUPERSENSITIZING COMPOUND(S)

FIELD OF THE INVENTION

The present invention relates to a silver halide photographic material that has been improved in order to have high sensitivity in spectral sensitization ranges.

BACKGROUND OF THE INVENTION

The basic characteristics which silver halide emulsions for photographic materials are required to have are such that the emulsions have high sensitivity, while being fogged poorly, and comprises fine grains.

In order to make a photographic emulsion have high sensitivity, it is necessary (1) to increase the number of photons to be absorbed by each of the grains constituting the emulsion, (2) to elevate the efficiency of the photoelectrons that are generated by absorption of light to be converted into silver clusters (latent images), and (3) to elevate the developing activity of the emulsion to effectively utilize the latent images formed. For these, it is considered to make a photographic emulsion comprise large-sized grains, by which the number of photons to be absorbed by the grains is increased. However, such large-sized grains often worsen the graininess of the photographic material having them. If the amount of spectrally sensitizing dyes which are in a photographic emulsion is increased, the number of the photons to be absorbed by the emulsion grains in spectral sensitization ranges can be increased. However, such a large amount of spectral sensitizing dyes in the emulsion often desensitize the emulsion, by which the sensitivity of the emulsion is rather lowered. In addition, the elevation of the developing activity of a photographic emulsion is one effective means for increasing the sensitivity of the emulsion. However, such often worsens the graininess of the photographic material comprising the emulsion when the material is processed by parallel development such as color development. In order to increase the sensitivity of a photographic emulsion without worsening the graininess of the photographic material comprising the emulsion, it is best to increase the efficiency of the photoelectrons formed in the emulsion to be converted into latent images, or that is, to increase the quantum sensitivity of the emulsion. In order to increase the quantum sensitivity of a photographic emulsion, for example, it is necessary to remove as much as possible the negative factors, such as re-bonding of photoelectrons formed or dispersion of latent images formed, in the process of converting the photoelectrons formed into latent images. As one means to attain this, a method of reducing sensitization is known to be effective in preventing the re-bonding of photoelectrons formed in a photographic emulsion, where small silver nuclei having no developing activity are formed in the inside or on the surface of each silver halide grain in the emulsion.

Babcock et al. (T. A. Babcock, P. M. Ferguson, W. C. Lewis and T. H. James, *Photogr. Sci. Eng.*, vol. 19(1), 49 (1975)) have found that when the layer of an emulsion that has been sensitized by gold and sulfur sensitization is degassed in a vacuum and then subjected to reduction sensitization by heat-treating it in a hydrogen gas atmosphere, then the sensitivity of the emulsion layer is increased more than that of the emulsion layer that has been subjected to ordinary reduction sensitization while the fog of the layer is retarded on a relatively low level. This sensitization is well known as hydrogen sensitization, which is effective as a means for highly sensitizing a photographic emulsion layer on a laboratory scale. In particular, such hydrogen sensitization is actually employed in the field of astronomical photographic materials.

Reduction sensitization of photographic emulsions has been studied from long ago. Carroll has disclosed in U.S. Pat. No. 2,487,850 that tin compounds are effective as reduction sensitizers; Lowe et al. have disclosed in U.S. Pat. No. 2,512,925 that polyamine compounds are effective as such; and Fallens et al. have disclosed in British Patent 789,823 that thiourea dioxide-type compounds are effective as such. Collier has compared the properties of silver nuclei that have been produced by various reduction sensitization methods, in Photographic Science and Engineering, Vol. 23, page 113 (1979). She has employed therein, for example, a method of ripening emulsions at high pH and low pAg, while using dimethylaminoborane, stannous chloride and hydrazine. Methods of reduction sensitization are further disclosed in U.S. Pat. Nos. 2,518,698, 3,201,254, 3,411,917, 3,779,777, 3,930,867. Not only the selection of reduction sensitizers but also the way how to use reducing agents is disclosed in JP-B-57-33572, JP-B-58-1410, JP-A-57-179835. (The terms "JP-A" and "JP-B" as used herein mean an "unexamined published Japanese patent application" and an "examined Japanese patent publication", respectively.) Techniques for improving the storability of emulsions that have been sensitized by reduction sensitization have been disclosed in JP-A-57-82831, JP-A-60-178445.

A mechanism of reduction sensitization has been taken into consideration, in which a silver nucleus which is formed by reduction sensitization and which is composed of two silver atoms traps a positive hole to be decomposed into a silver ion and an unstable silver atom, the thermally-unstable silver atom is further decomposed into a silver ion and a conductive electron and the electron contributes to the formation of a latent image, as so described by T. H. James in The Theory of the Photographic Process, 4th Ed., page 152 (published by Macmillan, 1977). According to this mechanism, it is possible to increase the sensitivity of a photographic emulsion by at most two times.

As mentioned above, various investigations have been made on reduction sensitization of photographic emulsions, but almost no example of reduction sensitization is known that could effectively be applied to spectrally sensitized silver halide emulsions. In JP-B-3-5572, they say that the application of reduction sensitization to spectrally sensitized emulsions is difficult. In this, they say that the sensitivity of photographic emulsions can be elevated when particular dyes among spectrally sensitizing dyes are used. In JP-A-3-168632, they say that the sensitivity of a particularly selected photographic emulsion comprising silver halide grains each having a high ratio of {100} face can be elevated by reducing the emulsion with ascorbic acid.

According to these techniques, however, the increase in the sensitivity of photographic emulsions is still insufficient, as compared with the increase in the sensitivity of photographic emulsions treated with hydrogen gas in a vacuum for hydrogen sensitization. In addition, the photographic emulsions treated by these techniques are highly fogged. Moreover, the storage stability of the photographic emulsions treated by these techniques is unsatisfactory in that the fog of the emulsions is increased and the sensitivity thereof is lowered after storage of the emulsions. Under these situations, improved techniques free from such drawbacks have been desired.

When photographic emulsions for green-sensitive layers or red-sensitive layers containing conventional sensitizing dyes for spectral sensitization in a wavelength range longer than 535 nm are subjected to reduction sensitization, it has heretofore been impossible to attain a sufficient increase in the intrinsic sensitivity of the emulsions, even though the intrinsic sensitivity of the photographic emulsions not containing such sensitizing dyes is significantly increased by ordinary reduction sensitization. Even if the sensitivity of photographic emulsions containing sensitizing dyes is somewhat increased by ordinary reduction sensitization, the increase in the sensitivity of the emulsions containing sensitizing dyes is much smaller than the increase in the intrinsic sensitivity of the emulsions not containing sensitizing dyes by ordinary reduction sensitization.

The efficiency of reduction sensitization is more retarded in silver halide emulsions containing a larger amount of sensitizing dyes.

Tabular silver halide grains have excellent light-scattering characteristics and have a larger ratio of (specific surface area)/(volume) than other silver halide grains such as cubic, octahedral, tetradecahedral or spherical silver halide grains, and these are characterized in that a larger amount of sensitizing dyes can be added to the unit volume of the grains. For these reasons, tabular silver halide grains may have improved sensitivity and improved relation between the sensitivity and the graininess. However, the addition of a large amount of sensitizing dyes to such tabular silver halide grains is problematic in that the effect of reduction sensitization of the emulsion containing the grains is retarded, as so mentioned hereinabove.

SUMMARY OF THE INVENTION

The present invention has been made in consideration of the above-mentioned problems, and its object is to provide a silver halide photographic material comprising a silver halide emulsion which has been spectrally sensitized with a large amount of sensitizing dyes in a wavelength range longer than 545 nm and has been further sensitized by reduction sensitization to have a much increased sensitivity, while being fogged poorly, and which has excellent storage stability.

The object of the present invention has been attained by a silver halide photographic material comprising a support having provided thereon at least one silver halide emulsion layer comprising a substantially surface-latent-image-type silver halide emulsion which comprises hole-injection-type sensitizing dye(s) in an amount of $4\times10^{-4}$ mol or more per mol of silver in the emulsion and further comprises supersensitizing compound(s), wherein the hole-injection-type sensitizing dye and the supersensitizing compound satisfy the following requirements:

(1) when both the hole-injection-type sensitizing dye and the supersensitizing compound have been adsorbed onto the silver halide grains constituting the emulsion, the emulsion has a maximum absorption wavelength of longer than 545 nm;

(2) when the hole-injection-type sensitizing dye is singly adsorbed onto a standard, negative silver iodobromide emulsion which is employed for the intended evaluation and which gives a surface negative image by exposure, the relative quantum yield of the negative sensitivity of the emulsion is smaller than 0.6;

(3) when both the hole-injection-type sensitizing dye and the supersensitizing compound are adsorbed onto a standard, internally fogged reversal silver iodobromide emulsion which is employed for the intended evaluation and which gives an internal reversal image by exposure, the degree of intrinsic desensitization of the reversal sensitivity of the emulsion is smaller than 0.2 as log E; and (4) when both the hole-injection-type sensitizing dye and the supersensitizing compound are adsorbed onto the standard, internally fogged reversal silver iodobromide emulsion referred to in (3), the relative quantum yield of the reversal sensitivity of the emulsion is 0.8 or more, which is designated the first embodiment of the present invention.

As the second embodiment of the present invention, the silver halide emulsion in the photographic material as defined in the first embodiment has been subjected to reduction sensitization.

As the third embodiment of the present invention, the silver halide emulsion in the photographic material as defined in the first or second embodiment comprises tabular silver halide grains having a mean thickness of 0.3 $\mu$m or less.

As the fourth embodiment of the present invention, the molar ratio of the supersensitizing compound(s) to the hole-injection-type sensitizing dye(s) to be in the silver halide emulsion in the photographic material as defined in any one of the first to third embodiments is from 0.003/1 to 0.3/1.

As the fifth embodiment of the present invention, the hole-injection-type sensitizing dye(s) satisfying the defined requirements account(s) for 70 mol % or more of all the sensitizing dyes to be in the silver halide emulsion in the photographic material as defined in any one of the first to fourth embodiments.

As the sixth embodiment of the present invention, the hole-injection-type sensitizing dye and the super-sensitizing compound to be in the silver halide emulsion in the photographic material as defined in any one of the first to fifth embodiments are such that the increase in the relative quantum yield of the negative sensitivity of the standard surface-latent-image-type silver iodobromide emulsion defined in the above-mentioned (2), $\Delta\phi r$ (=$\phi r$ of the negative image formed on the surface of the emulsion onto which both the hole-injection-type sensitizing dye and the supersensitizing compound have been adsorbed—$\phi r$ of the negative image formed on the surface of the emulsion onto which only the hole-injection-type sensitizing dye has been adsorbed) is larger than 0.2.

As the seventh embodiment of the present invention, $\Delta\phi r$ in the photographic material as defined in the sixth embodiment is larger than 0.4.

As the eighth embodiment of the present invention, the silver halide emulsion in the photographic material as defined in any one of the first to seventh embodiments comprises silver halide grains having a grain size of 0.5 $\mu$m or more as the diameter of the sphere corresponding to the grain.

As the ninth embodiment of the present invention, the silver halide emulsion in the photographic material as defined in any one of the first to eighth embodiments has been subjected to reduction sensitization during the process of producing it and at least one compound of the following formula (1), (2) or (3) has been added to the emulsion:

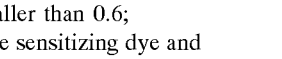

$$R_{21}—SO_2—S—M \quad (1)$$

$$R_{21}—SO_2—S—R_{22} \quad (2)$$

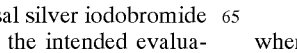

$$R_{21}—SO_2—S—L_m—S—SO_2—R_{23} \quad (3)$$

wherein $R_{21}$, $R_{22}$ and $R_{23}$ may be the same or different and each represents an aliphatic group, an aromatic group or a heterocyclic group; M represents a cation; L represents a divalent linking group; and m represents 0 or 1. The compounds of formula (1), (2) or (3) may be polymers each containing repeating units of the divalent group to be derived from any of the structures of formula (1), (2) or (3).

DETAILED DESCRIPTION OF THE INVENTION

The present invention is described in detail hereinunder.

Various investigations have been made so as to obtain silver halide emulsions having high sensitivity, which have made steady progress in the elevation of the sensitivity of silver halide emulsions. However, the demand for further elevation of the sensitivity of picture-taking photographic materials, for further improvement in the graininess of them and for further improvement in the storage stability of them is still large, and the photographic materials now in use are not still on the satisfactory level.

On the other hand, reduction sensitization has a potential that can increase by at most two times the sensitivity of a photographic emulsion, and various investigations have heretofore been made on such reduction sensitization so as to utilize it to obtain photographic emulsions with elevated sensitivity. However, there is known no example of a photographic emulsion with elevated sensitivity which has been spectrally sensitized in a green-sensitive range or in a red-sensitive range and which has been sensitized by reduction sensitization, while having good storage stability, as so mentioned hereinabove. In particular, it is quite difficult to elevate the sensitivity of an emulsion comprising tabular silver halide grains, to which a large amount of sensitizing dyes have been added, by reduction sensitization.

As mentioned hereinabove, the mechanism of reduction sensitization of an emulsion by exposure in the intrinsic range is considered to be caused by the following reactions:

$$AgX+h\nu \rightarrow e^- + h^+ \quad (1)$$

$$Ag_2+h^+ \rightarrow Ag^+ + Ag \quad (2)$$

$$Ag \rightarrow Ag^+ + e^- \quad (3)$$

In these formulae, $e^-$ and $h^+$ are the free electron and the free positive hole generated by exposure, respectively; hν is the photon; and $Ag_2$ is the reduced silver nucleus formed by reduction sensitization.

Precisely, it is considered that the increase in the sensitivity of an emulsion by reduction sensitization is attained by the reaction of the free positive hole formed by exposure of one photon with the reduced silver nucleus, which forms still another free electron.

On the other hand, in the reduction sensitization of an emulsion that is exposed in a spectrally sensitizing range, the initial step for light absorption starts according to the following formula (4) but not according to the above-mentioned formula (1).

$$\text{dye}+h\nu \rightarrow \text{dye}^* \quad (4)$$

$$\text{dye}^* \rightarrow \text{dye}^+ + e^- (\text{on AgBr}) \quad (5)$$

$$\text{dye}^+ \rightarrow \text{dye} + h^+ (\text{on AgBr}) \quad (6)$$

In these formulae, dye is the sensitizing dye adsorbed onto silver halide grains; dye* is the sensitizing dye in an excited condition; $\text{dye}^+$ is the sensitizing dye in a one-electron-oxidized condition (dye hole).

The quantum yield in the step of (5) indicates the efficiency of the spectral sensitization, and this is generally referred to as φr.

By exposure in a spectrally sensitizing range, all the steps (4) to (6) are finished and the condition of the exposed emulsion becomes equivalent to the condition of the emulsion that has been subjected to exposure in the intrinsic range in the step of (1).

Accordingly, sensitizing dyes which have high spectrally sensitizing efficiency and which are added to emulsions that are exposed in a spectrally sensitizing range while having been sensitized by reduction sensitization (i.e., sensitizing dyes which have high spectrally sensitizing efficiency and which have such a characteristic that sensitivity evaluated in case where the sensitizing dyes are added in an emulsion having been sensitized by reduction sensitization and the resulting emulsion is exposed in a spectrally sensitizing range is higher than sensitivity evaluated in case where the sensitizing dyes are added in an emulsion not sensitized by reduction sensitization and the resulting emulsion is exposed in a spectrally sensitizing range) must satisfy the following two conditions:

(a) they have a high degree of electron transfer in the step (5); and (b) they have a high degree of hole injection in the step (6).

However, there is known no sensitizing dye which has an absorption peak in a wavelength range longer than 545 nm and which satisfies both the above-mentioned conditions (a) and (b). In principle, the condition (a) requires a high LUMO level of sensitizing dyes, while the condition (b) requires a low HOMO level of sensitizing dyes. Hence, sensitizing dyes satisfying the both two shall have high transition energy. In view of these, it is therefore expected that sensitizing dyes that exhibit low energy transition at a wavelength longer than 545 nm could not satisfy both the conditions (a) and (b). (However, sensitizing dyes having an absorption peak in a wavelength range shorter than 545 nm could satisfy these conditions (a) and (b).)

For these reasons, conventional sensitizing dyes having high spectrally sensitizing ability cannot satisfy the condition (b), and therefore, if such conventional sensitizing dyes are added to photographic emulsions, it is impossible to make the emulsions have high sensitivity by reduction sensitization. On the other hand, if sensitizing dyes having high efficiency of hole injection are added to photographic emulsions, the emulsions can be sensitized by reduction sensitization but the degree of spectral sensitization of the emulsions by the sensitizing dyes added is lowered. As a result, it is impossible to make the emulsions have satisfactorily high sensitivity. For these reasons, it has heretofore been considered impossible to attain both the spectral sensitization and the reduction sensitization of photographic emulsions.

When photographic emulsions comprising silver halide grains to which a large amount of sensitizing dyes have been added are exposed, the reverse reaction opposite to the reaction of the above-mentioned formula (6) occurs with the result that the probability of the trapping of positive holes by the sensitizing dyes is increased. As a result, the hole concentration in the silver halide grains is lowered and therefore it becomes difficult to sensitize the emulsions by reduction sensitization.

We, the present inventors have assiduously studied and, as a result, have found that even a silver halide emulsion containing a large amount of sensitizing dyes can be satisfactorily sensitized both by spectral sensitization and by reduction sensitization to make the emulsion have high sensitivity when both hole-injection-type sensitizing dye(s) and supersensitizing compound(s) satisfying the following conditions are added to the silver halide emulsions.

(1) When both the hole-injection-type sensitizing dye and the supersensitizing compound have been adsorbed onto the silver halide grains constituting the emulsion, the emulsion has a maximum absorption wavelength of longer than 545 nm;

(2) when the hole-injection-type sensitizing dye is singly adsorbed onto a standard, negative silver iodobromide emulsion which is employed for the intended evaluation and which gives a surface negative image by exposure, the relative quantum yield of the negative sensitivity of the emulsion is smaller than 0.6;

(3) when both the hole-injection-type sensitizing dye and the supersensitizing compound are adsorbed onto a standard, internally fogged reversal silver iodobromide emulsion which is employed for the intended evaluation and which gives an internal reversal image by exposure, the degree of intrinsic desensitization of the reversal sensitivity of the emulsion is smaller than 0.2 as log E; and (4) when both the hole-injection-type sensitizing dye and the supersensitizing compound are adsorbed onto the standard, internally fogged reversal silver iodobromide emulsion referred to in (3), the relative quantum yield of the reversal sensitivity of the emulsion is 0.8 or more.

According to the present invention, sensitizing dyes that do not satisfy the condition (a) but satisfy the condition (b) are selected and the insufficiency of the spectral sensitization by the thus-selected sensitizing dyes is compensated by the combination of the sensitizing dyes and the supersensitizing compounds. The sensitizing mechanism in the present invention is considered as follows:

Scheme of energy-transfer-type supersensitization and hole injection:

$$\text{dye I}+h\nu\rightarrow\text{dye I}^* \quad (7)$$

$$\text{S}+\text{dye I}^*\rightarrow\text{S}^*+\text{dye I} \quad (8)$$

$$\text{S}^*\rightarrow\text{S}^++e^-(\text{on AgBr}) \quad (9)$$

$$\text{S}^++\text{dye I}\rightarrow\text{S}+\text{dye I}^+ \quad (10)$$

$$\text{dye I}^+\rightarrow\text{dye}+h^+(\text{on AgBr}) \quad (11)$$

In these formulae, dye I is the hole-injection-type sensitizing dye satisfying the above-defined conditions; S is the supersensitizing compound satisfying the above-defined conditions.

In the above-mentioned scheme, the mechanism of the supersensitization to be effected in the emulsion of the present invention is considered to be of a energy-transfer type. Supersensitization is also considered to be of an electron-transfer type. The scheme of the electron-transfer-type supersensitization is as follows: Scheme of electron-transfer-type supersensitization and hole injection:

$$\text{dye I}+h\nu\rightarrow\text{dye I}^* \quad (7')$$

$$\text{S}+\text{dye I}^*\rightarrow\text{S}^*+\text{dye I}^- \quad (8')$$

$$\text{dye I}^-\rightarrow\text{dye I}+e^-(\text{on AgBr}) \quad (9')$$

$$\text{S}^++\text{dye I}\rightarrow\text{S}+\text{dye I}^+ \quad (10')$$

$$\text{dye I}^+\rightarrow\text{dye}+h^+(\text{on AgBr}) \quad (11')$$

This is different from the above-mentioned energy-transfer-type scheme only in the reactions (8') and (9').

In the energy-transfer-type scheme, it is considered that the electron transfer to the silver halide in the emulsion does not start from dye I having low electron transfer efficiency but starts from S that has received energy from dye I by energy transfer, while the hole injection into the silver halide effectively starts from dye $I^+$ that has been formed after the hole transfer (see (10)) from $S^+$ to dye I. (This $S^+$ is formed as a result of the electron transfer to the silver halide.)

In the electron-transfer-type scheme, it is considered that the electron transfer to the silver halide in the emulsion starts from dye $I^-$ whose energy level has been increased by receiving the electron from S, while the hole injection into the silver halide effectively starts from dye $I^+$ that has been formed after the hole transfer (see (10')) from $S^+$ to dye I. (This $S^+$ is formed as a result of the electron transfer from S to dye I.)

According to the conventional knowledge of supersensitization of this type, it has been considered that the positive hole is trapped by the supersensitizing agent (S) so that it is not injected into a silver halide. However, we, the present inventors consider that the combination of the hole-injection-type sensitizing dye and the supersensitizing compound according to the present invention efficiently induces the step (10) (or (10')), by which the positive hole is efficiently injected into the silver halide in the emulsion.

No one can expect the compatibility of the increase in the electron transfer efficiency by supersensitization with the reduction sensitization by hole injection, and the technique of the present invention for increasing the sensitivity of a photographic emulsion by the combination of the reduction sensitization and supersensitization has yielded surprising effects.

The conditions of the hole-injection-type sensitizing dyes and the supersensitizing compounds to be used in the present invention are described in detail hereinunder.

The first condition is as follows:

(1) When both the hole-injection-type sensitizing dye and the supersensitizing compound have been adsorbed onto the silver halide grains constituting an emulsion, the emulsion has a maximum absorption wavelength of longer than 545 nm.

Since the present invention is intended to increase the sensitivity of the silver halide emulsions for green-sensitive layer and red-sensitive layer in a photographic material by reduction sensitization, sensitizing dyes having a maximum absorption wavelength of longer than 545 nm are employed. Sensitizing dyes having a maximum absorption wavelength of shorter than 545 nm, which can be added to emulsions to be sensitized by reduction sensitization, are known even though they do not satisfy the conditions as defined by the present invention.

The second condition is as follows:

(2) When the hole-injection-type sensitizing dye is singly adsorbed onto a standard, negative silver iodobromide emulsion which is employed for the intended evaluation and which gives a surface negative image by exposure, the relative quantum yield of the negative sensitivity of the emulsion is smaller than 0.6.

The conventional sensitizing dyes that have heretofore been tried to be subjected to reduction sensitization in a spectrally sensitizing range all have a relative quantum yield of 0.6 or more. When such sensitizing dyes are used, it is impossible by any means to increase the efficiency of hole injection into silver halides according to the step (6) mentioned hereinabove, and therefore it is impossible to increase the sensitivity of the emulsions containing such sensitizing dyes by reduction sensitization. According to the present invention, we, the present inventors have employed sensitizing dyes having the relative quantum yield of smaller than 0.6 and have succeeded in the increase in the sensitivity of the emulsions containing the sensitizing dyes by reduction sensitization.

The method of obtaining the relative quantum yield of a standard silver iodobromide emulsion that gives a surface negative image is described below.

The relative quantum yield of a photographic emulsion is generally obtained from its photographic properties. It is known that the relative quantum yield of a photographic emulsion varies, depending on the way how to add sensitizing dyes thereto, the amount of the sensitizing dyes added and the type of the silver halide emulsion to be examined, and this is not determined unconditionally only by the sensitizing dyes added to the emulsion. The relative quantum yield as referred to herein is defined to be one that is obtained by the method mentioned below.

Preparation of standard emulsion that gives surface negative image:

1,200 ml of an aqueous solution containing 43 g of gelatin and having pH of 6 were stirred at 76° C. 190 ml of an aqueous solution of silver nitrate (containing 7 g of $AgNO_3$) and an aqueous solution of KBr were added thereto over a period of 25 minutes by a controlled double jet method at pAg of 6.9. After this was adjusted to have pH of 4, 431 ml of an aqueous solution of silver nitrate (containing 108 g of $AgNO_3$) and an aqueous solution of a halide (containing KI in an amount of 1 mol % relative to KBr) were added thereto over a period of 40 minutes by a controlled double jet method at pAg of 8.0, while the amount of the silver nitrate solution being added was increased by 0.27 ml/min. Next, 431 ml of an aqueous solution of silver nitrate (containing 108 g of $AgNO_3$) and an aqueous solution of a halide (containing KI in an amount of 2 mol % relative to KBr) were added thereto over a period of 50 minutes by a controlled double jet method at pAg of 8.0.

The resulting emulsion was de-salted to have a salt concentration of 1/200, and this was re-dispersed at 50° C. and at pAg of 8.8 and pH of 6.4. Thus, an emulsion of octahedral grains having a sphere-corresponding diameter of 0.5 $\mu$m was obtained. This gives a surface negative image. This emulsion contained 130 g of silver and 70 g of gelatin, per kg of the emulsion.

This emulsion was dissolved at 40° C., and a sensitizing dye was added thereto in an amount of $6.4\times10^{-4}$ mol, per mol of silver in the emulsion. This was coated on a support. The coated sample had Ag of 2 g/m$^2$.

The thus-formed sample was stored for 14 hours at 40° C. and at a relative humidity of 70%, and then exposed for 10 seconds through an interference filter at 391 nm and that in the vicinity of the absorption peak wavelength of the sensitizing dye (for exposure in the spectrally sensitizing range) both via a continuous optical wedge. The thus-exposed sample was then developed with the processing solution mentioned below at 20° C. for 30 minutes.

| Processing Solution: | |
|---|---|
| Metol | 2 g |
| Hydroquinone | 8 g |
| Anhydrous sodium sulfite | 90 g |
| Anhydrous sodium carbonate | 45 g |
| KBr | 5 g |
| Water to make | 1 liter |

After thus processed, the sample was fixed and washed, and the density of the sample was measured.

The quantity of light applied to the sample by the exposure was measured, and the degree of the absorption by the sample was measured. From these, the number of the photons for the exposure to give a density of (fog+0.2) of the negative image formed was calculated. According to the following equation, $\phi r$ of the negative image (relative quantum yield of the negative image) was obtained.

$\phi r$ of negative image = (number of photons for exposure at 391 nm)/(number of photons for exposure in the vicinity of the absorption peak wavelength of the sensitizing dye used)

The third condition is as follows:

(3) When both the hole-injection-type sensitizing dye and the supersensitizing compound are adsorbed onto a standard, internally fogged reversal silver iodobromide emulsion which is employed for the intended evaluation and which gives an internal reversal image by exposure, the degree of intrinsic desensitization of the reversal sensitivity of the emulsion is smaller than 0.2 as log E.

The following step (12) is taken into consideration as one negative reaction, by which the spectral sensitization of an emulsion that has been subjected to reduction sensitization is retarded.

$$\text{dye}+h^+(\text{on AgBr})\rightarrow\text{dye}^+ \quad (12)$$

This is the reverse reaction opposite to the reaction of the above-mentioned step (6), indicating the step where the positive hole in the inside of each silver halide grain in the emulsion is trapped by the sensitizing dye that has adsorbed onto the surface of the grain. If the probability of this step is high, the positive hole concentration in the silver halide grains in the emulsion is lowered with the result that the reaction between the reduced silver nuclei and the positive holes becomes difficult. As a result, it becomes difficult to satisfactorily sensitize the emulsion by reduction sensitization. This step can be evaluated by measuring the intrinsic sensitivity of an internally fogged emulsion that gives an internal reversal image. When the combination of the hole-injection-type sensitizing dye and the supersensitizing compound of the present invention is applied to such an internally fogged emulsion, the intrinsic desensitization of the emulsion is smaller than 0.2 and the reaction of the above-mentioned formula (12) hardly occurs in this emulsion. However, even if the combination of any other sensitizing dye and supersensitizing compound that do not satisfy the condition (3) of the present invention is applied to an emulsion and even if the emulsion is subjected to reduction sensitization, the sensitivity of the emulsion is not increased.

The method for preparing a standard, internally fogged reversal silver iodobromide emulsion which is employed for the intended evaluation and which gives an internal reversal image by exposure is mentioned below. Preparation of seed crystals:

1,200 ml of an aqueous solution containing 43 g of gelatin and having pH of 6 were stirred at 76° C. 190 ml of an aqueous solution of silver nitrate (containing 7 g of $AgNO_3$) and an aqueous solution of KBr were added thereto over a period of 6 minutes by a controlled double jet method at pAg of 6.9. Next, 0.03 g of $K_3RhCl_6$ were added thereto. Next, 431 ml of an aqueous solution of silver nitrate (containing 108 g of $AgNO_3$) and an aqueous solution of a halide (containing KI in an amount of 1 mol % relative to KBr) were added thereto over a period of 30 minutes by a controlled double jet method at pAg of 8.0, while the amount of the silver nitrate solution being added was increased by 0.7 ml/min. Next, 431 ml of an aqueous solution of silver nitrate (containing 108 g of $AgNO_3$) and an aqueous solution of a halide (containing KI in an amount of 2 mol % relative to KBr) were added thereto over a period of 20 minutes by a controlled double jet method at pAg of 8.0. After this was adjusted to have pAg of 7.0, $1.8\times10^{-6}$ mol, per mol of silver, of thiourea dioxide and $1.9\times10^{-6}$ mol, per mol of silver, of chloroauric acid were added thereto, and this was ripened for 50 minutes. The resulting emulsion was de-salted to have a salt concentration of 1/200, and this was re-dispersed at 50° C. and at pAg of 8.8 and pH of 6.4. Thus, an emulsion of tetradecahedral seed crystals having a sphere-corresponding diameter of 0.3 μm was obtained. This gives a surface reversal image. This emulsion contained 131 g of silver and 57 g of gelatin, per kg of the emulsion.

Preparation of standard, internally fogged reversal emulsion:

To an aqueous solution containing 463 g of the above-mentioned seed crystals (containing 0.56 mols of silver) and 17 g of gelatin and having pH of 3.5, added were 400 ml of an aqueous solution of silver nitrate (containing 100 g of $AgNO_3$) and an aqueous solution of a halide (containing KI in an amount of 1 mol % relative to KBr) over a period of 53 minutes by a controlled double jet method at pAg of 8.5, while the amount of the silver nitrate solution being added was increased by 0.1 ml/min. Next, 120 ml of an aqueous solution of silver nitrate (containing 30 g of $AgNO_3$) and an aqueous solution of a halide (containing KI in an amount of 1 mol % relative to KBr) were added thereto over a period of 7 minutes by a controlled double jet method at pAg of 8.5. The resulting emulsion was de-salted to have a salt concentration of 1/200, and this was re-dispersed at 50° C. and at pAg of 8.8 and pH of 6.4. Thus, an emulsion of octahedral grains having a sphere-corresponding diameter of 0.4 μm was obtained. This contained 125 g of silver and 80 g of gelatin, per kg of the emulsion. When exposed, this emulsion does not give a negative image both on its surface and in its inside, since the electrons in the emulsion have been trapped by $Rh^{3+}$ contained in the seed crystals. In this emulsion, the positive holes formed by exposure react with the internal fog to bleach it. Therefore, the exposed emulsion gives an internal reversal image.

This emulsion was dissolved at 40° C., and a sensitizing dye was added thereto in an amount of $9\times10^{-4}$ mol, per mol of silver in the emulsion, along with a supersensitizing compound at such a ratio that shall be employed in actually producing photographic materials. This was coated on a support. The coated sample had Ag of 2 g/$m^2$. For comparison, a comparative sample not containing the sensitizing dye was prepared.

The thus-formed samples were stored for 14 hours at 40° C. and at a relative humidity of 70%, and then exposed for 10 seconds through an interference filter at 391 nm via a continuous optical wedge. The thus-exposed samples were developed with the processing solution mentioned below at 20° C. for 60 minutes to form an internally fogged reversal image on each sample.

| Processing Solution: | |
|---|---|
| Metol | 2 g |
| Sodium thiosulfate | 3 g |
| Hydroquinone | 8 g |
| Anhydrous sodium sulfite | 90 g |
| Anhydrous sodium carbonate | 45 g |
| KBr | 5 g |
| Water to make | 1 liter |

After thus processed, the samples were fixed and washed, and the density of each sample was measured.

The amount of exposure to give a reversal image having a density of (maximum density—0.2) as log E was obtained for each sample, and the degree of intrinsic desensitization of the reversal sensitivity of the emulsion was obtained according to the following equation.

Degree of intrinsic desensitization = (amount of exposure as log E, of sensitizing dye-added sample) − (amount of exposure, as log E, of sensitizing dye-free sample)

The fourth condition is as follows:

(4) When both the hole-injection-type sensitizing dye and the supersensitizing compound are adsorbed onto the standard, internally fogged reversal silver iodobromide emulsion referred to in (3), the relative quantum yield of the reversal sensitivity of the emulsion is 0.8 or more.

The relative quantum yield of the reversal sensitivity of a reversal emulsion to which a sensitizing dye only has been added follows the steps of the above-mentioned formulae (5) and (6). Precisely, only when the emulsion contains a sensitizing dye which is such that it has, when it is in an excited condition, a high capacity for electron transfer onto the silver halide in the emulsion and that the efficiency of hole transfer of the dye positive hole formed as a result of the electron transfer onto the silver halide is high, the emulsion can have a high relative quantum yield of reversal sensitivity. In principle, however, there is no sensitizing dye having a longer absorption wavelength than 545 nm and satisfying this condition, as so mentioned hereinabove.

Sensitizing dyes that have heretofore been tried to be subjected to reduction sensitization in a spectrally sensitizing range all have a relative quantum yield of reversal sensitivity of not higher than 0.8, or the combination of sensitizing dye(s) and supersensitizing compound(s) has been tried to be subjected to such reduction sensitization. The intrinsic sensitivity of an emulsion containing such sensitizing dyes could be increased by reduction sensitization but it is almost impossible to further increase the sensitivity of the emulsion when subjected to spectrally sensitizing exposure.

When the hole-injection-type sensitizing dye of the present invention is singly added to the standard emulsion, the emulsion gives a surface negative image having $\phi r$ of smaller than 0.6, since the dye satisfies the second condition (2). Therefore, the proportion of $dye^+$ to be formed in the step (5) is not higher than 60% with the result that the efficiency of the dye for producing $h^+$ shall not be not smaller than 0.6. However, when both the hole-injection-type sensitizing dye and the supersensitizing compound satisfying the conditions defined by the present invention are added to the emulsion, the emulsion follows the steps (7) to (11) or (7') to (11'), in which both electrons and positive holes can be efficiently injected into the silver halide, and, as a result, the relative quantum yield of the reversal sensitivity of the emulsion shall be 0.8 or more. In other words, when the hole-injection-type sensitizing dye and the supersensitizing compound are combined and added to the emulsion in such a way that the relative quantum yield of the reversal sensitivity of the emulsion may be 0.8 or more, then the increase in the sensitivity of the emulsion by reduction sensitization can be fully attained even in spectrally sensitizing exposure.

Since, in principle, it is impossible to make the emulsion, to which only the sensitizing dye has been singly added, have a relative quantum yield of the reversal sensitivity of 0.8 or more, it has heretofore been considered impossible to attain the object of the present invention by the prior art technique. Surprisingly, we, the present inventors have achieved the impossible as a result our assiduous investigations.

The method for obtaining the relative quantum yield of the reversal sensitivity of an emulsion is mentioned below.

The same sample as that prepared hereinabove for the evaluation of the third condition (3) of the sample was exposed for 10 seconds through an interference filter at 391 nm and that in the vicinity of the absorption peak wavelength of the sensitizing dye both via a continuous optical wedge. The thus-exposed sample was then developed with the same processing solution as that employed for the evaluation of the third condition (3) of the sample, to form an internally fogged reversal image thereon.

The quantity of light applied to the sample by the exposure was measured, and the degree of the absorption by the sample was measured. From these, the number of the photons for the exposure to give a density of (maximum density—0.2) of the reversal image formed was calculated. According to the following equation, ϕr of the reversal image was obtained.

ϕr of reversal image =
(number of photons for exposure at 391 nm)/
(number of photons for exposure in the vicinity of the absorption peak wavelength of the sensitizing dye used)

The combination of the hole-injection-type sensitizing dye and the supersensitizing compound of the present invention is characterized in that the value ϕr of the reversal image of the emulsion containing both the dye and the compound, which is obtained according to the above-mentioned method, is 0.8 or more.

Next, the hole-injection-type sensitizing dyes for use in the present invention are mentioned below.

The terminology "hole-injection-type" for the sensitizing dyes means that the dyes have high efficiency in injecting dye positive holes into silver halides. The hole-injection-type sensitizing dyes for use in the present invention are characterized in that the combination of the dye and the supersensitizing compound defined according to the present invention gives a reversal image having a degree of intrinsic desensitization of smaller than 0.2, as log E, under the condition (3) and having ϕr of 0.8 or more under the condition (4).

The hole-injecting efficiency of sensitizing dyes in injecting positive holes into silver halides is often referred to, in correspondence to the HOMO level of the dyes. The HOMO level of sensitizing dyes can be known by measuring their oxidation potential.

The value of oxidation potential of a compound is defined by its half-wave potential in anodic polarograpy, which means the potential at which electrons are drawn from the compound at an anode. In general, the measurement of the potential is conducted at 25° C., using sodium perchlorate as the supporting electrolyte, acetonitrile as the solvent for the dye, a rotary platinum electrode as the anode and a saturated calomel electrode as the reference electrode.

Berriman et al. (P. W. Berriman et al., P. B. Gilmann, *Photogr. Sci. Eng.*, vol. 17(2), 235 (1973)) have reported that the possibility of positive hole injection by a single sensitizing dye depends on the HOMO level of the dye, and they have obtained experimental results demonstrating that the positive hole injection is possible to sensitizing dyes having an oxidation potential of 0.85 V or higher. However, dyes satisfying the third condition (3) are known but those satisfying the fourth condition (4) are unknown, as so mentioned hereinabove.

Regarding the oxidation potential of the hole-injection-type sensitizing dyes satisfying the conditions of the present invention, many of the dyes have a threshold voltage at about 1.0 V but some of them have an oxidation potential at lower than 1.0 V, while some sensitizing dyes having an oxidation potential at higher than 1.0 V are outside the range of the hole-injection-type sensitizing dyes of the present invention.

The oxidation potential of dyes is measured in a solution containing only the dye. However, the actual photographic properties of dyes are determined while the dyes are adsorbed on silver halide grains. In addition, many dyes form their J-associates. Therefore, it is considered that the electron condition of sensitizing dyes in photographic emulsions does not always correspond to that of the dyes in their solutions.

Though there are some exceptions such as those mentioned hereinabove, the hole-injection-type sensitizing dyes of the present invention having a higher oxidation potential are expected to give favorable results.

Usable in the present invention are spectrally sensitizing cyanine dyes, merocyanine dyes, complex cyanine dyes, complex merocyanine dyes, holopolar cyanine dyes, styryl dyes, hemicyanine dyes, oxonole dyes, hemioxonole dyes, etc. which satisfy the conditions defined according to the present invention. In order to make these sensitizing dyes satisfy the conditions defined according to the present invention for the hole-injection-type sensitizing dyes to be used herein, it is effective to select the basic skeletons of the dyes having a low HOMO level and/or to introduce electron-attracting substituents into the dyes.

Specific examples of the hole-injection-type sensitizing dyes for use in the present invention are mentioned below, which, however, are not limitative.

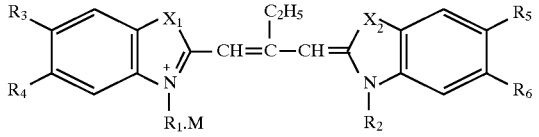

| | $X_1$ | $X_2$ | $R_1$ | $R_2$ | $R_3$ | $R_4$ | $R_5$ | $R_6$ | M |
|---|---|---|---|---|---|---|---|---|---|
| I-1 | O | O | $(CH_2)_3SO_3^-$ | $(CH_2)_3SO_3^-$ | Cl | Cl | Cl | Cl | Na |
| I-2 | O | O | $(CH_2)_3SO_3^-$ | $(CH_2)_3SO_3^-$ | Br | Br | Br | Br | Na |
| I-3 | O | O | $(CH_2)_3SO_3^-$ | $(CH_2)_3SO_3^-$ | H | $COCH_3$ | H | $COCH_3$ | Na |
| I-4 | O | O | $(CH_2)_3SO_3^-$ | $(CH_2)_3SO_3^-$ | H | $COOCH_3$ | H | $COOCH_3$ | Na |

-continued

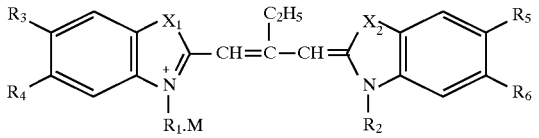

| | $X_1$ | $X_2$ | $R_1$ | $R_2$ | $R_3$ | $R_4$ | $R_5$ | $R_6$ | M |
|---|---|---|---|---|---|---|---|---|---|
| I-5 | O | O | $(CH_2)_3SO_3^-$ | $(CH_2)_3SO_3^-$ | H | $CF_3$ | H | $CF_3$ | Na |
| I-6 | O | O | $(CH_2)_3SO_3^-$ | $(CH_2)_3SO_3^-$ | H | $NO_2$ | H | $NO_2$ | Na |
| I-7 | O | O | $(CH_2)_3SO_3^-$ | $(CH_2)_3SO_3^-$ | H | $SOCH_3$ | H | $SOCH_3$ | Na |
| 1-8 | O | O | $CH_2CF_2CF_2H$ | $CH_2CF_2CF_2H$ | H | Cl | H | Cl | I |
| I-9 | O | O | $(CH_2)_3SO_3^-$ | $CH_2CF_2CF_2H$ | H | $COCH_3$ | H | $COCH_3$ | |
| I-10 | O | O | $(CH_2)_3SO_3^-$ | $(CH_2)_3SO_3^-$ | H | CN | H | CN | Na |
| I-11 | O | O | $(CH_2)_3-CH=CHSO_3^-$ | $(CH_2)_2-CH=CHSO_3^-$ | H | Cl | H | Cl | Na |
| I-12 | O | O | $(CH_2)_3SO_3^-$ | $(CH_2)_3SO_3^-$ | H | $COCH_3$ | H | $COCH_3$ | Na |
| I-13 | O | S | $(CH_2)_3SO_3^-$ | $(CH_2)_3SO_3^-$ | H | $CF_3$ | H | $CF_3$ | Na |
| I-14 | O | S | $(CH_2)_3SO_3^-$ | $(CH_2)_3SO_3^-$ | H | Cl | H | CN | Na |
| I-15 | O | S | $(CH_2)_3SO_3^-$ | $CH_2CF_2CF_2H$ | H | $CF_3$ | H | $CF_3$ | — |
| I-16 | O | S | $(CH_2)_2-CH=CHSO_3^-$ | $(CH_2)_2-CH=CHSO_3^-$ | H | Cl | H | Cl | Na |
| I-17 | O | S | $(CH_2)_2SO_3^-$ | $(CH_2)_3SO_3^-$ | H | $COCH_3$ | H | $COCH_3$ | Na |
| I-18 | S | S | $(CH_2)_3SO_3^-$ | $(CH_2)_3SO_3^-$ | H | $CF_3$ | H | $CF_3$ | Na |
| I-19 | S | S | $(CH_2)_3SO_3^-$ | $(CH_2)_3SO_3^-$ | H | CN | H | CN | Na |
| I-20 | S | S | $(CH_2)_3SO_3^-$ | $(CH_2)_3SO_3^-$ | H | $NO_3$ | H | $NO_3$ | Na |
| I-21 | S | S | $(CH_2)_3SO_3^-$ | $(CH_2)_3SO_3^-$ | H | $SOCH_3$ | H | $SOCH_3$ | Na |
| I-22 | S | S | $(CH_2)_2-CH=CHSO_3^-$ | $(CH_2)_2-CH=CHSO_3^-$ | H | Cl | H | Cl | Na |
| I-23 | S | S | $(CH_2)_3SO_3^-$ | $(CH_2)_3SO_3^-$ | H | $COCH_3$ | H | $COCH_3$ | Na |
| I-24 | S | S | $CH_2CF_2CF_2H$ | $CH_2CF_2CF_2H$ | H | $COCH_3$ | H | $COCH_3$ | I |

I-25

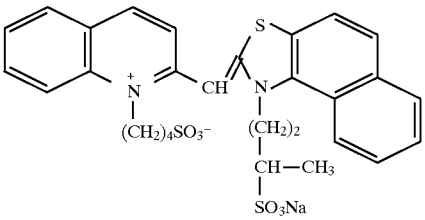

I-26

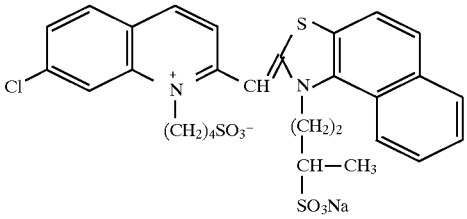

I-27

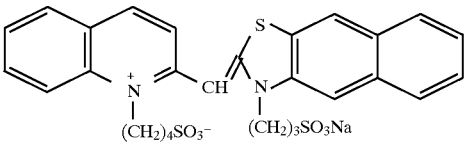

I-28

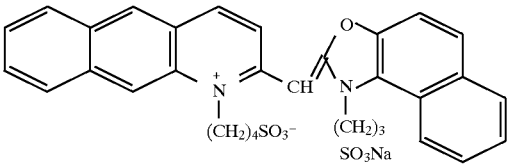

-continued
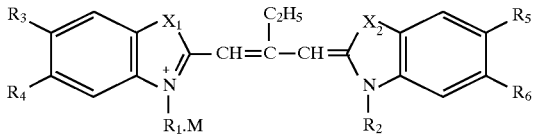
| $X_1$ | $X_2$ | $R_1$ | $R_2$ | $R_3$ | $R_4$ | $R_5$ | $R_6$ | M |
|---|---|---|---|---|---|---|---|---|
I-29
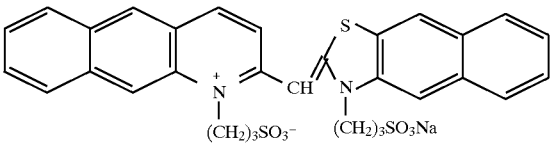
I-30
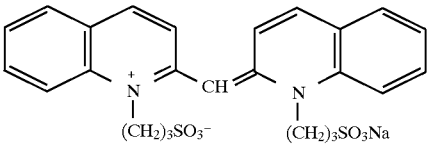
I-31
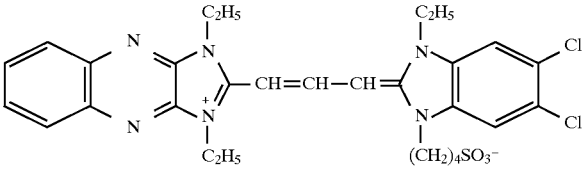
I-32
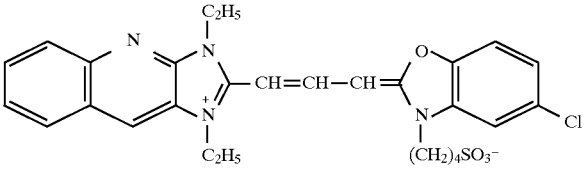
I-33
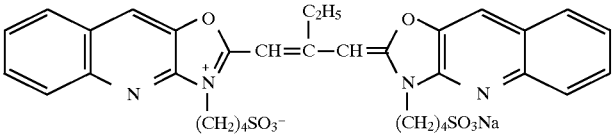
I-34
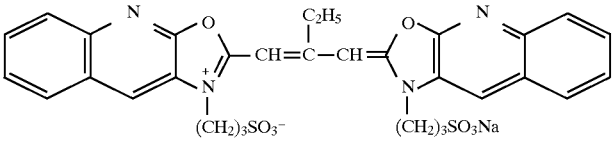
Examples of dyes which are not within the scope of the hole-injection-type sensitizing dyes referred to herein are mentioned below.

S-1
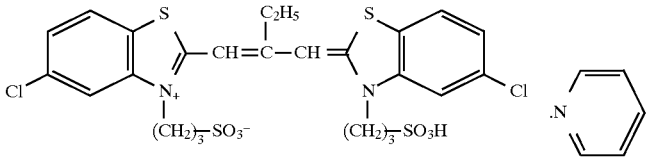
S-2
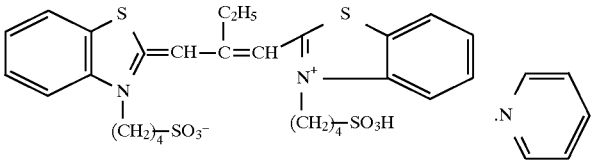
S-3
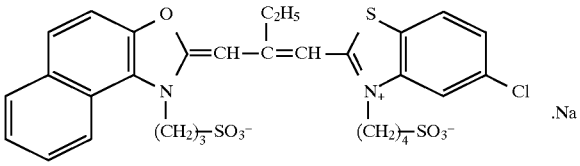
S-4
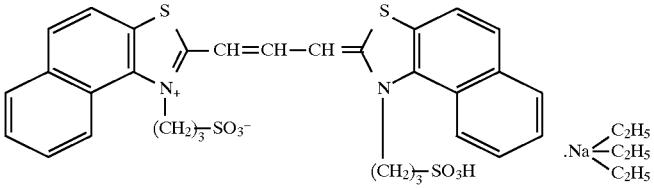
S-5
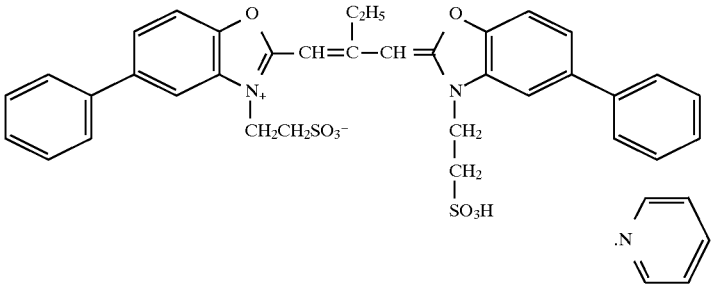
S-6
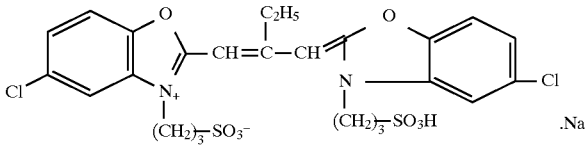
S-7
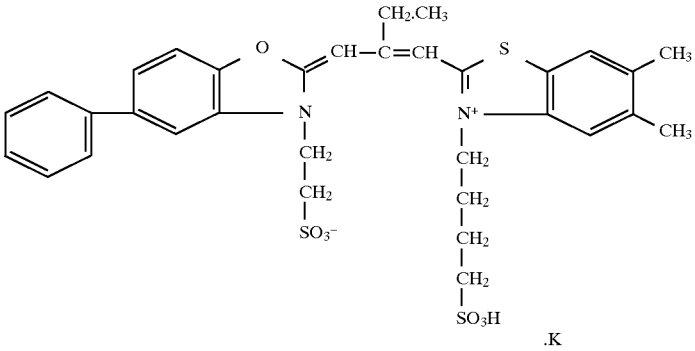

-continued
S-8
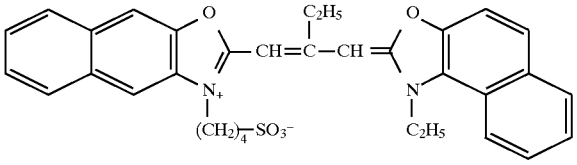
S-9
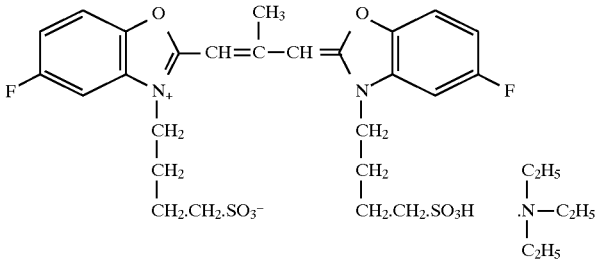
S-10
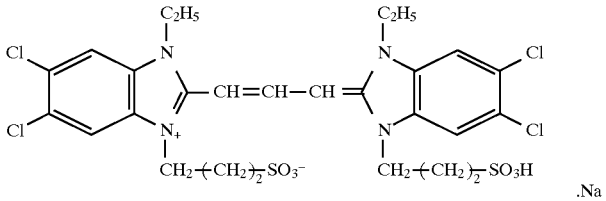
S-11
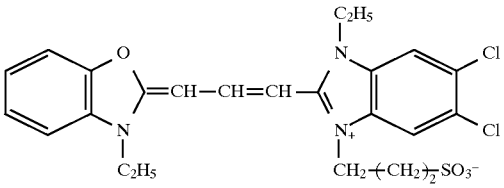
S-12
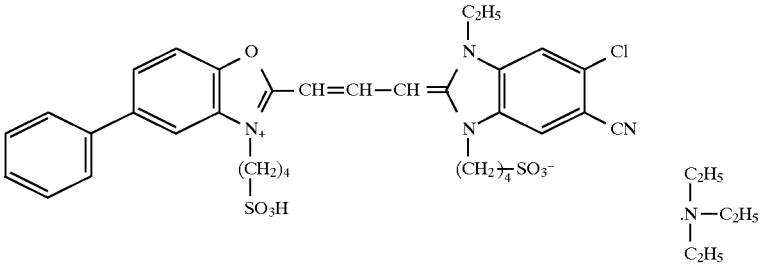
S-13
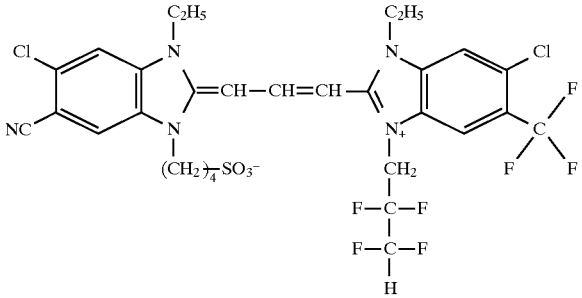
S-14
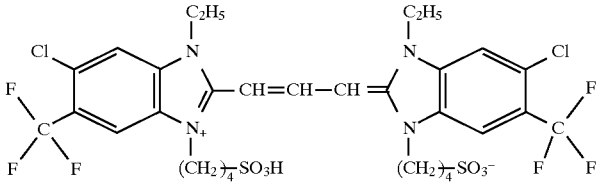

-continued

S-15

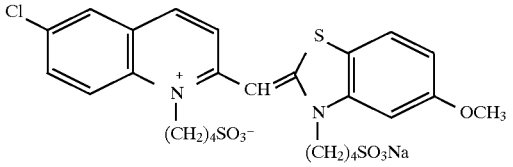

S-16

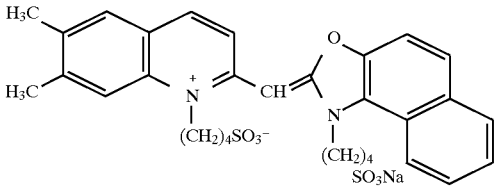

Next, the supersensitizing compounds for use in the present invention are mentioned below.

The terminology "supersensitization" is generally used for indicating the action of increasing the electron transfer efficiency of sensitizing dyes in photographic emulsions (thereby increasing ϕr of the negative image to be formed). Regarding the mechanism of the "supersensitization", various theories are known. In general, however, the above-mentioned electron-transfer-type or energy-transfer-type mechanism has been accepted.

The "supersensitization" as referred to herein is meant to indicate both the general action of increasing the electron transfer efficiency of the sensitizing dyes in photographic emulsions (thereby increasing ϕr of the negative image to be formed) and the action of increasing ϕr of the reversal image to be formed.

The supersensitizing compound for use in the present invention may be any compound that satisfies all the above-mentioned conditions (1), (3) and (4), when it is combined with the hole-injection-type sensitizing dye of the present invention. The most suitable supersensitizing compound generally differs, depending on the type of the hole-injection-type sensitizing dye to be selectively combined with the compound. As preferred examples of the supersensitizing compound for use in the present invention, mentioned are the sensitizing dyes described in U.S. Pat. Nos. 3,703,377, 2,688,545, 3,397,060, 3,615,635, 3,628,964, British Patents 1,242,588, 1,293,862, JP-B-43-4936, JP-B-44-14030, JP-B-43-10773, U.S. Pat. No. 3,416,927, JP-B-43-4930, U.S. Pat. Nos. 3,615,632, 3,617,295, 3,635,721, etc.; the holopolar cyanines described in British Patent 1,153,343, U.S. Pat. No. 4,546,073, JP-A-59-148053, etc.; hemicyanines and hemicyanine bases described in U.S. Pat. No. 4,152,163, JP-B-49-17525, JP-B-48-38406; the aminostyryl compounds described in British Patents 1,351,149, 1,230,449, 1,310,994, etc.

The supersensitizing compound for use in the present invention is preferably such that it results in the increase in ϕr of the negative image formed (Δϕr) of 0.2 or more, more preferably 0.4 or more.

Δϕr is obtained by the method mentioned below.

Using the standard emulsion for the evaluation of the condition (2), a sample containing only the hole-injection-type sensitizing dye and a sample containing both the hole-injection-type sensitizing dye and the supersensitizing compound at a practical ratio are formed. These samples were exposed and processed to form negative images thereon, and ϕr of each negative image formed is obtained. Δϕr is obtained according to the following equation.

Δϕr=(ϕr of the negative image formed on the sample containing both the sensitizing dye and the supersensitizing compound)−(ϕr of the negative image formed on the sample containing only the sensitizing dye)

The amount of the supersensitizing compound to be in the emulsion of the present invention may be any one that satisfies the conditions (1), (3) and (4) when combined with the hole-injection-type sensitizing dye. Preferably, however, the molar ratio of the compound to be in the emulsion is from 0.003 to 0.3, relative to the sensitizing dye combined with it.

The above-mentioned hole-injection-type sensitizing dye and supersensitizing compound can be added to the emulsion of the present invention at any desired stage which has heretofore been known employable in producing photographic emulsions. Most generally, the addition is conducted after the completion of the chemical sensitization of the emulsion but before coating the emulsion. It is possible to add these to the emulsion along with the addition of chemical sensitizers thereto, by which the spectral sensitization and the chemical sensitization of the emulsion are conducted at the same time, according to the technique disclosed in U.S. Pat. Nos. 3,628,969 and 4,225,666. It is also possible to add these to the emulsion prior to the addition of chemical sensitizers thereto or prior to the completion of the formation of silver halide grains thereby to previously start the color sensitization of the grains in the emulsion, according to the technique disclosed in JP-A-58-113929. It is also possible to divide these compounds into plural parts and add them to the emulsion at different times or, that is, to add parts of these compounds to the emulsion prior to the chemical sensitization of the emulsion and thereafter add the remaining parts to the emulsion after its chemical sensitization, according to the teaching disclosed in U.S. Pat. No. 4,225,666. It is also possible to add these to the emulsion at any stage during the formation of silver halide grains in the emulsion, according to the technique disclosed in U.S. Pat. No. 4,183,756.

It is most preferred that the hole-injection-type sensitizing dye and the supersensitizing compound of the present invention are simultaneously added to the silver halide emulsion, but these may be added thereto at different times according to the embodiments mentioned hereinabove. The emulsion of the present invention may contain one or more hole-injection-type sensitizing dyes satisfying the conditions of the present invention, along with the supersensitizing compound, in order to have the intended spectral sensitivity.

If desired, the emulsion of the present invention may contain, in addition to the hole-injection-type sensitizing dye(s), other sensitizing dye(s) not falling within the scope of the hole-injection-type sensitizing dyes of the present invention. Such additional sensitizing dye(s) may be added to the emulsion simultaneously with or separately from the addition of the hole-injection-type sensitizing dye(s) thereto.

As examples of such additional sensitizing dyes which are outside the scope of the hole-injection-type sensitizing dyes of the present invention and which may be added to the emulsion in addition to the hole-injection-type sensitizing dye(s), mentioned are cyanine dyes, merocyanine dyes, complex cyanine dyes, complex merocyanine dyes, holopolar cyanine dyes, styryl dyes, hemicyanine dyes, oxonole dyes, hemioxonole dyes, etc. These are described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, 2,503,776, JP-A-48-76525, Belgian Patent 691,807.

Preferably, 50% or more, more preferably, 80% or more of the dyes to be in the emulsion of the present invention are added to the emulsion prior to the start of the chemical sensitization of the emulsion.

The amount of the sensitizing dye(s) to be added to the emulsion is from $4\times10^{-6}$ to $8\times10^{-3}$ mol, per mol of the silver halide in the emulsion. More preferably, it is approximately from $5\times10^{-5}$ to $2\times10^{-3}$ mol, per mol of the silver halide in the emulsion, when the silver halide grains in the emulsion have a grain size of from 0.2 to 1.2 $\mu$m.

It is desirable that 50% or more, more preferably 70% or more, most preferably 90% or more, of all the sensitizing dyes to be in the silver halide emulsion of the present invention are the hole-injection-type sensitizing dye(s) satisfying the conditions of the present invention.

The silver halide emulsion of the present invention is subjected to reduction sensitization. The reduction sensitization may be conducted at any site of the grains constituting the emulsion, for example, on the surfaces of the silver halide grains, in the inside of each grain, or on the surface and in the inside of each grain. The sensitizing effect of the present invention is the greatest, when the invention is applied to silver halide emulsions where the inside of each constitutive grain has been sensitized by reduction sensitization. The emulsions thus sensitized according to the present invention are preferred, since they are fogged little during storage.

The reduction sensitization of the inside of each grain constituting the silver halide emulsion can be conducted during the growth of the silver halide grains in the emulsion. To conduct the reduction sensitization of this type, for example, the silver halide grains may be subjected to reduction sensitization during the physical ripening of the grains, or may be subjected to reduction sensitization during the addition of water-soluble silver salt(s) and water-soluble alkali halide(s) to the emulsion, or may be subjected to reduction sensitization while the addition of such salts to the emulsion is stopped for a while before the completion of the growth of the grains.

The reduction sensitization of the emulsion of the present invention can be conducted by any of a method of adding a reduction sensitizer to the silver halide in the emulsion, a so-called silver-ripening method where the silver halide grains are grown or ripened in a low-pAg atmosphere having pAg of from 1 to 7, and a so-called high-pH-ripening method where the silver halide grains are grown and ripened in a high-pH atmosphere having pH of from 8 to 11. If desired, the reduction sensitization can be conducted by two or more of these methods as combined.

The first method of adding a reduction sensitizer to the emulsion is preferred, since it is possible to delicately control the level of the reduction sensitization to be attained by this method.

As the reduction sensitizers to be employed in this method, for example, known are stannous salts, amines, polyamines, hydrazine derivatives, formamidinesulfinic acids, silane compounds, borane compounds, etc. Any of these known reduction sensitizers can be employed in conducting the reduction sensitization of the emulsion of the present invention. Two or more of these known reduction sensitizers, as combined, can be employed in the present invention. Since the amount of the reduction sensitizer to be added to the emulsion depends on the conditions for the production of the emulsion, it is necessary to add a suitably selected amount of the reduction sensitizer to the emulsion. Generally, however, the amount of the reduction sensitizer to be added to the emulsion is suitably from $10^{-7}$ to $10^{-2}$ mol per mol of the silver halide in the emulsion.

The reduction sensitizer is dissolved in a solvent, such as that selected from water, alcohols, glycols, ketones, esters and amides, and the resulting solution is added to the emulsion during the growth of the silver halide grains therein. This may be previously added to the reactor where the silver halide grains are formed. However, it is more desirable that this is added to the emulsion at a suitable stage during the growth of the grains therein. It is also possible to previously add the reduction sensitizer to either one or both of the aqueous solution of a water-soluble silver salt and the aqueous solution of a water-soluble alkali halide to be reacted, and these solutions are reacted to produce silver halide grains. It is also possible to add a solution of the reduction sensitizer to the emulsion at plural times with the growth of the grains in the emulsion, or to add it to the emulsion continuously for a long period of time. The last two methods are preferably employed in the present invention.

Reduced silver nuclei may exist on the surfaces of the silver halide grains in the emulsion of the present invention, after the inside of each grain has been subjected to the reduction sensitization in the manner as mentioned above. However, it is desirable that no reduced silver nucleus exist on their surfaces. In order to finish the internal reduction sensitization of the silver halide grains without making the reduced silver nuclei exist on the surfaces of the grains, the following means may be employed.

After the internal reduction sensitization of the silver halide grains has been conducted under the above-mentioned low-pAg-ripening and/or high-pH-ripening conditions, the low pAg of the reaction system is varied to a high pAg of 7 or higher at which the reduction is no more possible and/or the high pH of the reaction system is varied to a low pH of 8 or lower at which the reduction is no more possible, and thereafter each grain is coated with an outermost layer.

When the internal reduction sensitization of the silver halide grains has been conducted by the use of a reduction sensitizer, an oxidizing agent such as iodine may be added to the reaction system after the reduction, as in JP-B-58-1410. However, a small amount of the oxidizing agent added still remains even in the following step of chemical sensitization and retards the formation of the sensitivity specks in the emulsion. Therefore, the addition of such an oxidizing agent is unfavorable from the photographic viewpoint. For these reasons, the methods which are preferably employed in producing the silver halide grains of the present invention are a method of lowering the pH of the reaction system after the reduction to 5 or lower and thereafter forming the outermost layer on each grain while making the reduction sensitizer inactive during the formation, a method of removing the reduction sensitizer used by washing the grains with water after the reduction and thereafter forming the outermost layer on each grain, and a method of forming the outermost layer on each grain in the presence of at least one compound of the following formula (1), (2) or (3). At least one selected from these methods is preferably employed in order to attain the intended object.

$$R_{21}—SO_2—S—M \quad (1)$$

$$R_{21}—SO_2—S—R_{22} \quad (2)$$

$$R_{21}—SO_2—S—L_m—S—SO_2—R_{23} \quad (3)$$

wherein $R_{21}$, $R_{22}$ and $R_{23}$ may be the same or different and each represents an aliphatic group, an aromatic group or a heterocyclic group; M represents a cation; L represents a divalent linking group; and m represents 0 or 1.

The compounds of formula (1), (2) or (3) may be polymers each containing repeating units of the divalent group to be derived from any of the structures of formula (1), (2) or (3) or the divalent group to be derived from the structure of formula (3). If possible, the compounds may have ring(s) to be formed by $R_{21}$, $R_{22}$, $R_{23}$ and L bonded to each other.

The thiosulfonic acid compounds of formula (1), (2) or (3) are described in more detail hereinunder. The aliphatic group for $R_{21}$, $R_{22}$ and $R_{23}$ is a saturated or unsaturated, linear, branched or cyclic aliphatic hydrocarbon residue. Preferably, it is an alkyl group having from 1 to 22 carbon atoms or an alkenyl or alkynyl group having from 2 to 22 carbon atoms, which may optionally be substituted. The alkyl group includes, for example, methyl, ethyl, propyl, butyl, pentyl, hexyl, octyl, 2-ethylhexyl, decyl, dodecyl, hexadecyl, octadecyl, cyclohexyl, isopropyl and t-butyl groups. The alkenyl group includes, for example, allyl and butenyl groups. The alkynyl group includes, for example, propargyl and butynyl groups.

The aromatic group for $R_{21}$, $R_{22}$ and $R_{23}$ includes monocyclic and condensed-cyclic aromatic groups which may optionally be substituted. It preferably has from 6 to 20 carbon atoms. Examples of the group are optionally-substituted phenyl and naphthyl groups.

The heterocyclic group for $R_{21}$, $R_{22}$ and $R_{23}$ is derived from a 3-membered to 15-membered, preferably 3-membered to 6-membered ring having at least one element selected from nitrogen, oxygen, sulfur, selenium and tellurium and having at least one carbon atom. The rings includes, for example, pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole and thiadiazole rings.

As substituents with which the groups for $R_{21}$, $R_{22}$ and $R_{23}$ may be substituted, for example, mentioned are an alkyl group (e.g., methyl, ethyl, hexyl), an alkoxy group (e.g., methoxy, ethoxy, octyloxy), an aryl group (e.g., phenyl, naphthyl, tolyl), a hydroxyl group, a halogen atom (e.g., fluorine, chlorine, bromine, iodine), an aryloxy group (e.g., phenoxy), an alkylthio group (e.g., methylthio, butylthio), an arylthio group (e.g., phenylthio), an acyl group (e.g., acetyl, propionyl, butyryl, valeryl), a sulfonyl group (e.g., methylsulfonyl, phenylsulfonyl), an acylamino group (e.g., acetylamino, benzoylamino), a sulfonylamino group (e.g., methanesulfonylamino, benzenesulfonylamino), an acyloxy group (e.g., acetoxy, benzoxy), a carboxyl group, a cyano group, a sulfo group, an amino group, —$SO_2SM$ group (where M indicates a monovalent cation), and —$SO_2R$ group (where R indicates an alkyl group).

The divalent linking group for L is an atom or atomic group comprising at least one selected from C, N, S and O. Concretely, it includes an alkylene group, an alkenylene group, an alkynylene group, an arylene group, —O—, —S—, —NH—, —CO—, —$SO_2$—, etc., and a combination of two or more of these groups.

L is preferably a divalent aliphatic or aromatic group. Examples of the divalent aliphatic group for L include —$(CH_2)_n$— (where n is from 1 to 12), —$CH_2$—CH=CH—$CH_2$—, —$CH_2C{\equiv}CCH_2$—, —$CH_2$-1,4-cyclohexylene-$CH_2$-, xylylene group, etc. Examples of the divalent aromatic group for L include phenylene and naphthylene groups, etc.

These groups may optionally be substituted with substituents such as those mentioned hereinabove.

M is preferably a metal ion or an organic cation. The metal ion for M includes, for example, lithium ion, sodium ion and potassium ion. The organic cation for M includes, for example, an ammonium ion (e.g., ammonium, tetramethylammonium or tetrabutylammonium ion), a phosphonium ion (e.g., tetraphenylphosphonium ion), and a guanidyl group.

For polymers of formulae (1), (2) or (3), examples of the repeating units therein are as follows:

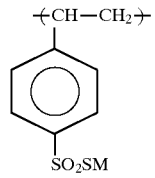

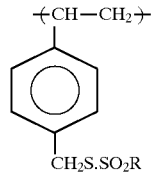

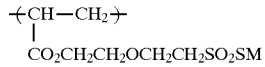

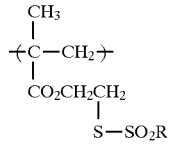

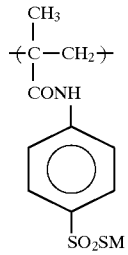

These polymers may be either homopolymers or copolymers with other comonomers.

Specific examples of the compounds of formula (1), (2) or (3) are mentioned below, which, however, are not limitative.

The compounds of formula (1), (2) or (3) can be produced by or according to the methods described in JP-A-54-1019, British Patent 972,211 and Journal of Organic Chemistry, Vol. 53, page 396 (1988).

$CH_3SO_2SNa$ (II-1)
$C_2H_5SO_2SNa$ (II-2)
$C_3H_7SO_2SK$ (II-3)
$C_4H_9SO_2SLi$ (II-4)
$C_6H_{13}SO_2SNa$ (II-5)
$C_8H_{17}SO_2SNa$ (II-6)

$CH_3(CH_2)_3CH(C_2H_5)CH_2SO_2S.NH_4$ (II-7)

$C_{10}H_{21}SO_2SNa$ (II-8)
$C_{12}H_{25}SO_2SNa$ (II-9)
$C_{16}H_{33}SO_2SNa$ (II-10)

$(CH_3)_2CH-SO_2SK$ (II-11)

t-$C_4H_9SO_2SNa$ (II-12)
$CH_3OCH_2CH_2SO_2S.Na$ (II-13)

(II-14)

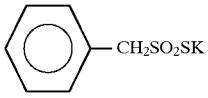

$CH_2{=}CHCH_2SO_2SNa$ (II-15)

(II-16)

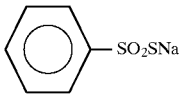

(II-17)

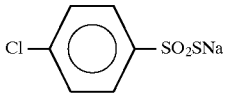

(II-18)

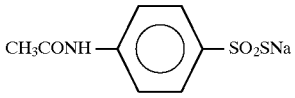

(II-19)

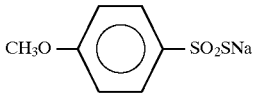

(II-20)

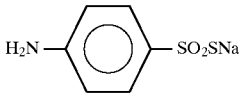

(II-21)

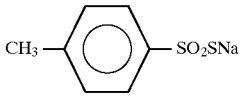

(II-22)

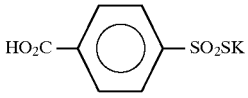

(II-23)

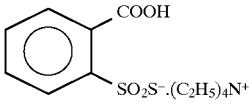

(II-24)

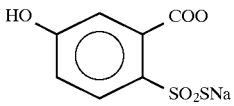

(II-25)

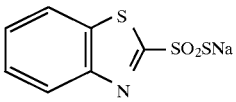

-continued (II-26)

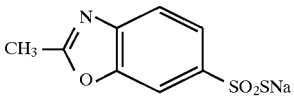

(II-27)

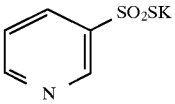

(II-28)

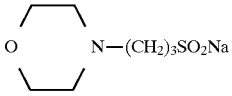

$NSSO_2(CH_2)_2SO_2SK$ (II-29)
$NaSSO_2(CH_2)_4SO_2SNa$ (II-30)
$NaSSO_2(CH_2)_4S(CH_2)_4SO_2SNa$ (II-31)

(II-32)

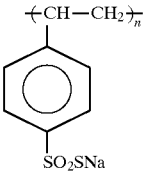

n = an integer (II-33)

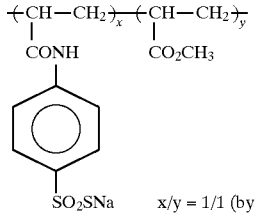

x/y = 1/1 (by mol)

$C_2H_5SO_2S-CH_3$ (III-1)
$C_8H_{17}SO_2SCH_2CH_3$ (III-2)

(III-3)

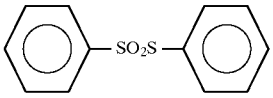

(III-4)

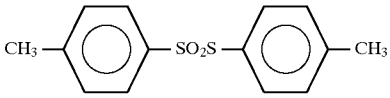

$C_2H_5SO_2SCH_2CH_2CN$ (III-5)

(III-6)

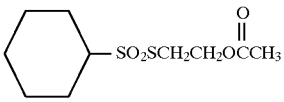

(III-7)

$C_4H_9SO_2SCH(CH_3)CH_2CN$ (III-8)

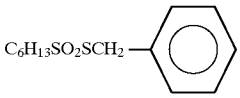

(III-9)

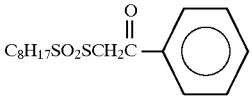

-continued (III-10)

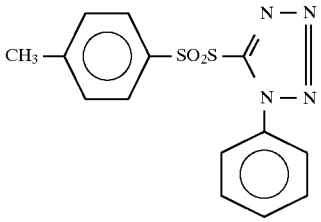

(III-11)

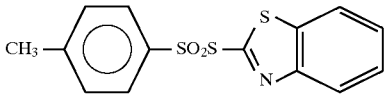

(III-12)

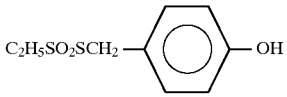

(III-13)

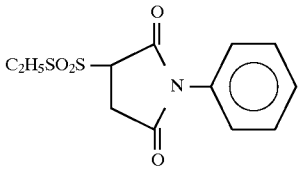

(III-14)

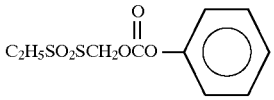

(III-15)

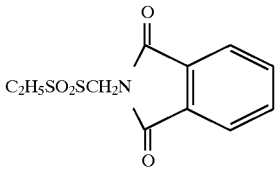

(III-16)

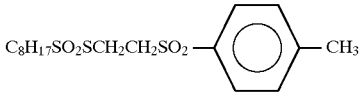

(III-17)

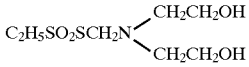

(III-18)

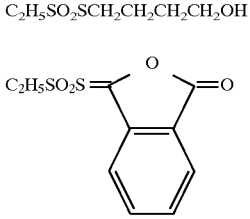

(III-19)

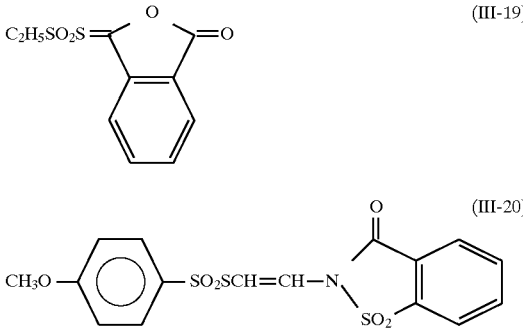

(III-20)

(III-21)

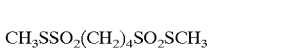

(III-22)

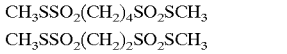

-continued (III-23)

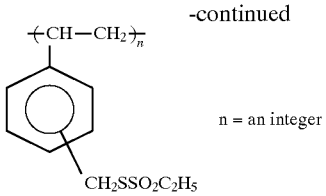

n = an integer (III-24)

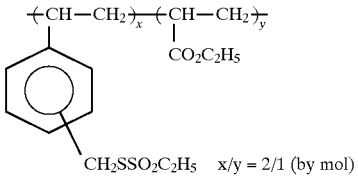

x/y = 2/1 (by mol)

(III-25)

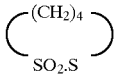

(IV-1)

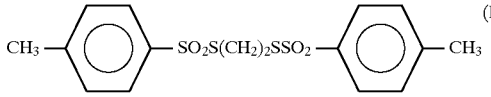

(IV-2)

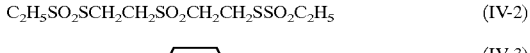

(IV-3)

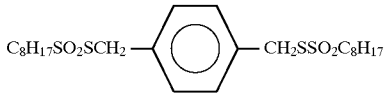

(IV-4)

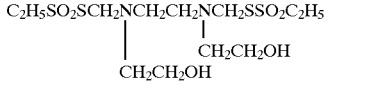

(IV-5)

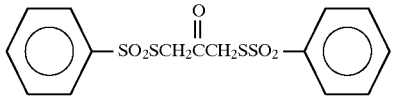

(IV-6)

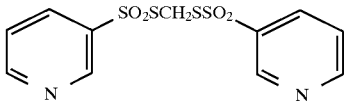

(IV-7)

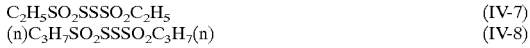

(IV-8)

(IV-9)

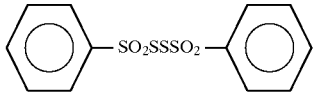

It is desirable that the amount of the compound of formula (1), (2) or (3) to be added to the emulsion of the present invention is selected from a range between $10^{-7}$ and $10^{-1}$ mol, more preferably between $10^{-6}$ and $10^{-2}$ mol, even more preferably between $10^{-5}$ and $10^{-3}$ mol, per mol of silver in the emulsion. The compound of formula (1), (2) or (3) may be added to the emulsion at any stage during the formation of the silver halide grains in the emulsion or before and after the chemical sensitization of the emulsion. Preferably, however, it is added before the chemical sensitization of the emulsion. More preferably, it is added during the formation of the grains.

The compound of formula (1), (2) or (3) may be added to the emulsion at any stage before or after the start of the reduction sensitization of the emulsion. Preferably, however, it is added after the start of the reduction sensitization.

To add the compound of formula (1), (2) or (3) to the emulsion during its formation, any ordinary method which is generally employed so as to add additives to photographic emulsions can be employed also in the present invention.

For instance, the compound which is soluble in water is dissolved in water to form an aqueous solution having a suitable concentration, while the compound which is insoluble or hardly soluble in water is dissolved in a suitable, water-miscible organic solvent which has no negative influence on the photographic properties of photographic emulsions and which is selected from, for example, alcohols, glycols, ketones, esters, amides, etc. to form its solution. The thus-formed solution is added to the emulsion of the present invention.

To sensitize the surfaces of the silver halide grains in the emulsion by reduction sensitization, the same methods as above may be employed.

The silver halide grains to be in the emulsion of the present invention may have any desired size. Preferably, however, these have a grain size falling within a range between 0.05 μm and 3.0 μm in terms of the diameter of the sphere corresponding to the grain. In particular, the present invention is especially effective, when it is applied to silver halide grains having a sphere-corresponding diameter of from 0.5 μm to 2.0 μm.

The silver halide grains for use in the present invention may be either tabular grains or normal crystalline grains. The normal crystalline grains may be either octahedral or cubic grains or may also be tetradecahedral grains as the intermediate between the former two. Preferred are tetradecahedral or octahedral grains having a proportion of {111} face of 70% or more. This is because the combination of the hole-injection-type sensitizing dye and the supersensitizing compound of the present invention exhibits a surprising effect in significantly increasing the sensitivity of the silver halide grains having a proportion of {111} face of 70% or more, when the dye and the compound are added to the grains.

The ratio of {100}/{111} in one grain can be obtained according to the Kubelka-Munk's dye adsorption method (hereinafter referred to as "Kubelka-Munk method"). According to this method, a dye which adsorbs preferentially onto either {100} face or {111} face of a silver halide grain in such a way that the condition of the resulting dye associate on the {100} face is spectrally different from that of the resulting dye associate on the {111} face is selected. A varying amount of the thus-selected dye is added to an emulsion, and the spectra of the emulsions that vary depending on the amount of the dye added are examined, from which the ratios of {100}/{111} in the grains constituting the emulsion is obtained. The details for the measurement of the ratio of faces of silver halide grains are described by T. Tani in "Identification of Crystal Phases of Silver Halide Grains in Photographic Emulsions by Utilizing Adsorption of Dyes onto the Grains" in the Journal of the Chemical Society of Japan, No. 6, pp. 942 to 946 (1984). Using the method disclosed in this reference, the ratios of faces of the silver halide grains for use in the present invention can be obtained.

The silver halide grains for use in the present invention are most preferably tabular silver halide grains having a mean aspect ratio of 3 or more.

The tabular silver halide grain (hereinafter referred to as "tabular grain") as referred to herein indicates a generic name that includes silver halide grains each having one twin-plane or two or more parallel twin-planes. The twin-plane corresponds to {111} face, where all the lattice point ions are in enatiomorphous conditions at the both sides on the {111} face. When seen from its top, the tabular grain is triangular, hexagonal or circular, while having triangular, hexagonal or circular parallel outer surfaces, respectively.

The aspect ratio of the tabular grain as referred to herein is a value to be obtained by dividing the diameter of the grain (with a diameter of 0.1 μm or more) by its thickness.

The diameter of the grain as referred to herein is a diameter of the circle having the same area as the projected area of one of its parallel outer surfaces of the grain. The projected area of the grain can be obtained by measuring the area of the electromicroscopic image of the grain followed by correcting the magnification of the electronic microscope used. To measure the thickness of the grain, a metal is coated over the grain by metal vapor deposition in the oblique direction of the grain while a reference latex bead is also plated with the metal in the same manner, and the length of the shadow of the grain is measured by electromicroscopy. With reference to the length of the shadow of the reference latex bead also measured in the same manner, the thickness of the grain can easily be calculated from the thus-measured length of the shadow of the grain.

The mean aspect ratio as referred to herein is an arithmetical mean value of the aspect ratios of at least 100 silver halide grains measured.

The tabular grains for use in the present invention have a mean aspect ratio of 3 or more, preferably from 3 to less than 10, more preferably from 4 to less than 8.

The diameter and the thickness of the tabular grains are not specifically defined but may be any desired one, as long as the grains satisfy the condition that they have a mean aspect ratio of 3 or more. Preferably, however, the diameter of the grains falls from 0.3 to 5.0 μm, more preferably from 0.4 to 3.0 μm; and the thickness of the grains falls from 0.05 to 1.0 μm, more preferably from 0.05 to 0.3 μm.

Monodisperse tabular grains often give more favorable results. For the structure of monodisperse tabular grains for use in the present invention and the method for producing them, for example, the disclosure in JP-A-63-151618 is referred to. The morphology of the monodisperse tabular grains for use in the present invention is briefly mentioned hereinunder. The monodispersibility of the silver halide emulsion of the present invention is such that hexagonal tabular silver halide grains each having a ratio of the length of the longest side to that of the shortest side of 2 or less and having parallel two planes as its outer surface account for 70% or more of the whole projected area of all the grains in the emulsion and that the fluctuation coefficient of the grain size of the hexagonal tabular silver halide grains (value to be obtained by dividing the dispersion of the grain sizes each corresponding to the diameter of the circle having the projected area of the grain (standard deviation) by the mean grain size) is 25% or less. More preferably, the monodispersibility is such that the fluctuation coefficient is 20% or less.

It is desirable that the tabular grains for use in the present invention have dislocation lines. The dislocation lines of the tabular grains can be observed by a direct method of using a transmission electronic microscope at a low temperature, for example, as described in J. F. Hamilton, *Phot. Sci, Eng.*, 11, 57 (1967); T. Shiozawa, *J. Soc. Phot. Sci. Japan*, 35, 213 (1972); JP-A-63-220238, etc. Briefly, silver halide grains are carefully taken out from an emulsion in such a way that any pressure of causing dislocation of the grains is not imparted to the grains, the grains are put on a mesh for electromicroscopic observation and they are electromicroscopically observed by a transmission method under a cooled condition while preventing the damage (such as print-out) of the grains due to the electronic rays imparted thereto. In the observation, since the transmission of the electronic rays through thicker grains are more difficult, it is recommended to use a highvoltage electronic microscope for attaining more sharp observation. (For instance, an electronic microscope at 200 kV or higher may be used for observation of 0.25 μm-thick grains.) From the photographs of the grains thus obtained by the method, the positions and the numbers of the dislocation lines in each grain in the vertical direction from the main plane of the grain can be determined.

The photographic emulsions for use in the present invention may be prepared, for example, by the methods described by P. Glafkides in Chemie et Phisique Photographique (published by Paul Montel, 1967); by G. F. Duffin in Photographic Emulsion Chemistry (published by Focal Press, 1966); by V. L. Zelikman et al. in Making and Coating Photographic Emulsion (published by Focal Press, 1964). Briefly, they may be prepared by any of acid methods, neutral methods and ammonia methods. As the system of reacting soluble silver salts and soluble halides, employable is any of a single jet method, a double jet method and a combination of them. Also employable is a so-called reversed mixing method where silver halide grains are formed in an atmosphere having excess silver ions. As one system of a double jet method, employable is a so-called controlled double jet method, in which the pAg in the liquid phase where silver halide grains are being formed is kept constant. According to this method, silver halide emulsions comprising regular crystalline grains having nearly uniform grain sizes may be obtained.

A method of forming a photographic emulsion by adding silver halide grains that have been separately prepared to the reactor where the emulsion is formed, and also the methods described in U.S. Pat. Nos. 4,334,012, 4,301,241, 4,150,994 are often preferably employed. In these methods, the silver halide grains that have been separately prepared can be used as seed crystals, or it is effective to add the grains to the reactor where an emulsion is being formed in order to grow the silver halide grains in the emulsion. In the latter case, it is preferred that the silver halide grains to be added to the emulsion have a small grain size. To add such fine silver halide grains having a small grain size to the emulsion, various methods may be employed. For example, the fine grains are added to the emulsion all at a time, or the fine grains are divided into plural parts and the thus-divided parts are intermittently added to the emulsion at several times, or the fine grains are gradually and continuously added to the emulsion. It is often effective to add silver halide grains having different halide compositions to the emulsion being produced in order to modify the surfaces of the grains being grown in the emulsion.

A method of modifying a major part or only a small part of the halide compositions of silver halide grains by halogen conversion is described in, for example, U.S. Pat. Nos. 3,477,852, 4,142,900, European Patents 273,429, 273,430, West German Patent Application (OLS) No. 3,819,241. This is an effective grain-forming method. According to this method, soluble halide solutions or silver halide grains may be added to the emulsion being produced, by which more hardly-soluble silver halide grains are formed. To conduct this halogen conversion, various methods can be employed. For instance, the silver halide grains to be modified by halogen conversion are modified all at a time, or the grains are intermittently modified at plural times, or the grains are gradually and continuously modified.

Apart from the above-mentioned methods where the silver halide grains are grown by adding thereto soluble silver salts and halides all at constant concentrations and at constant flow rates, other methods are also preferably employed where the concentrations of the solution of the salts to be added are varied or the flow rates of the solutions of the salts to be added are varied. These methods are described in, for example, British Patent 1,469,480, U.S. Pat. Nos. 3,650,757, 4,242,445. By increasing the concentrations of the solution of the salts to be added or by accelerating the flow rates of the solutions of the salts to be added, it is possible to vary the amounts of the silver halides to be added as a primary function, a secondary function or more complicated functions relative to the time for the addition. As the case may be, it is often desirable to decrease the amounts of the silver halides to be added. When plural solutions of soluble silver salts having different compositions are added or when plural solutions of soluble halides having different compositions are added, it is also effective to increase the amounts of some of these solutions while decreasing the amounts of some others.

Examples of the reactors to be used for reacting soluble silver salts and soluble halides to produce silver halides therein are described in U.S. Pat. Nos. 2,996,287, 3,342,605, 3,415,650, 3,785,777, West German Patent Application (OLS) Nos. 2,556,885, 2,555,364. These can be used for producing the photographic emulsions of the present invention.

It is effective to use solvents for silver halides so as to accelerate the ripening of the silver halide grains formed. For example, it is known to make excess halide ions exist in the reactor in order to accelerate the ripening of the silver halide grains being formed therein. Other ripening agents may also be used for this purpose. All the necessary amount of such a ripening agent may be previously incorporated into the dispersing medium in the reactor prior to the addition of silver salts and halide salts to the reactor, or the ripening agent may be added to the reactor along with halides and silver salts or with a peptizer. As another embodiment different from these, a ripening agent may be independently added to the reactor at the stage when halides and silver salts are added thereto.

As concrete examples of ripening agents which can be employed in the present invention, there are mentioned ammonia, thiocyanates (e.g., potassium rhodanate, ammonium rhodanate), organic thioether compounds (e.g., the compounds described in U.S. Pat. Nos. 3,574,628, 3,021,215, 3,057,724, 3,038,805, 4,276,374, 4,297,439, 3,704,130, 4,782,013, JP-A-57-104926), thione compounds (e.g., the tetra-substituted thioureas described in JP-A-53-82408, JP-A-55-77737, U.S. Pat. No. 4,221,863; the compounds described in JP-A-53-144319), mercapto compounds capable of accelerating the growth of silver halide grains (e.g., the compounds described in JP-A-57-202531), amine compounds (e.g., the compounds described in JP-A-54-100717).

Gelatin is effectively employed as the protective colloid to be used in producing the silver halide emulsions of the present invention and also as the binder to be in hydrophilic colloid layers constituting the photographic material of the present invention. However, hydrophilic colloids other than gelatin may also be employed.

As examples of the protective colloids and binders usable in the present invention, there are mentioned proteins such as gelatin derivatives, graft polymers of gelatin and other polymer segments, albumin, casein, etc.; cellulose derivatives such as hydroxyethyl cellulose, carboxymethyl cellulose, cellulose sulfate esters, etc.; saccharide derivatives such as sodium alginate, starch derivatives, etc.; various synthetic hydrophilic homo- or copolymer substances such as polyvinyl alcohol, partially-acetalized polyvinyl alcohol, poly-N-vinylpyrrolidone, polyacrylic acid, polymethacrylic acid, polyacrylamide, polyvinylimidazole, polyvinylpyrazole, etc.

As gelatin, employable is lime-processed gelatin as well as acid-processed gelatin and also enzyme-processed gelatin such as that described in Bull. Soc. Sic. Photo. Japan, No. 16, p. 30 (1966). In addition, hydrolysates and enzymolysates of gelatin may also be used.

It is desirable that the silver halide emulsion of the present invention is washed in water for de-salting and it is dispersed in a newly-prepared protective colloid. The temperature for the washing may be selected in accordance with the object. Preferably, however, it is selected from the range between 5° C. and 50° C. The pH in the washing system may also be selected in accordance with the object. Preferably, however, it is selected from the range between 2 and 10, more preferably between 3 and 8. The pAg in the washing system may also be selected in accordance with the object. Preferably, however, it is selected from the range between 5 and 10. To conduct the washing, any of a noodle washing method, a dialyzing method using a semi-permeable membrane, a centrifuging method, a flocculating method and an ion-exchanging method may be employed. In the flocculating method, any of sulfates, organic solvents, water-soluble polymers and gelatin derivatives may be used.

The silver halide grains for use in the present invention may be subjected to at least one sensitization of sulfur sensitization, selenium sensitization, gold sensitization, palladium sensitization and noble metal sensitization, at any stage during the production of the silver halide emulsion. It is desirable that the grains are subjected to the combination of two or more of these sensitizing methods. Emulsions of different types are produced, depending on when emulsions are subjected to chemical sensitization during their production. There are known silver halide grains having chemically-sensitized nuclei embedded in the inside of each grain by chemical sensitization, those having chemically-sensitized nuclei embedded in the site near to the surface of each grain by chemical sensitization, and those having chemically-sensitized nuclei formed on the surface of each grain by chemical sensitization. The silver halide grains for use in the present invention may be subjected to any chemical sensitization to have chemically-sensitized nuclei formed in any desired site of each grain. In general, however, the grains preferably have at least one chemically-sensitized nuclei formed in the vicinity of the surface of each grain.

The silver halide grains for use in the present invention are preferably subjected to chalcogenide sensitization and/or noble metal sensitization, which may be effected, for example, according the method described by T. H. James in The Theory of the Photographic Process, 4th Ed. (published by Macmillan, 1977), pp. 67–76, using an active gelatin, or according to the methods described in *Research Disclosure*, Vol. 120 (April, 1974, Item 12008), *Research Disclosure*, Vol. 34 (June, 1975, Item 13452), U.S. Pat. Nos. 2,642,361, 3,297,446, 3,772,031, 3,857,711, 3,901,714, 4,266,018, 3,904,415, British Patent 1,315,755, using one or more sensitizers selected from sulfur, selenium, tellurium, gold, platinum, palladium and iridium compounds, at pAg of from 5 to 10, at pH of from 5 to 8 and at a temperature of from 30° to 80° C. In the noble metal sensitization, for example, usable are salts of noble metals of gold, platinum, palladium and iridium. In particular, gold sensitization, palladium sensitization and the combination thereof is preferred. In the gold sensitization, for example, usable are known compounds such as chloroauric acid, potassium chloroaurate, potassium aurithiocyanate, gold sulfide, gold selenide, etc. The palladium compounds to be used in the palladium sensitization are salts of palladium(II) or palladium(IV). As the palladium compounds, preferably used are $R_2PdX_6$ and $RPdX_4$ (where R represents a hydrogen atom, an alkali metal or an ammonium group; and X represents a halogen atom such as chlorine, bromine or iodine atom).

As preferred examples of the palladium compounds, mentioned are $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$. The gold compounds and palladium compounds are preferably used along with thiocyanates or selenocyanates.

Where the emulsions of the present invention are subjected to sulfur sensitization, sodium thiosulfate (hypo), thiourea compounds, rhodanine compounds and also sulfur-containing compounds such as those described in U.S. Pat. Nos. 3,857,711, 4,266,018, 4,054,457 may be used as sulfur sensitizers. The chemical sensitization may be conducted in the presence of a so-called chemical sensitization aid. The chemical sensitization aid includes compounds which are known to have the ability to inhibit the emulsion from being fogged during chemical sensitization while increasing the sensitivity of the emulsion, such as azaindenes, azapyridazines and azapyrimidines. Examples of such chemical sensitization aids and modifiers are described in U.S. Pat. Nos. 2,131,038, 3,411,914, 3,554,757, JP-A-58-126526 and in the above-mentioned Duffin's Photographic Emulsion Chemistry, pp. 138–143.

The silver halide emulsion of the present invention is preferably subjected to gold sensitization along with the above-mentioned chemical sensitization. The amount of the gold sensitizer to be used for subjecting the emulsion to gold sensitization is preferably from $1\times10^{-7}$ to $1\times10^{-4}$ mol, more preferably from $5\times10^{-7}$ to $1\times10^{-5}$ mol, per mol of the silver halide in the emulsion.

The amount of the above-mentioned palladium compound to be used for the palladium sensitization is preferably from $5\times10^{-7}$ to $1\times10^{-3}$ mol, per mol of the silver halide in the emulsion to be sensitized therewith. The amount of the thiocyanide compound or the selenocyanide compound to be used is preferably from $1\times10^{-6}$ to $5\times10^{-2}$ mol, per mol of the silver halide in the emulsion to be sensitized therewith.

The amount of the sulfur sensitizer to be added to the silver halide grains of the present invention so as to sensitize them is preferably from $1\times10^{-7}$ to $1\times10^{-4}$ mol, more preferably from $5\times10^{-7}$ to $1\times10^{-5}$ mol, per mol of the silver halide.

Selenium sensitization is preferably applied to the silver halide emulsion of the present invention. In the selenium sensitization, employable are known unstable selenium compounds, such as for example, colloidal selenium metal, selenoureas (e.g., N,N-dimethylselenourea, N,N-diethylselenourea), selenoketones, selenoamides, etc. It is often preferred that the selenium sensitization is combined with sulfur sensitization and/or noble metal sensitization.

The photographic emulsions for use in the present invention may contain various compounds for the purpose of inhibiting the emulsions from being fogged or of stabilizing the photographic properties of the emulsions during the production, storage or processing of photographic materials comprising the emulsions. For these purposes, the emulsions may contain various compounds which are known as anti-foggants or stabilizers, for example, thiazoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole); mercaptopyrimidines; mercaptotriazines; thioketo compounds such as oxazolinethiones; azaindenes such as triazaindenes, tetrazaindenes (especially, hydroxy-substituted (1,3,3a,7)-tetrazaindenes), pentazaindenes, etc. In addition to these, the compounds described in U.S. Pat. Nos. 3,954,474, 3,982,947, JP-B-52-28660 may also be used for these purposes. The compounds described in JP-A-63-212932 are also preferably used. These antifoggants and stabilizers may be added to the emulsions at any stage before, during or after the formation of the silver halide grains, during the step of washing the grains, during the dispersion of the grains after the washing step, before, during or after the chemical sensitization of the grains, or before the coating of the emulsions, in accordance with the intended objects. In addition to adding such antifoggants and stabilizers to the emulsions in order to make them exhibit their intrinsic antifogging and stabilizing effects, it is also possible to add them to the emulsions during the preparation of the emulsions for other various purposes of controlling the crystal habit of the grains in the emulsions, reducing the grain size of the grains, reducing the solubility of the grains, retarding the chemical sensitization of the grains, and controlling the arrangement of the dyes added to the emulsions.

The silver halide photographic material of the present invention may contain the above-mentioned various additives. In addition to these, it may further contain any other various additives.

The additives which may be added to the photographic material of the present invention are described in detail in *Research Disclosure* (RD), Item 17643 (December, 1978), ibid., Item 18716 (November, 1979) and ibid., Item 307105 (November, 1989), and the related disclosures are mentioned below.

| Additives | RD 17643 | RD 18716 | RD 307105 |
|---|---|---|---|
| 1. Chemical Sensitizers | p. 23 | p. 648, right column | p. 996 |
| 2. Sensitivity Enhancers | | p. 648, right column | |
| 3. Spectral Sensitizers Supersensitizers | pp. 23 to 24 | p. 648, right column to p. 649, right column | p. 966, right column to p. 998, right column |
| 4. Whitening Agents | p. 24 | | p. 998, right column |
| 5. Anti-foggants Stabilizers | pp. 24 to 25 | p. 649, right column | p. 998, right column to p. 1000, right column |
| 6. Light-Absorbents Filter Dyes Ultraviolet Absorbents | pp. 25 to 26 | p. 649, right column to p. 650, left column | p. 1003, left and right columns |
| 7. Stain Inhibitors | p. 25, right column | p. 650, left and right columns | |
| 8. Color Image Stabilizers | p. 25 | | |
| 9. Hardening Agents | p. 26 | p. 651, left column | p. 1004, right column to p. 1005, left column |
| 10. Binders | p. 26 | p. 651, left column | p. 1003, right column to p. 1004, right column |
| 11. Plasticizers Lubricants | p. 27 | p. 650, right column | p. 1006, left and right columns |
| 12. Coating Aids Surfactants | pp. 26 to 27 | p. 650, right column | p. 1005, left column to p. 1006, left column |
| 13. Antistatic Agents | p. 27 | p. 650, right column | p. 1006, right column to page 1007, left column |

Various photographic techniques and inorganic and organic materials which are employable in carrying out the present invention are described in EP-A-436938 and other patent publications mentioned below.

1. Layer Structures EP-A-436938, from page 146, line 34 to page 147, line 25
2. Yellow Couplers EP-A-436938, from page 137, line 35 to page 146, line 33, and page 149, lines 21 to 23
3. Magenta Couplers EP-A-436938, page 149, lines 24 to 28; EP-A-421453, from page 3, line 5 to page 25, line 55
4. Cyan Couplers EP-A-436938, page 149, lines 29 to 33; EP-A-432804, from page 3, line 28 to page 40, line 2
5. Polymer Couplers EP-A-436938, page 149, lines 34 to 38; EP-A-435334, from page 113, line 39 to page 123, line 37
6. Colored Couplers EP-A-436938, from page 53, line 42 to page 137, line 34, and page 149, lines 39 to 45
7. Other Functional Couplers EP-A-436938, from page 7, line 1 to page 53, line 41, and from page 149, line 46 to page 150, line 3; EP-A-435334, from page 3, line 1 to page 29, line 50
8. Antiseptics, Antifungals EP-A-436938, page 150, lines 25 to 28
9. Formalin Scavengers EP-A-436938, page 149, lines 15 to 17
10. Other Additives EP-A-436938, page 153, lines 38 to 47; EP-A-421453, from page 75, line 21 to page 84, lines 56, and from page 27, line 40 to page 37, line 40
11. Dispersing Methods EP-A-436938, page 150, lines 4 to 24
12. Supports EP-A-436938, page 150, lines 32 to 34
13. Thickness of Films, Properties of Films EP-A-436938, page 150, lines 35 to 49
14. Color Development Steps EP-A-436938, from page 150, line 50 to page 151, line 47
15. Desilvering Steps EP-A-436938, from page 151, line 48 to page 152, line 53
16. Automatic Developing Machines EP-A-436938, from page 152, line 54 to page 153, line 2
17. Washing and Stabilizing Steps EP-A-436938, page 153, lines 3 to 37

The present invention is described in more detail hereinunder by means of the following examples, which, however, are not intended to restrict the scope of the present invention.

EXAMPLE 1

Various sensitizing dyes were evaluated according to the evaluating methods referred to herein and the results are shown in Table 1 below.

TABLE 1

| Sample No. | Dye | Super-sensitizing Compound | Condition (1) Absorption Peak Wavelength | Condition (2) ϕr of Negative Image (dye only) | Δϕr (negative image) | Condition (3) Intrinsic Desensitization of Reversal Image | Condition (4) ϕr of Reversal Image | |
|---|---|---|---|---|---|---|---|---|
| Sample 1 | I-1 | S-7 (5 mol %) | 548 nm | 0.40 | 0.53 | 0.04 | 0.92 | sample of the invention |
| Sample 2 | I-2 | S-7 (5 mol %) | 553 nm | 0.46 | 0.45 | 0.06 | 0.86 | sample of the invention |
| Sample 3 | I-3 | S-7 (5 mol %) | 558 nm | 0.35 | 0.63 | 0.01 | 0.95 | sample of the invention |
| Sample 4 | I-4 | S-7 (5 mol %) | 547 nm | 0.38 | 0.57 | 0.02 | 0.93 | sample of the invention |
| Sample 5 | I-5 | S-7 (5 mol %) | 550 nm | 0.30 | 0.70 | 0.01 | 0.97 | sample of the invention |
| Sample 6 | I-6 | S-7 (5 mol %) | 549 nm | 0.21 | 0.61 | 0.02 | 0.82 | sample of the invention |
| Sample 7 | I-7 | S-7 (5 mol %) | 549 nm | 0.46 | 0.40 | 0.05 | 0.87 | sample of the invention |
| Sample 8 | I-8 | S-7 (5 mol %) | 553 nm | 0.51 | 0.34 | 0.13 | 0.85 | sample of the invention |
| Sample 9 | I-9 | S-7 (5 mol %) | 560 nm | 0.35 | 0.55 | 0.05 | 0.91 | sample of the invention |
| Sample 10 | I-10 | S-7 (5 mol %) | 547 nm | 0.20 | 0.71 | 0.01 | 0.92 | sample of the invention |
| Sample 11 | I-11 | S-7 (5 mol %) | 563 nm | 0.55 | 0.33 | 0.11 | 0.87 | sample of the invention |
| Sample 12 | I-12 | S-7 (5 mol %) | 560 nm | 0.22 | 0.75 | 0.01 | 0.97 | sample of the invention |
| Sample 13 | I-13 | S-7 (5 mol %) | 581 nm | 0.45 | 0.40 | 0.09 | 0.83 | sample of the invention |
| Sample 14 | I-14 | S-7 (5 mol %) | 579 nm | 0.39 | 0.50 | 0.07 | 0.87 | sample of the invention |
| Sample 15 | I-15 | S-7 (5 mol %) | 580 nm | 0.35 | 0.59 | 0.09 | 0.89 | sample of the invention |
| Sample 16 | I-16 | S-4 (3 mol %) | 591 nm | 0.48 | 0.38 | 0.14 | 0.82 | sample of the invention |
| Sample 17 | I-17 | S-4 (3 mol %) | 592 nm | 0.31 | 0.58 | 0.10 | 0.85 | sample of the invention |
| Sample 18 | I-18 | S-4 (3 mol %) | 648 nm | 0.43 | 0.40 | 0.13 | 0.82 | sample of the invention |
| Sample 19 | I-19 | S-4 (3 mol %) | 645 nm | 0.38 | 0.51 | 0.11 | 0.85 | sample of the invention |
| Sample 20 | I-20 | S-4 (3 mol %) | 638 nm | 0.31 | 0.62 | 0.08 | 0.87 | sample of the invention |
| Sample 21 | I-21 | S-4 (3 mol %) | 654 nm | 0.44 | 0.38 | 0.17 | 0.80 | sample of the invention |
| Sample 22 | I-22 | S-4 (3 mol %) | 652 nm | 0.45 | 0.39 | 0.15 | 0.81 | sample of the invention |
| Sample 23 | I-23 | S-4 (3 mol %) | 656 nm | 0.41 | 0.45 | 0.14 | 0.83 | sample of the invention |
| Sample 24 | I-24 | S-4 (3 mol %) | 653 nm | 0.38 | 0.51 | 0.10 | 0.87 | sample of the invention |
| Sample 25 | I-25 | S-7 (5 mol %) | 560 nm | 0.30 | 0.68 | 0.01 | 0.98 | sample of the invention |
| Sample 26 | I-26 | S-7 (5 mol %) | 557 nm | 0.31 | 0.68 | 0.01 | 0.98 | sample of the invention |
| Sample 27 | I-27 | S-7 (5 mol %) | 554 nm | 0.34 | 0.60 | 0.03 | 0.95 | sample of the invention |
| Sample 28 | I-28 | S-7 (5 mol %) | 551 nm | 0.36 | 0.64 | 0.01 | 0.99 | sample of the invention |
| Sample 29 | I-29 | S-7 (5 mol %) | 561 nm | 0.41 | 0.56 | 0.01 | 0.98 | sample of the invention |
| Sample 30 | I-30 | S-7 (5 mol %) | 579 nm | 0.38 | 0.57 | 0.03 | 0.96 | sample of the invention |
| Sample 31 | I-31 | S-4 (3 mol %) | 621 nm | 0.12 | 0.78 | 0.14 | 0.83 | sample of the invention |
| Sample 32 | I-32 | S-7 (5 mol %) | 578 nm | 0.25 | 0.68 | 0.11 | 0.84 | sample of the invention |
| Sample 33 | I-33 | S-7 (5 mol %) | 562 nm | 0.32 | 0.65 | 0.03 | 0.96 | sample of the invention |
| Sample 34 | I-34 | S-7 (5 mol %) | 559 nm | 0.35 | 0.63 | 0.02 | 0.97 | sample of the invention |
| Sample 35 | S-1 | S-4 (3 mol %) | 651 nm | 0.54 | 0.35 | 0.86 | 0.21 | comparative sample |
| Sample 36 | S-2 | S-4 (3 mol %) | 635 nm | 0.76 | 0.05 | 0.77 | 0.25 | comparative sample |
| Sample 37 | S-3 | S-4 | 616 nm | 0.97 | 0.00 | 0.56 | 0.31 | comparative |

TABLE 1-continued

| Sample No. | Dye | Super-sensitizing Compound | Condition (1) Absorption Peak Wavelength | Condition (2) φr of Negative Image (dye only) | Δφr (negative image) | Condition (3) Intrinsic Desensitization of Reversal Image | Condition (4) φr of Reversal Image | |
|---|---|---|---|---|---|---|---|---|
| | | (3 mol %) | | | | | | sample |
| Sample 38 | S-4 | — | 661 nm | 1.00 | — | Not reversed | Not reversed | comparative sample |
| Sample 39 | S-5 | S-7 (5 mol %) | 553 nm | 0.99 | 0.00 | 0.38 | 0.57 | comparative sample |
| Sample 40 | S-6 | S-7 (5 mol %) | 555 nm | 0.95 | 0.03 | 0.30 | 0.69 | comparative sample |
| Sample 41 | S-7 | S-4 (3 mol %) | 592 nm | 0.98 | 0.00 | 0.48 | 0.28 | comparative sample |
| Sample 42 | S-8 | S-7 (5 mol %) | 570 nm | 0.99 | 0.00 | 0.45 | 0.38 | comparative sample |
| Sample 43 | S-9 | S-7 (5 mol %) | 554 nm | 0.95 | 0.01 | 0.37 | 0.35 | comparative sample |
| Sample 44 | S-10 | S-7 (5 mol %) | 584 nm | 0.97 | 0.00 | Not reversed | Not reversed | comparative sample |
| Sample 45 | S-11 | S-7 (5 mol %) | 571 nm | 0.95 | 0.00 | Not reversed | Not reversed | comparative sample |
| Sample 46 | S-12 | S-7 (5 mol %) | 570 nm | 0.93 | 0.02 | 1.34 | 0.22 | comparative sample |
| Sample 47 | S-13 | S-7 (5 mol %) | 581 nm | 1.00 | 0.00 | Not reversed | Not reversed | comparative sample |
| Sample 48 | S-14 | S-7 (5 mol %) | 540 nm | 0.34 | 0.65 | 0.02 | 0.96 | comparative sample |
| Sample 49 | S-15 | S-7 (5 mol %) | 528 nm | 0.86 | 0.13 | 0.01 | 0.98 | comparative sample |

EXAMPLE 2

Preparation of Emulsion 2A:

(i) 1000 ml of an aqueous solution containing 3 g of gelatin and 3.2 g of KBr were stirred at 60° C. (ii) An aqueous solution of silver nitrate (containing 8.2 g of $AgNO_3$) and an aqueous solution of a nitrate (containing 5.7 g of KBr) were added thereto by a double jet method over a period of one minute. (iii) 21.5 g of gelatin were added thereto, and the resulting mixture was heated at 75° C. (iv) After this, an aqueous solution of silver nitrate (containing 136.3 g of $AgNO_3$) and an aqueous solution of a halide (containing 2.0 mol % of KI relative to KBr) were added thereto by a double jet method over a period of 51 minutes, while the flow rates were accelerated. During this addition, the silver potential was kept at 0 mV relative to the saturated calomel electrode within the first 46 minutes. (v) This was cooled to 40° C., and an aqueous solution of silver nitrate (containing 3.2 g of $AgNO_3$) and an aqueous solution of KI (containing 3.2 g of KI) were added thereto over a period of 5 minutes. During this addition, the silver potential was kept at −50 mV relative to the saturated calomel electrode. (vi) After this, an aqueous solution of silver nitrate (containing 25.4 g of $AgNO_3$) and an aqueous solution of KBr were added thereto by a double jet method over a period of 5.35 minutes. During this addition, the silver potential was kept at −50 mV relative to the saturated calomel electrode. (vii) The thus-formed emulsion was de-salted by flocculation, gelatin was added thereto, and the emulsion was adjusted to have pH of 5.5 and pAg of 8.7 and then subjected to optimum chemical sensitization with sodium thiosulfate, potassium thiocyanate, chloroauric acid and dimethylselenourea. Emulsion 2A thus prepared contained tabular grains having a mean circle-corresponding diameter of 0.60 μm, a mean thickness of 0.15 μm, a mean aspect ratio of 5.2 and a mean silver iodide content of 3.5 mol %, in an amount of 80% of the total projected area of all the grains therein.

Preparation of Emulsion 2B:

Emulsion 2B was prepared by subjecting emulsion 2A to reduction sensitization in such a way that $1.4\times10^{-5}$ mol, per mol of silver, of thiourea dioxide was added before the start of the step (iv) and that $2\times10^{-4}$ mol, per mol of silver, of thiosulfonic acid was added after the step (iv).

Preparation of Samples 2-1-A,B to 2-24-A,B

The above-mentioned two emulsions were separately dissolved at 40° C., and the sensitizing dye shown in Table 2 below was added thereto in an amount of $8\times10^{-4}$ mol per mol of silver, while at the same time adding thereto the supersensitizing compound also shown in Table 2. These were separately coated on a support of TAC (triacetyl cellulose). Thus, coated samples were prepared. The amount of the supersensitizing compound added is shown in Table 2, in terms of the molar ratio relative to the total amount of all the sensitizing dyes added.

Conditions for coating emulsion on support:

| | |
|---|---|
| (1) Emulsion Layer: | |
| Emulsion (above-mentioned spectrally sensitized emulsion) | $2.1\times10^{-2}$ mol/m$^2$ as Ag |
| Coupler (ExC-8 mentioned hereinunder) | $1.5\times10^{-3}$ mol/m$^2$ |
| Tricresyl phosphate | 1.10 g/m$^2$ |
| Gelatin | 2.30 g/m$^2$ |
| (2) Protective Layer: | |
| 2,4-Dichloro-6-hydroxy-s-triazine sodium salt | 0.08 g/m$^2$ |
| Gelatin | 1.80 g/m$^2$ |

These samples were stored for 14 hours at 40° C. and at a relative humidity of 70%, and then exposed for 1/100 second through an interference filter at 391 nm (for exposure in the intrinsic range) and that in the vicinity of the absorption peak wavelength of the sensitizing dye added (for exposure in the spectrally sensitizing range) both via a continuous optical wedge. The thus-exposed samples were then processed according to the following process.

| Process for Color Development: | | |
|---|---|---|
| Step | Time | Temperature |
| Color Development | 2 min 00 sec | 40° C. |
| Bleach-fix | 3 min 00 sec | 40° C. |
| Washing (1) | 20 sec | 35° C. |
| Washing (2) | 20 sec | 35° C. |
| Stabilization | 20 sec | 35° C. |
| Drying | 50 sec | 65° C. |

The compositions of the processing solutions used above are mentioned below.

| Color Developer: | |
|---|---|
| Diethylenetriaminepentaacetic acid | 2.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 0.5 mg |
| Hydroxylamine sulfate | 2.4 g |
| 2-(N-ethyl-N-β-hydroxyethylamino)-2-methylaniline sulfate | 4.5 g |
| Water to make | 1 liter |
| pH | 10.05 |
| **Bleach-fix:** | |
| Ammonium ethylenediaminetetraacetato ferrate dihydrate | 90.0 g |
| Disodium ethylenediaminetetraacetate | 5.0 g |
| Sodium sulfite | 12.0 g |
| Aqueous solution of ammonium thiosulfate (70%) | 260.0 ml |
| Acetic acid (98%) | 5.0 ml |
| Bleaching accelerator, $[(CH_3)_2N—CH_2CH_2—S]_2.2HCl]$ | 0.01 mol |
| Water to make | 1.0 liter |
| pH | 6.0 |

Washing Water:

City water was passed through a mixed-bed-type column as filled with an H-type strong acidic cation-exchange resin (Amberlite IR-120B, produced by Rhom & Haas Co.) and an OH-type anion-exchange resin (Amberlite IR-400, produced by Rhom & Haas Co.) so that both the calcium ion concentration and the magnesium ion concentration in the water were reduced to 3 mg/liter, individually. Next, 20 mg/liter of sodium dichloroisocyanurate and 1.5 g/liter of sodium sulfate were added to the resulting water, which had pH of from 6.5 to 7.5. This was used as the washing water.

| Stabilizer: | |
|---|---|
| Formalin (37%) | 2.0 ml |
| Polyoxyethylene-p-monononylphenyl ether (mean polymerization degree 10) | 0.3 g |
| Disodium ethylenediaminetetraacetate | 0.05 g |
| Water to make | 1.0 liter |
| pH | 5.0 to 8.0 |

The density of each sample thus processed was measured through a green filter. From the data thus measured, the sensitivity and the fog value of each sample were obtained. The sensitivity is represented as a relative value of the reciprocal of the amount of exposure that gave a density of (fog+0.2). From the sensitivity of each sample, obtained were the relative sensitivity of each sample exposed in the intrinsic range, based on the sensitivity (100) of the control sample (2-1-A, containing no sensitizing dye) exposed in the intrinsic range; the ratio of the sensitivity of each sample containing emulsion 2B and exposed in the intrinsic range to that of the corresponding sample containing emulsion 2A and exposed in the intrinsic range (this means the increase in the sensitivity of each sample due to the reduction sensitization, when the sample was exposed in the intrinsic range); and the ratio of the sensitivity of each sample containing emulsion 2B and exposed in the spectrally sensitizing range to that of the corresponding sample containing emulsion 2A and exposed in the spectrally sensitizing range (this means the increase in the sensitivity of each sample due to the reduction sensitization, when the sample was exposed in the spectrally sensitizing range). The results are shown in Table 2 below.

TABLE 2

| | | | Exposure in Intrinsic Range | | Exposure in Spectrally Sensitizing Range | |
|---|---|---|---|---|---|---|
| | Sensitizing Dye | Super-sensitizing Compound | Sensitivity of Sample Containing Emulsion 2A (not reduced) | Increase in Sensitivity of Sample due to Reduction Sensitization (%) | Increase in Sensitivity of Sample due to Reduction Sensitization (%) | |
| Sample 2-1-A, B | None | None | 100 | 98 | — | comparative sample |
| Sample 2-2-A, B | S-1 | S-4 (3 mol %) | 76 | 1 | 100 | comparative sample |
| Sample 2-3-A, B | S-3 | S-4 (3 mol %) | 84 | 2 | 0 | comparative sample |
| Sample 2-4-A, B | S-4 | — | 51 | 0 | 0 | comparative sample |
| Sample 2-5-A, B | S-5 | S-7 (5 mol %) | 92 | 30 | 5 | comparative sample |
| Sample 2-6-A, B | S-6 | S-7 (5 mol %) | 97 | 39 | 8 | comparative sample |
| Sample 2-7-A, B | S-7 | S-4 (3 mol %) | 89 | 1 | 0 | comparative sample |
| Sample 2-8-A, B | S-8 | S-7 (5 mol %) | 93 | 2 | 0 | comparative sample |
| Sample 2-9-A, B | S-10 | S-7 (5 mol %) | 87 | 0 | 0 | comparative sample |

TABLE 2-continued

| | Sensitizing Dye | Super-sensitizing Compound | Exposure in Intrinsic Range: Sensitivity of Sample Containing Emulsion 2A (not reduced) | Exposure in Intrinsic Range: Increase in Sensitivity of Sample due to Reduction Sensitization (%) | Exposure in Spectrally Sensitizing Range: Increase in Sensitivity of Sample due to Reduction Sensitization (%) | |
|---|---|---|---|---|---|---|
| Sample 2-10-A, B | S-11 | S-7 (5 mol %) | 92 | 1 | 0 | comparative sample |
| Sample 2-11-A, B | S-14 | S-7 (5 mol %) | 90 | 1 | 0 | comparative sample |
| Sample 2-12-A, B | I-1 | S-7 (5 mol %) | 100 | 87 | 85 | sample of the invention |
| Sample 2-13-A, B | I-2 | S-7 (5 mol %) | 98 | 91 | 86 | sample of the invention |
| Sample 2-14-A, B | I-3 | S-7 (5 mol %) | 99 | 99 | 99 | sample of the invention |
| Sample 2-15-A, B | I-8 | S-7 (5 mol %) | 98 | 97 | 95 | sample of the invention |
| Sample 2-16-A, B | I-15 | S-7 (5 mol %) | 96 | 88 | 81 | sample of the invention |
| Sample 2-17-A, B | I-17 | S-4 (3 mol %) | 95 | 87 | 80 | sample of the invention |
| Sample 2-18-A, B | I-19 | S-4 (3 mol %) | 97 | 89 | 86 | sample of the invention |
| Sample 2-19-A, B | I-24 | S-4 (3 mol %) | 98 | 91 | 86 | sample of the invention |
| Sample 2-20-A, B | I-25 | S-7 (5 mol %) | 101 | 100 | 100 | sample of the invention |
| Sample 2-21-A, B | I-28 | S-7 (5 mol %) | 99 | 102 | 101 | sample of the invention |
| Sample 2-22-A, B | I-30 | S-7 (5 mol %) | 96 | 97 | 94 | sample of the invention |
| Sample 2-23-A, B | I-31 | S-4 (3 mol %) | 86 | 85 | 79 | sample of the invention |
| Sample 2-24-A, B | I-33 | S-7 (5 mol %) | 98 | 94 | 92 | sample of the invention |

From Table 2 above, it is known that the sensitivity of the samples of the present invention each containing the hole-injection-type sensitizing dye and the supersensitizing compound and having been subjected to reduction sensitization was significantly increased even when the samples were exposed in the wavelength range longer than 545 nm.

EXAMPLE 3

Emulsion 2A and emulsion 2B prepared in Example 2 were separately dissolved at 40° C., and sensitizing dye S-1 or I-3 was added thereto in an amount shown in Table 3 below while adding thereto supersensitizing compound S-4 in an amount shown in Table 3. Using these, coated samples 3-1-A,B to 3-13-A,B were formed in the same manner as in Example 2.

These samples were stored for 14 hours at 40° C. and at a relative humidity of 70%, and then exposed for 1/100 second through an interference filter at 391 nm (for exposure in the intrinsic range) and an yellow filter (for exposure in the spectrally sensitizing range) both via a continuous optical wedge. The thus-exposed samples were then processed in the same manner as in Example 2.

The density of each sample thus processed was measured through a green filter. From the data thus measured, the sensitivity and the fog value of each sample were obtained. The sensitivity is represented as a relative value of the reciprocal of the amount of exposure that gave a density of (fog+0.2). From the sensitivity of each sample, obtained were the relative sensitivity of each sample exposed in the intrinsic range, based on the sensitivity (100) of the control sample (3-1-A, containing no sensitizing dye) exposed in the intrinsic range; the ratio of the sensitivity of each sample containing emulsion 2B and exposed in the intrinsic range to that of the corresponding sample containing emulsion 2A and exposed in the intrinsic range (this means the increase in the sensitivity of each sample due to the reduction sensitization, when the sample was exposed in the intrinsic range); the ratio of the sensitivity of each sample containing emulsion 2B and exposed in the spectrally sensitizing range to that of the corresponding sample containing emulsion 2A and exposed in the spectrally sensitizing range (this means the increase in the sensitivity of each sample due to the reduction sensitization, when the sample was exposed in the spectrally sensitizing range); and the sensitivity of each sample subjected to reduction sensitization and exposed in the spectrally sensitizing range (this means the final sensitivity of each sample exposed through yellow filter).

In addition, in order to evaluate the storage stability of the samples, the samples were stored at 30° C. and at a relative humidity of 60% for 2 months and thereafter processed in the same manner as above. The fog of each of the thus-processed samples was measured.

The results obtained are shown in Table 3 below.

TABLE 3

| | | | Exposure in Intrinsic Range | | Exposure of Spectrally Sensitizing Range | | Fog of Reduction-sensitized Emulsion | | |
|---|---|---|---|---|---|---|---|---|---|
| | Sensitizing Dye | Super-sensitizing Compound | Sensitivity of Sample Containing Emulsion 2A (not reduced) | Increase in Sensitivity of Sample due to Reduction Sensitization (%) | Increase in Sensitivity of Sample due to Reduction Sensitization (%) | Final Sensitivity of Sample (exposed through yellow filter) | Fresh Sample | Stored for 2 months at 30° C. | |
| Sample 3-1-A, B | None | None | 100 | 98 | — | — | 0.2 | 0.23 | comparative sample |
| Sample 3-2-A, B | S-1 ($1 \times 10^{-4}$ mol) | S-4 (3 mol %) | 97 | 96 | 95 | 100 | 0.25 | 0.35 | comparative sample |
| Sample 3-3-A, B | S-1 ($2 \times 10^{-4}$ mol) | S-4 (3 mol %) | 95 | 94 | 82 | 171 | 0.29 | 0.38 | comparative sample |
| Sample 3-4-A, B | S-1 ($3 \times 10^{-4}$ mol) | S-4 (3 mol %) | 85 | 82 | 68 | 192 | 0.31 | 0.41 | comparative sample |
| Sample 3-5-A, B | S-1 ($4 \times 10^{-4}$ mol) | S-4 (3 mol %) | 81 | 32 | 18 | 192 | 0.42 | 0.69 | comparative sample |
| Sample 3-6-A, B | S-1 ($6 \times 10^{-4}$ mol) | S-4 (3 mol %) | 76 | 21 | 6 | 184 | 0.51 | 0.85 | comparative sample |
| Sample 3-7-A, B | S-1 ($8 \times 10^{-4}$ mol) | S-4 (3 mol %) | 68 | 11 | 1 | 175 | 0.64 | 0.91 | comparative sample |
| Sample 3-8-A, B | I-3 ($1 \times 10^{-4}$ mol) | S-4 (3 mol %) | 98 | 98 | 97 | 104 | 0.21 | 0.23 | comparative sample |
| Sample 3-9-A, B | I-3 ($2 \times 10^{-4}$ mol) | S-4 (3 mol %) | 97 | 97 | 95 | 187 | 0.23 | 0.25 | comparative sample |
| Sample 3-10-A, B | I-3 ($3 \times 10^{-4}$ mol) | S-4 (3 mol %) | 97 | 97 | 96 | 241 | 0.22 | 0.25 | comparative sample |
| Sample 3-11-A, B | I-3 ($4 \times 10^{-4}$ mol) | S-4 (3 mol %) | 95 | 97 | 97 | 321 | 0.22 | 0.25 | sample of the invention |
| Sample 3-12-A, B | I-3 ($6 \times 10^{-4}$ mol) | S-4 (3 mol %) | 94 | 97 | 96 | 387 | 0.23 | 0.26 | sample of the invention |
| Sample 3-13-A, B | I-3 ($8 \times 10^{-4}$ mol) | S-4 (3 mol %) | 94 | 98 | 97 | 431 | 0.25 | 0.31 | sample of the invention |

As is known from Table 3 above, when the amount of the sensitizing dye added to the emulsion was less than $4\times10^{-4}$ mols, per mol of Ag, the sensitivity of the photographic material samples comprising the emulsion was increased in some degree by reduction sensitization even though the sensitizing dye was not the hole-injection-type sensitizing dye specifically defined according to the present invention and the supersensitizing compound was not added to the emulsion. However, when a large amount of the conventional sensitizing dye was added to the emulsion in order to increase the spectrally sensitizing effect of the dye added, the reduction sensitization applied to the samples was almost ineffective. Contrary to these results of the comparative samples, the samples of the present invention containing the hole-injection-type sensitizing dye and the supersensitizing compound still exhibited the high effect of spectral sensitization while they were highly sensitized by the reduction sensitization, even though the amount of the sensitizing dye added to the samples was large. As a result, the samples of the present invention had a significantly increased final sensitivity, as shown in Table 3 above.

It is also known from Table 3 that the fog of the fresh samples of the present invention each containing the hole-injection-type sensitizing dye was low and that the increase in the fog of the stored samples of the present invention was small, as compared with the comparative samples each containing the conventional sensitizing dye.

EXAMPLE 4

Emulsion 2A and emulsion 2B prepared in Example 2 were separately dissolved at 40° C., and sensitizing dyes S-1, I-3 and S-7 were added thereto in an amount of $8\times10^{-4}$ mol, per mol of silver, as a whole but the amount of S-7 added was fixed at $4\times10^{-5}$ mols while varying only the proportion of I-3 added to that shown in Table 4 below. Using these, coated samples 4-1-A,B to 4-6-A,B were formed in the same manner as in Example 2.

These samples were stored for 14 hours at 40° C. and at a relative humidity of 70%, and then exposed for 1/100 second through an yellow filter (for exposure in the spectrally sensitizing range) via a continuous optical wedge. The thus-exposed samples were then processed in the same manner as in Example 2.

The density of each sample thus processed was measured through a green filter. From the data thus measured, the sensitivity and the fog value of each sample were obtained. The sensitivity is represented as a relative value of the reciprocal of the amount of exposure that gave a density of (fog+0.2). From the sensitivity of each sample, obtained was the relative sensitivity of each sample, based on the sensitivity (100) of the control sample (4-1-A, not containing sensitizing dye I-3), and shown in Table 4 below.

TABLE 4

| | Proportion of the Amount of I-3 to the Total Amount of All Sensitizing Dyes Added | Sensitivity of Sample Containing Emulsion 2A (not reduced) | Sensitivity of Sample Containing Emulsion 2B (reduced) | |
|---|---|---|---|---|
| Sample 4-1-A, B | 0% | 100 | 103 | comparative sample |
| Sample 4-2-A, B | 50% | 100 | 108 | sample of the invention |
| Sample 4-3-A, B | 60% | 101 | 120 | sample of the invention |
| Sample 4-4-A, B | 70% | 101 | 164 | sample of the invention |
| Sample 4-5-A, B | 80% | 100 | 185 | sample of the invention |
| Sample 4-6-A, B | 100% | 102 | 197 | sample of the invention |

From Table 4 above, it is known that, among the samples containing the hole-injection-type sensitizing dye of the present invention along with the conventional sensitizing dyes, the sample containing a larger amount of the hole-injection-type sensitizing dye was sensitized more and therefore had a higher final sensitivity. In addition, it is also known that the proportion of the hole-injection-type sensitizing dye of the present invention to the total content of all the sensitizing dyes added is preferably 70% or more.

EXAMPLE 5

Preparation of Emulsions 5-1-A,B to 5-5-A,B:

Emulsions 5-1-A to 5-5-A having different mean grain sizes were prepared in the same manner as in the preparation of emulsion 2A in Example 2, except that these were not subjected to chemical sensitization. Emulsion 5-1-A had a mean grain size of 0.35 μm; emulsion 5-2-A had a mean grain size of 0.45 μm; emulsion 5-3-A had a mean grain size of 0.55 μm; emulsion 5-4-A had a mean grain size of 0.80 μm; and emulsion 5-5-A had a mean grain size of 1.20 μm. These all had a mean grain thickness of 0.25 μm.

Emulsions 5-1-B to 5-5-B were prepared in the same manner as in the preparation of emulsions 5-1-A to 5-5-A, respectively, except that these were subjected to optimum reduction sensitization. The optimum reduction sensitization was conducted in the same manner as in emulsion 2B in Example 2.

Preparation of Samples 5-1-A,B-A to 5-5-A,B-D

Various sensitizing dyes mentioned below were added to these ten emulsions, which were then subjected to optimum chemical sensitization with sodium thiosulfate, potassium thiocyanate, chloroauric acid and dimethylselenourea. The sensitizing dyes added are as follows:

A: only S-6

B: only S-7

C: I-3 and S-4 of 5 mol % of I-3

D: I-15 and S-7 of 3 mol % of I-15

The optimum amounts of these dyes were added to the emulsions and the emulsions were subjected to optimum chemical sensitization. The amount of the sensitizing dye(s) added to the emulsions was $4\times10^{-4}$ mol, per mol of silver, or more.

Using these emulsions, coated photographic material samples were prepared in the same manner as in Example 2. The sensitivity of these samples (with or without reduction sensitization) was obtained according to the same process as in Example 4. The relative sensitivity of these samples, each based on the sensitivity (100) of the control sample (containing sensitizing dye S-6 and not subjected to reduction sensitization), is shown in Table 5 below.

TABLE 5

| | Sensitizing Dye | Grain Size (as the diameter of the corresponding sphere) | Sensitivity of Sample Containing Non-reduced Emulsion | Sensitivity of Sample Containing Reduced Emulsion | |
|---|---|---|---|---|---|
| Sample 5-1-A, B-A | S-6 | 0.35 μm | 100 | 168 | comparative sample |
| Sample 5-1-A, B-B | S-7 | 0.35 μm | 98 | 97 | comparative sample |
| Sample 5-1-A, B-C | I-3, S-4 | 0.35 μm | 102 | 198 | sample of the invention |
| Sample 5-1-A, B-D | I-15, S-7 | 0.35 μm | 101 | 186 | sample of the invention |
| Sample 5-2-A, B-A | S-6 | 0.45 μm | 100 | 136 | comparative sample |
| Sample 5-2-A, B-B | S-7 | 0.45 μm | 99 | 101 | comparative sample |
| Sample 5-2-A, B-C | I-3, S-4 | 0.45 μm | 105 | 199 | sample of the invention |
| Sample 5-2-A, B-D | I-15, S-7 | 0.45 μm | 103 | 187 | sample of the invention |
| Sample | S-6 | 0.55 μm | 100 | 112 | comparative |

TABLE 5-continued

| | Sensitizing Dye | Grain Size (as the diameter of the corresponding sphere) | Sensitivity of Sample Containing Non-reduced Emulsion | Sensitivity of Sample Containing Reduced Emulsion | |
|---|---|---|---|---|---|
| 5-3-A, B-A Sample | S-7 | 0.55 μm | 96 | 95 | sample comparative sample |
| 5-3-A, B-B Sample | I-3, S-4 | 0.55 μm | 102 | 197 | sample of the invention |
| 5-3-A, B-C Sample | I-15, S-7 | 0.55 μm | 100 | 181 | sample of the invention |
| 5-3-A, B-D Sample | S-6 | 0.80 μm | 100 | 103 | comparative sample |
| 5-4-A, B-A Sample | S-7 | 0.80 μm | 98 | 95 | comparative sample |
| 5-4-A, B-B Sample | I-3, S-4 | 0.80 μm | 102 | 194 | sample of the invention |
| 5-4-A, B-C Sample | I-15, S-7 | 0.80 μm | 98 | 183 | sample of the invention |
| 5-4-A, B-D Sample | S-6 | 1.20 μm | 100 | 98 | comparative sample |
| 5-5-A, B-A Sample | S-7 | 1.20 μm | 95 | 95 | comparative sample |
| 5-5-A, B-B Sample | I-3, S-4 | 1.20 μm | 101 | 191 | sample of the invention |
| 5-5-A, B-C Sample | I-15, S-7 | 1.20 μm | 100 | 181 | sample of the invention |
| 5-5-A, B-D | | | | | |

From Table 5 above, it is known that the sensitivity of some comparative samples having the emulsion comprising small grains and containing the conventional sensitizing dye was increased in some degree by reduction sensitization. However, the increase in the sensitivity of the samples of the present invention having the emulsion comprising small grains and containing both the hole-injection-type sensitizing dye and the supersensitizing compound was greater than that in the sensitivity of such comparative samples. The reduction sensitization of the comparative samples having the emulsion comprising grains with a mean grain size larger than 0.45 μm and containing the conventional sensitizing dye was almost ineffective. However, the samples of the present invention having the emulsion comprising such large grains with a mean grain size larger than 0.45 μm and containing both the hole-injection-type sensitizing dye and the supersensitizing compound were all satisfactorily sensitized to have a high final sensitivity.

EXAMPLE 6

Preparation of Emulsions 6-1-A,B to 6-5-A,B:

Emulsions 6-1-A to 6-5-A having the same mean grain size but having different mean grain thicknesses were prepared in the same manner as in the preparation of emulsion 2A in Example 2, except that these were not subjected to chemical sensitization. All the emulsions had the same mean grain size of 0.80 μm, while emulsion 6-1-A had a mean thickness of 0.40 μm; emulsion 6-2-A had a mean grain thickness of 0.35 μm; emulsion 6-3-A had a mean grain thickness of 0.30 μm; emulsion 6-4-A had a mean grain thickness of 0.27 μm; and emulsion 6-5-A had a mean grain thickness of 0.20 μm.

Emulsions 6-1-B to 6-5-B were prepared in the same manner as in the preparation of emulsions 6-1-A to 6-5-A, respectively, except that these were subjected to optimum reduction sensitization. The optimum reduction sensitization was conducted in the same manner as in emulsion 2B in Example 2.

Preparation of Samples 6-1-A,B-A to 6-5-A,B-D

Various sensitizing dyes mentioned below were added to these ten emulsions, which were then subjected to optimum chemical sensitization with sodium thiosulfate, potassium thiocyanate, chloroauric acid and dimethylselenourea. The sensitizing dyes added are as follows:

A: only S-6

B: only S-7

C: I-3 and S-4 of 5 mol % of I-3

D: I-15 and S-7 of 3 mol % of I-15

The optimum amounts of these dyes were added to the emulsions and the emulsions were subjected to optimum chemical sensitization. The amount of the sensitizing dye(s) added to the emulsions was $4\times10^{-4}$ mol, per mol of silver, or more.

Using these emulsions, coated photographic material samples were prepared in the same manner as in Example 2. The sensitivity of these samples (with or without reduction sensitization) was obtained according to the same process as in Example 4. The relative sensitivity of these samples, each based on the sensitivity (100) of the control sample (having the emulsion comprising grains with a mean grain thickness of 0.4 μm and containing sensitizing dye S-6 and not subjected to reduction sensitization), is shown in Table 6 below.

TABLE 6

| | Sensitizing Dye | Mean Grain Thickness | Sensitivity of Sample Containing Non-reduced Emulsion | Sensitivity of Sample Containing Reduced Emulsion | |
|---|---|---|---|---|---|
| Sample 6-1-A, B-A | S-6 | 0.4 μm | 100 | 175 | comparative sample |
| Sample 6-1-A, B-B | S-7 | 0.4 μm | 98 | 101 | comparative sample |
| Sample 6-1-A, B-C | I-3, S-4 | 0.4 μm | 102 | 197 | sample of the invention |
| Sample 6-1-A, B-D | I-15, S-7 | 0.4 μm | 101 | 187 | sample of the invention |
| Sample 6-2-A, B-A | S-6 | 0.35 μm | 134 | 181 | comparative sample |
| Sample 6-2-A, B-B | S-7 | 0.35 μm | 131 | 133 | comparative sample |
| Sample 6-2-A, B-C | I-3, S-4 | 0.35 μm | 138 | 272 | sample of the invention |
| Sample 6-2-A, B-D | I-15, S-7 | 0.35 μm | 131 | 187 | sample of the invention |
| Sample 6-3-A, B-A | S-6 | 0.30 μm | 164 | 183 | comparative sample |
| Sample 6-3-A, B-B | S-7 | 0.30 μm | 158 | 159 | comparative sample |
| Sample 6-3-A, B-C | I-3, S-4 | 0.30 μm | 168 | 331 | sample of the invention |
| Sample 6-3-A, B-D | I-15, S-7 | 0.30 μm | 164 | 321 | sample of the invention |
| Sample 6-4-A, B-A | S-6 | 0.27 μm | 194 | 196 | comparative sample |
| Sample 6-4-A, B-B | S-7 | 0.27 μm | 182 | 181 | comparative sample |
| Sample 6-4-A, B-C | I-3, S-4 | 0.27 μm | 201 | 397 | sample of the invention |
| Sample 6-4-A, B-D | I-15, S-7 | 0.27 μm | 198 | 381 | sample of the invention |
| Sample 6-5-A, B-A | S-6 | 0.20 μm | 208 | 209 | comparative sample |
| Sample 6-5-A, B-B | S-7 | 0.20 μm | 198 | 199 | comparative sample |
| Sample 6-5-A, B-C | I-3, S-4 | 0.20 μm | 231 | 458 | sample of the invention |
| Sample 6-5-A, B-D | I-15, S-7 | 0.20 μm | 221 | 428 | sample of the invention |

From Table 6 above, it is known that the sensitivity of the comparative samples having the emulsion comprising thick grains and containing the conventional sensitizing dye was increased by reduction sensitization and that the difference in the sensitivity between the comparative samples and the samples of the present invention containing the hole-injection-type sensitizing dye and the supersensitizing compound is small. It became possible to add a larger amount of the sensitizing dye to the emulsion having a smaller mean grain thickness, by which the spectral sensitivity of the emulsion thus containing a larger amount of the sensitizing dye was increased. However, it was impossible to further increase the sensitivity of the comparative samples containing the conventional sensitizing dye by reduction sensitization. Contrary to these results, it was possible to further increase the sensitivity of the samples of the present invention containing both the hole-injection-type sensitizing dye and the supersensitizing compound by reduction sensitization, even though the emulsions in the samples comprised thick grains and contained a large amount of the hole-injection-type sensitizing dye. As a result, the samples of the present invention all had an extremely high final sensitivity.

EXAMPLE 7

1) Support:

The support used in this example was produced according to the method mentioned below.

100 parts by weight of a commercial polymer, polyethylene-2,6-naphthalate and 2 parts by weight of a commercial ultraviolet absorbent, Tinuvin P-326 (produced by Geigy Co.) were dried in an ordinary manner, then melted at 300° C., extruded through a T-die, stretched by 3.0 times at 140° C. in the machine direction, then stretched by 3.0 times at 130° C. in the transverse direction and thereafter thermally fixed at 250° C. for 6 seconds to obtain a PEN film having a thickness of 90 μm.

A part of this film was wound around a stainless steel core having a diameter of 20 cm, and thermal hysteresis was imparted thereto at 110° C. for 48 hours.

2) Coating of Subbing Layer on Support:

The both surfaces of the support prepared in the above were treated by corona-discharging treatment, UV-discharging treatment, glow-discharging treatment and flame treatment. One surface of the support that had heated higher during the stretching was coated with a coating solution having the composition mentioned below to form thereon a subbing layer. The corona-discharging treatment was conducted by treating the support having a width of 30 cm with a solid state corona-treating machine 6 KVA Model (produced by Pillar Co.) at a speed of 20 m/min. From the values of the current and the voltage designated by the machine, the support was treated by 0.375 KV·A·min/$m^2$. The discharged frequency during the treatment was 9.6 KHz, and the gap clearance between the electrode and the dielectric roll was 1.6 mm. The UV-discharging treatment was conducted under heat at 75° C. The glow-discharging treatment was conducted by using a column electrode of 3000 W, and the irradiation time was 30 seconds.

| Composition of Coating Solution for Subbing Layer: | |
|---|---|
| Gelatin | 3 g |
| Distilled water | 25 ml |
| Sodium α-sulfo-di-2-ethylhexylsuccinate | 0.05 g |
| Formaldehyde | 0.03 g |
| Salicylic acid | 0.1 g |
| Diacetyl cellulose | 0.5 g |
| p-Chlorophenol | 0.5 g |
| Resorcinol | 0.5 g |
| Cresol | 0.5 g |
| $(CH_2{=}CHSO_2CH_2CH_2NHCO)_2CH_2$ | 0.2 g |
| Trimethylolpropanetriazine | 0.2 g |
| Trimethylolpropanetristoluene diisocyanate | 0.2 g |
| Methanol | 15 ml |
| Acetone | 85 ml |
| Acetic acid | 0.01 g |
| Concentrated hydrochloric acid | 0.01 g |

3) Coating of Backing Layers on Support:

On the other surface of the support opposite to the surface coated with the subbing layer, were coated an antistatic layer, a magnetic recording layer and a lubricant layer each having the composition mentioned below, as backing layers.

3-1) Coating of Antistatic Layer on Support:

3-1-1) Preparation of dispersion of fine electroconductive grains (dispersion of tin oxide-antimony oxide composite grains):

230 parts by weight of stannic chloride dihydrate and 23 parts by weight of antimony trichloride were dissolved in 3,000 parts by weight of ethanol to form a uniform solution. To this was dropwise added an aqueous solution of 1-N sodium hydroxide, until the pH of the resulting solution became 3. Hence, a colloidal coprecipitate of stannic oxide and antimony oxide was obtained. This was kept at 50° C. for 24 hours, and a colloidal reddish-brown precipitate was formed.

This colloidal reddish-brown precipitate was separated by centrifugation. In order to remove the excess ions, water was added to the precipitate and the precipitate was washed with water by centrifugation. This operation was performed three times, and the excess ions were removed.

200 parts by weight of the colloidal precipitate from which the excess ions had been removed were again dispersed in 1,500 parts by weight of water, and the resulting dispersion was sprayed into a burning furnace heated at 650° C. to obtain a powder of bluish fine grains of tin oxide-antimony oxide composite having a mean grain size of 0.005 μm. This powder had a specific resistivity of 5 Ω·cm.

A mixture comprising 40 parts by weight of the powder and 60 parts by weight of water was adjusted to have pH of 7.0, roughly dispersed in a stirrer and then again dispersed in a horizontal sand mill (Dino-mill; trade name, produced by Willya Bachofen AG), until a residence time became 30 minutes. The secondary agglomerate thus formed had a mean grain size of about 0.04 μm.

3-1-2) Coating of electroconductive layer on support:

A coating composition comprising the components mentioned below was coated on the support at a dry thickness of 0.2 μm and dried at 115° C. for 60 seconds.

| Coating Composition: | |
|---|---|
| Dispersion of fine electroconductive grains prepared in 3-1-1) | 20 wt. pts. |
| Gelatin | 2 wt. pts. |
| Water | 27 wt. pts. |
| Methanol | 60 wt. pts. |
| p-Chlorophenol | 0.5 wt. pt. |
| Resorcinol | 2 wt. pts. |
| Polyoxyethylene-nonylphenyl ether | 0.01 wt. pt. |

The resistance of the thus-formed electroconductive film was 108.0 Ω (at 100 V), and the film had a good antistatic capacity.

3-2) Coating of Electromagnetic Layer on Support:

1,100 g of a magnetic substance, Co-coated γ-$Fe_2O_3$ (needle-like grains having a major axis of 0.14 μm and a minor axis of 0.03 μm, and having a specific surface area of 41 $m^2/g$, a saturation magnetization of 89 emu/g, a coercive force of 930 Oe and a ratio of $Fe^{2+}/Fe^{3+}$=6/94; their surfaces were treated with 2% by weight, relative to $Fe_2O_3$, of aluminium oxide and 2% by weight, relative to $Fe_2O_3$, of silicon oxide) were well kneaded with 220 g of water and 150 g of a silane coupling agent, polyoxyethylenepropyltrimethoxysilane having a degree of polymerization of 16, in an open kneader for 3 hours. The viscous liquid thus dispersed roughly was dried for one full day at 70° C. to remove water, and then heated at 110° C. for 1 hour. Hence, surface-treated magnetic grains were obtained.

The magnetic grains were kneaded along with the following components in an open kneader.

| | |
|---|---|
| Surface-treated magnetic grains mentioned above | 1000 g |
| Diacetyl cellulose | 17 g |
| Methyl ethyl ketone | 100 g |
| Cyclohexanone | 100 g |

The thus-kneaded mixture was finely dispersed along with the following components in a sand mill (¼ G) at 200 rpm for 4 hours.

| | |
|---|---|
| Kneaded mixture prepared in the above | 100 g |
| Diacetyl cellulose | 60 g |
| Methyl ethyl ketone | 300 g |
| Cyclohexanone | 300 g |

In addition, diacetyl cellulose and a hardening agent, $C_2H_5C(CH_2OCONH{-}C_6H_3(CH_3)NCO)_3$ were added to the resulting dispersion each in an amount of 20% by weight relative to the binder. The liquid thus obtained was diluted with a mixture of methyl ethyl ketone and cyclohexanone (1/1 by volume), by which the diluted liquid had a viscosity of about 80 cps. This was coated on the above-mentioned electroconductive layer with a bar coater to form thereon a magnetic layer having a thickness of 1.2 μm. The amount of the magnetic substance coated was 0.6 $g/m^2$. To the coating composition added were a mat agent of silica grains (0.3 μm) and an abrasive of aluminium oxide (0.5 μm) each in an amount of 10 $mg/m^2$. The thus-coated layer was dried at 115° C. for 6 minutes in a drier where the rollers and the conveying means in the drying zone were all kept at 115° C.

The increase in the DB color density of the magnetic recording layer was about 0.1, when measured with an X-light at a status M through a blue filter. The magnetic recording layer had a saturation magnetization moment of 4.2 $emu/m^2$, a coercive force of 923 Oe and a squareness ratio of 65%.

3-3) Coating of Lubricant Layer on Support:

A coating composition comprising the components mentioned below was coated on the magnetic layer of the support and dried at 110° C. for 5 minutes to form a lubricant layer thereon. The amounts mentioned below are in terms of the solid contents coated.

| | |
|---|---|
| Diacetyl cellulose | 25 mg/m$^2$ |
| $C_6H_{13}CH(OH)C_{10}H_{20}COOC_{40}H_{81}$ (compound-a) | 6 mg/m$^2$ |
| $C_{50}H_{101}O(CH_2CH_2O)_{16}H$ (compound-b) | 9 mg/m$^2$ |

Compound-a/compound-b (6/9) were dissolved in the same amount of xylene/propyleneglycol-monomethyl ether (1/1, by volume) under heat at 105° C., and the resulting solution was added to propyleneglycol-monomethyl ether (25° C.) of 10 times the solution to obtain a fine dispersion. This was diluted with acetone of 5 times the dispersion, and this was again dispersed in a high-pressure homogenizer (200 atmospheric pressures) to obtain a dispersion (having a mean grain size of 0.01 $\mu$m). This dispersion was added to the above-mentioned coating composition. The lubricant layer thus formed had excellent characteristics, concretely having a coefficient of kinetic friction of 0.06 (to hard stainless steel balls with 5 mmϕ under a load of 100 g at a speed of 6 cm/min) and a coefficient of static friction of 0.07 (measured by a clipping method). Regarding the lubricative characteristic of the lubricant layer sliding on the surface of the emulsion layer coated on the support (the emulsion layer is described hereinunder), the lubricant layer had a coefficient of kinetic friction of 0.12.

4) Coating of Photographic Layers on Support:

Next, on the surface of the support opposite to the surface coated with the above-mentioned backing layers, coated were plural layers each having the composition mentioned below. Thus, a color negative film, sample 7-1 was produced.

Compositions of Photographic Layers:

Essential components of constituting the photographic layers are grouped as follows:

ExC: Cyan Coupler

ExM: Magenta Coupler

ExY Yellow Coupler

ExS: Sensitizing Dye

UV: Ultraviolet Absorbent

HBS: High Boiling Point Organic Solvent

H: Gelatin Hardening Agent

The number for each component indicates the amount coated by way of a unit of g/m$^2$. The amount of the silver halide coated is represented as the amount of silver therein coated. The amount of the sensitizing dye coated is represented by way of a molar unit relative to mol of the silver halide in the same layer.

Formation of Sample 7-1:

First Layer Anti-halation Layer:

| | |
|---|---|
| Black Colloidal Silver | 0.09 as Ag |
| Gelatin | 1.60 |
| ExM-1 | 0.12 |
| ExF-1 | $2.0 \times 10^{-3}$ |
| Solid Disperse Dye, ExF-2 | 0.030 |
| Solid Disperse Dye, ExF-3 | 0.040 |
| HBS-1 | 0.15 |
| HBS-2 | 0.02 |

-continued

Formation of Sample 7-1:

Second Layer (Interlayer):

| | |
|---|---|
| Silver Iodobromide Emulsion M | 0.065 as Ag |
| ExC-2 | 0.04 |
| Polyethyl Acrylate Latex | 0.20 |
| Gelatin | 1.04 |

Third Layer (Low-sensitivity Red-sensitive Emulsion Layer):

| | |
|---|---|
| Silver Iodobromide Emulsion A | 0.25 as Ag |
| Silver Iodobromide Emulsion B | 0.25 as Ag |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| HBS-1 | 0.10 |
| Gelatin | 0.87 |

Fourth Layer (Middle-sensitivity Red-sensitive Emulsion Layer):

| | |
|---|---|
| Silver Iodobromide Emulsion C | 0.70 as Ag |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |

Fifth Layer (High-sensitivity Red-sensitive Emulsion Layer):

| | |
|---|---|
| Silver Iodobromide Emulsion D | 1.40 as Ag |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| HBS-1 | 0.22 |
| HBS-2 | 0.050 |
| Gelatin | 1.10 |

Sixth Layer (Interlayer):

| | |
|---|---|
| Cpd-1 | 0.090 |
| Solid Disperse Dye, ExF-4 | 0.030 |
| HBS-1 | 0.050 |
| ExF-2 | 0.040 |
| Polyethyl Acrylate Latex | 0.15 |
| Gelatin | 1.10 |

Seventh Layer (Low-sensitivity Green-sensitive Emulsion Layer):

| | |
|---|---|
| Silver Iodobromide Emulsion E | 0.15 as Ag |
| Silver Iodobromide Emulsion F | 0.10 as Ag |
| Silver Iodobromide Emulsion G | 0.10 as Ag |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |

-continued

Formation of Sample 7-1:

Eighth Layer (Middle-sensitivity Green-sensitive Emulsion Layer):

| | |
|---|---|
| Silver Iodobromide Emulsion H | 0.80 as Ag |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |

Ninth Layer (High-sensitivity Green-sensitive Emulsion Layer):

| | |
|---|---|
| Silver Iodobromide Emulsion I | 1.25 as Ag |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-2 | 0.040 |
| HBS-1 | 0.25 |
| Polyethyl Acrylate Latex | 0.15 |
| Gelatin | 1.33 |

Tenth Layer (Yellow Filter Layer):

| | |
|---|---|
| Yellow Colloidal Silver | 0.015 as Ag |
| Cpd-1 | 0.16 |
| Solid Disperse Dye, ExF-5 | 0.060 |
| Solid Disperse Dye, ExF-6 | 0.060 |
| Oil-soluble Dye, ExF-7 | 0.010 |
| HBS-1 | 0.60 |
| Gelatin | 0.60 |

Eleventh Layer (Low-sensitivity Blue-sensitive Emulsion Layer):

| | |
|---|---|
| Silver Iodobromide Emulsion J | 0.09 as Ag |
| Silver Iodobromide Emulsion K | 0.09 as Ag |
| ExS-7 | $8.6 \times 10^{-4}$ |

-continued

Formation of Sample 7-1:

| | |
|---|---|
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | $4.0 \times 10^{-3}$ |
| HBS-1 | 0.28 |
| Gelatin | 1.20 |

Twelfth Layer (High-sensitivity Blue-sensitive Emulsion Layer):

| | |
|---|---|
| Silver Iodobromide Emulsion L | 1.00 as Ag |
| ExS-7 | $4.0 \times 10^{-4}$ |
| ExY-2 | 0.10 |
| ExY-3 | 0.10 |
| ExY-4 | 0.010 |
| Cpd-2 | $1.0 \times 10^{-3}$ |
| HBS-1 | 0.070 |
| Gelatin | 0.70 |

Thirteenth Layer (First Protective Layer):

| | |
|---|---|
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |

Fourteenth Layer (Second Protective Layer):

| | |
|---|---|
| Silver Iodobromide Emulsion M | 0.10 as Ag |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

In addition, the respective layers contained any of W-1 through W-3, B-4 through B-6, F-1 through F-15, and iron salts, lead salts, gold salts, platinum salts, palladium salts, iridium salts and rhodium salts, so as to have improved storability, processability, pressure resistance, anti-fungal and anti-bacterial property, antistatic property and coatability.

TABLE 7

| | Mean AgI Content (%) | Fluctuation Coefficient Relative to AgI Content among Grains (%) | Mean Grain Size (as the diameter of the corresponding sphere) (μm) | Fluctuation Coefficient Relative to Grain Size (%) | Grain Diameter (corresponding to the diameter of the circle of the projected area) (μm) | Ratio of Diameter/-Thickness |
|---|---|---|---|---|---|---|
| Emulsion A | 1.7 | 10 | 0.46 | 15 | 0.56 | 5.5 |
| Emulsion B | 3.5 | 15 | 0.57 | 20 | 0.78 | 4.0 |
| Emulsion C | 8.9 | 25 | 0.66 | 25 | 0.87 | 5.8 |
| Emulsion D | 8.9 | 18 | 0.84 | 26 | 1.03 | 3.7 |
| Emulsion E | 1.7 | 10 | 0.46 | 15 | 0.56 | 5.5 |
| Emulsion F | 3.5 | 15 | 0.57 | 20 | 0.78 | 4.0 |
| Emulsion G | 8.8 | 25 | 0.61 | 23 | 0.77 | 4.4 |
| Emulsion H | 8.8 | 25 | 0.61 | 23 | 0.77 | 4.4 |
| Emulsion I | 8.9 | 18 | 0.84 | 26 | 1.03 | 3 7 |
| Emulsion J | 1.7 | 10 | 0.46 | 15 | 0.50 | 4.2 |
| Emulsion K | 8.8 | 18 | 0.64 | 23 | 0.85 | 5.2 |
| Emulsion L | 14.0 | 25 | 1.28 | 26 | 1.46 | 3.5 |
| Emulsion M | 1.0 | — | 0.07 | 15 | — | 1 |

In Table 7;

(1) Emulsions J to L were sensitized by reduction sensitization with thiourea dioxide and thiosulfonic acid, according to the example in JP-A-2-191938 (corresponding to U.S. Pat. No. 5,061,614), when the grains were prepared.(2) Emulsions A to I were sensitized by gold sensitization, sulfur sensitization and selenium sensitization in the presence of the spectrally sensitizing dyes described in each spectrally sensitive layer and sodium thiocyanate, according to the example in JP-A-3-237450 (corresponding to EP-A-443453).

(3) In preparing the tabular grains, a low-molecular weight gelatin was used according to the example in JP-A-1-158426.

(4) Dislocation lines such as those described in JP-A-3-237450 were found in the tabular grains, when the grains were observed with a high-pressure electronic microscope.

(5) Emulsion L contained two-layered grains each having an iodine-rich core such as those described in JP-A-60-143331.

(6) Emulsion M contained light-insensitive fine grains having a grain diameter of 0.05 μm.

Preparation of Dispersions of Solid Organic Disperse Dyes:

ExF-2 mentioned hereinunder was dispersed according to the following method. Concretely, 21.7 ml of water, 3 ml of an aqueous 5-% solution of sodium p-octylphenoxyethoxyethoxyethanesulfonate and 0.5 g of an aqueous 5-% solution of p-octylphenoxy-polyoxyethylene ether (having a degree of polymerization of 10) were put into a 700-ml pot mill, 5.0 g of ExF-2 (dye) and 500 ml of zirconium oxide beads (having a diameter of 1 mm) were added thereto, and the content in the mill was dispersed for 2 hours. This dispersion was conducted with a BO-type shaking ball mill (produced by Chuo Kohki KK). After thus dispersed, the content was taken out and added to 8 g of an aqueous 12.5-% solution of gelatin. The beads were removed by filtration, and a gelatin dispersion of the dye was obtained. The fine dye grains in the dispersion had a mean grain size of 0.44 μm.

In the same manner as above, solid dispersions of ExF-3, ExF-4 and ExF-6 were prepared. The fine dye grains in these dispersions had a mean grain size of 0.24 μm, 0.45 μm and 0.52 μm, respectively. A dispersion of ExF-5 was prepared according to the microprecipitation method described in Example 1 in EP-A-549489. This had a mean grain size of 0.06 μm.

Compounds used above are mentioned below.

ExC-1

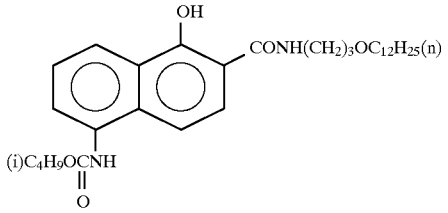

ExC-2

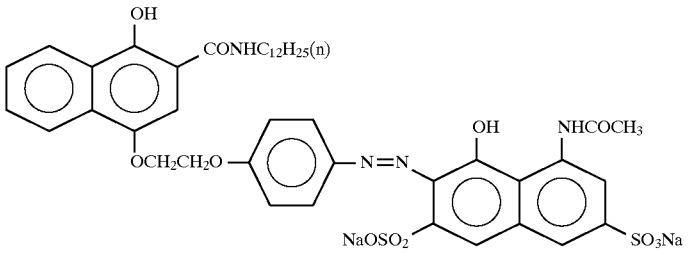

ExC-3

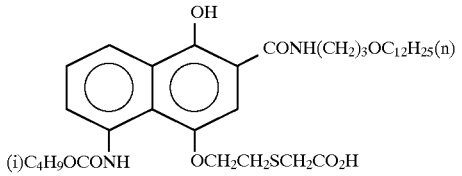

ExC-4

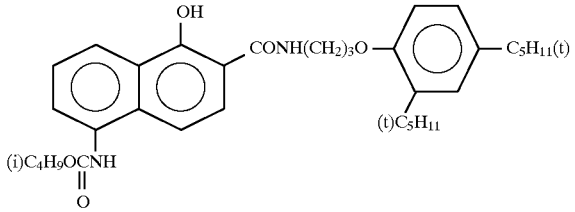

-continued
ExC-5
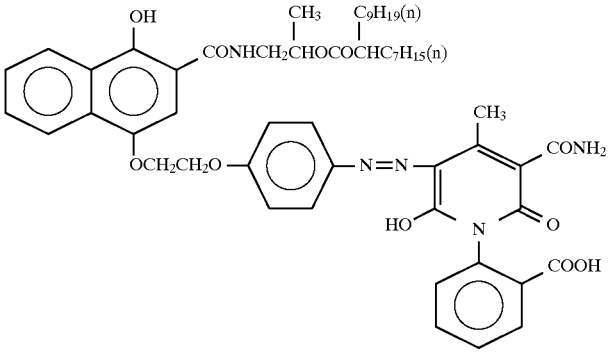
ExC-6
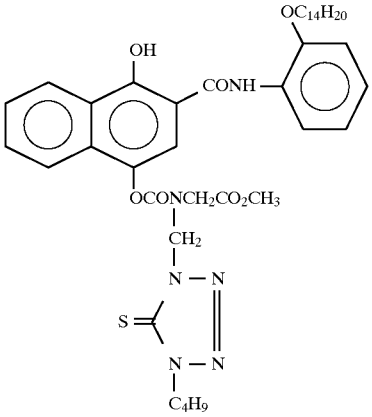
ExC-7
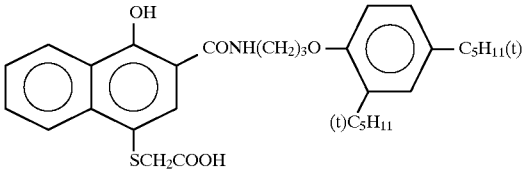
ExC-8
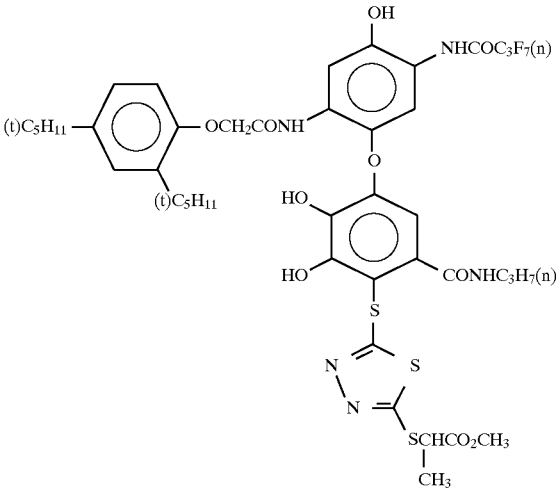

-continued
ExM-1
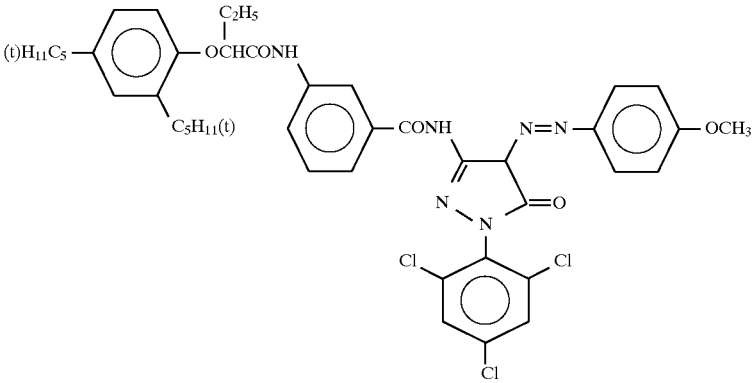
ExM-2
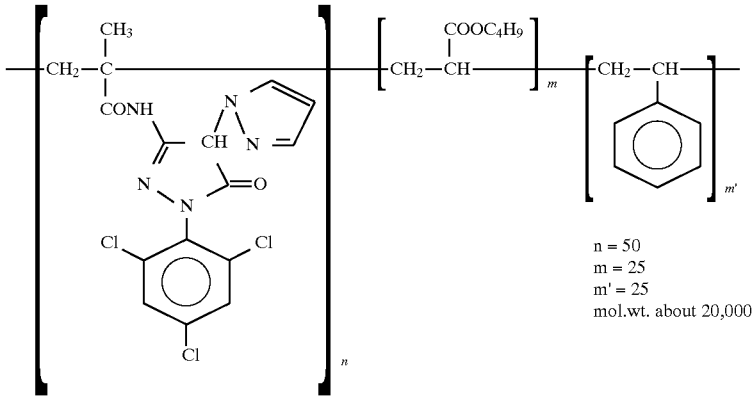
ExM-3
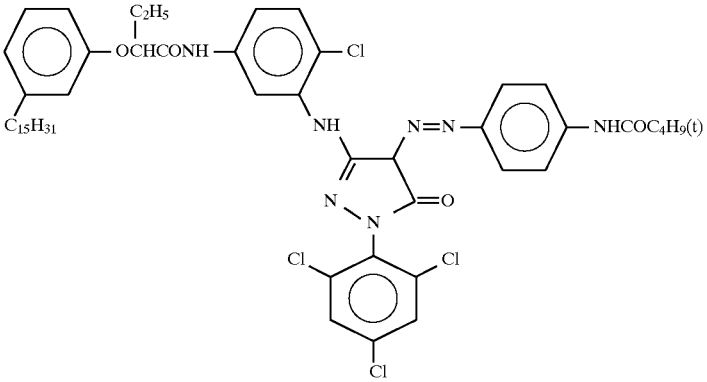
ExM-4
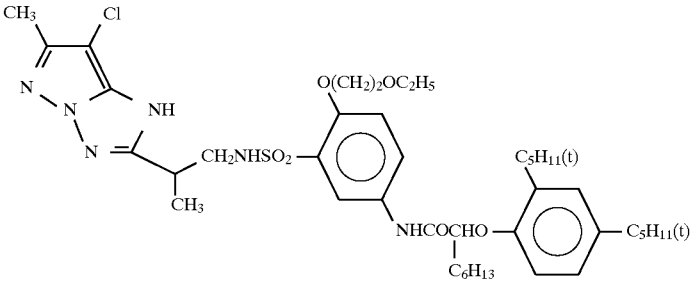

-continued
ExM-5
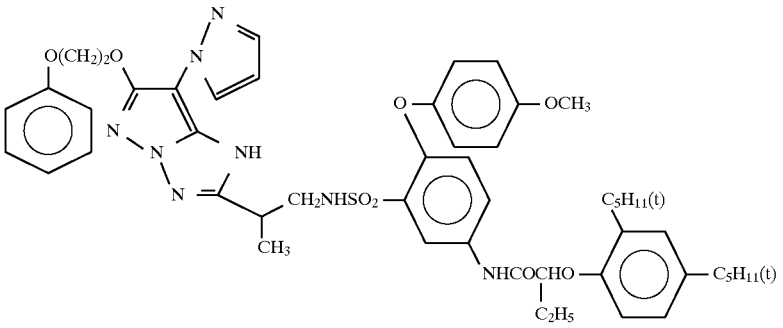
ExY-1
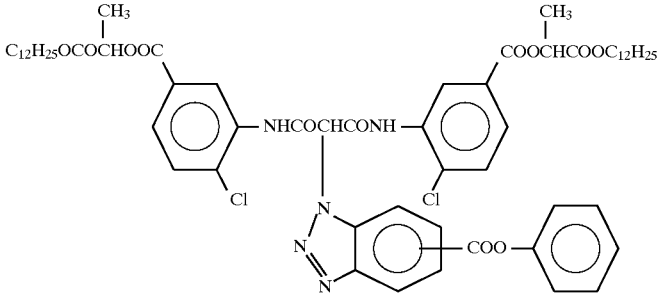
ExY-2
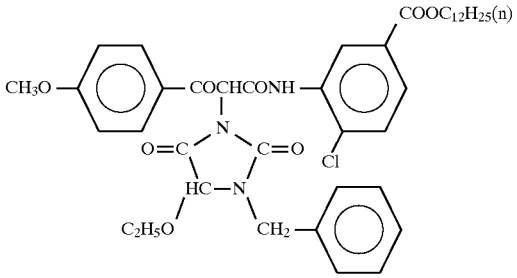
ExY-3
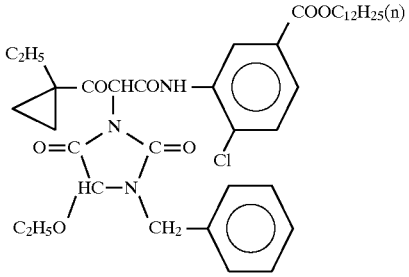
ExY-4
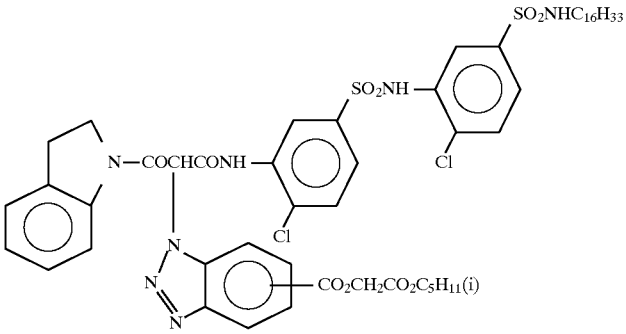

-continued
ExY-5
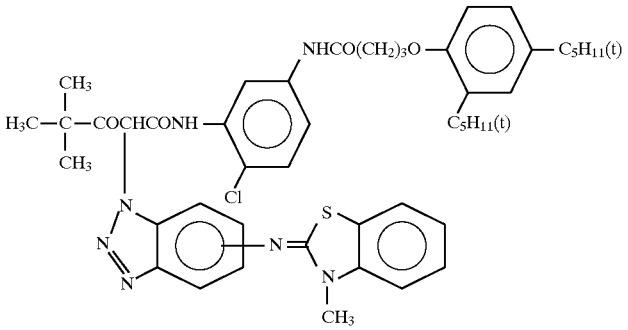
ExF-1
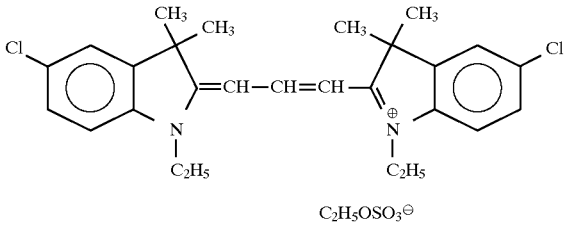
ExF-2
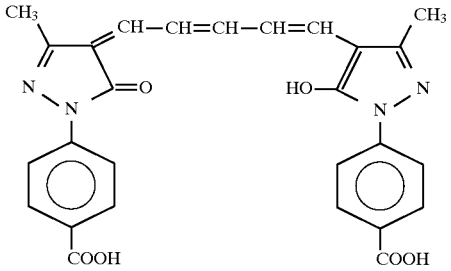
ExF-3
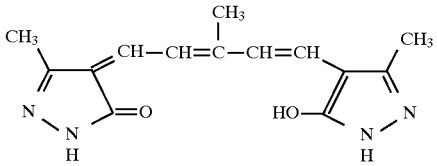
ExF-4
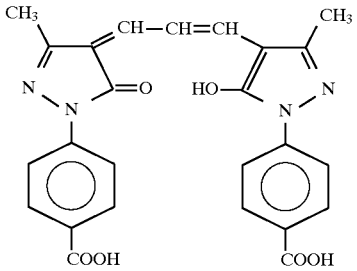
ExF-5
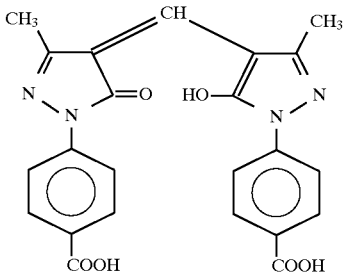

-continued
ExF-6
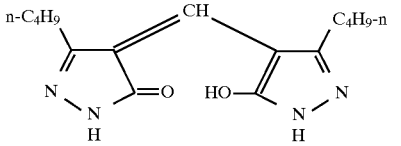
ExF-7
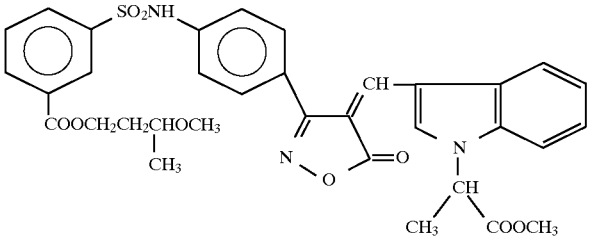
Cpd-1
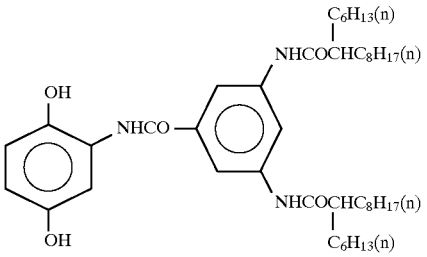
Cpd-2
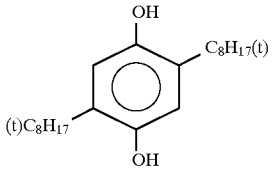
UV-1
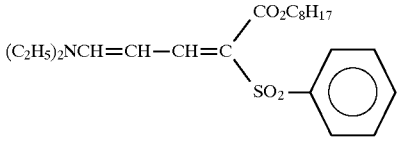
UV-2
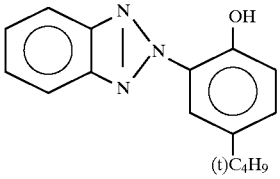
UV-3
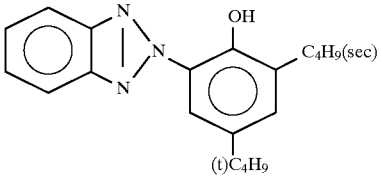
Tricresyl Phosphate HBS-1
Di-n-butyl Phthalate HBS-2
HBS-3
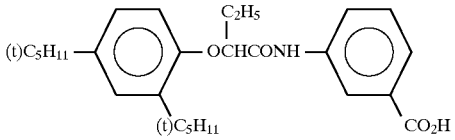
Tri(2-ethylhexyl) Phosphate HBS-4

-continued
ExS-1
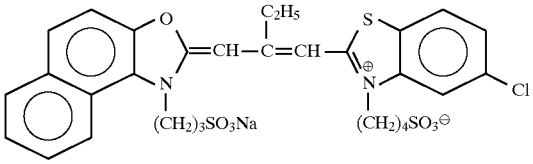
ExS-2
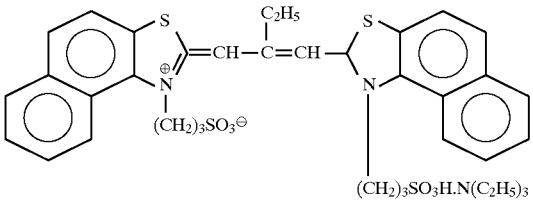
ExS-3
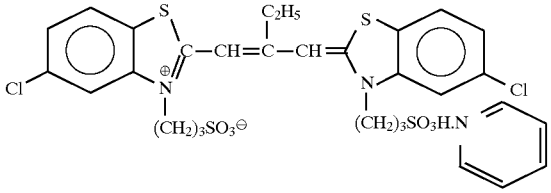
ExS-4
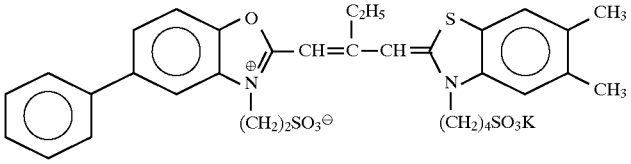
ExS-5
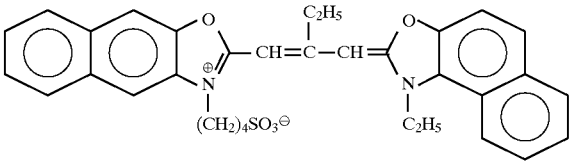
ExS-6
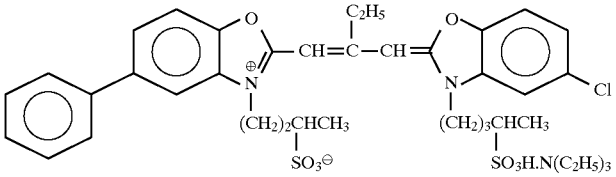
ExS-7
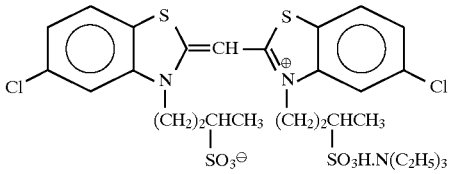
S-1
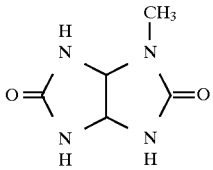
H-1
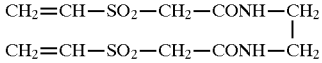
B-1
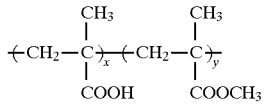
x/y = 10/90 (mol%)

-continued
B-2
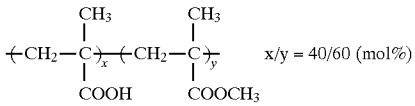
x/y = 40/60 (mol%)
B-3
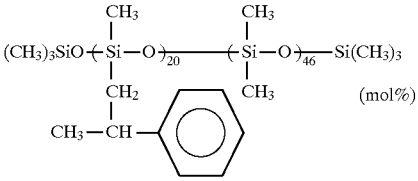
(mol%)
B-4
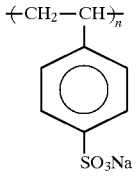
(n = an integer of ca. 1,000)
B-5
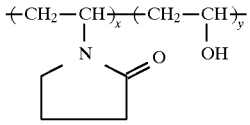
x/y = 70/30 (mol%)
B-6
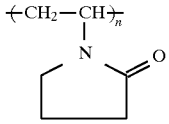
(mol. wt. about 10,000)
(n = an integer)
W-1
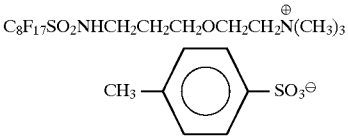
W-2
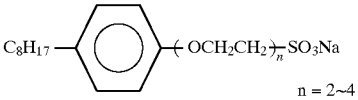
n = 2~4
W-3
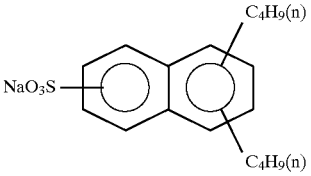
F-1
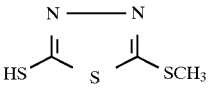
F-2
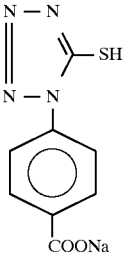

-continued
F-3
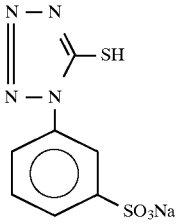
F-4
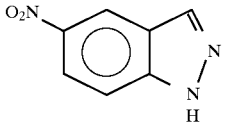
F-5
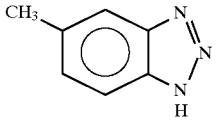
F-6
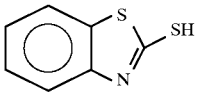
F-7
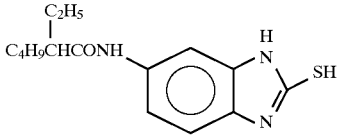
F-8
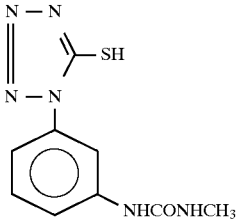
F-9
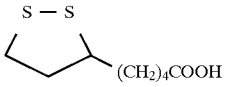
F-10
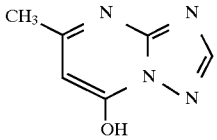
F-11
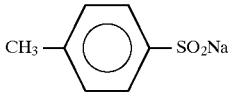
F-12
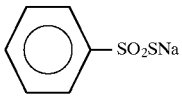
F-13
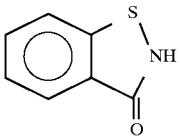

-continued

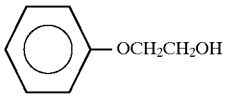

F-14

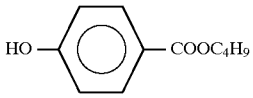

F-15

Formation of Sample 7-2:

Sample 7-2 was prepared in the same manner as in the preparation of sample 7-1, except that ExS-4, ExS-5 and ExS-6 in the 7th to 9th layers were replaced by I-4, I-15 and S-7, respectively and that ExS-1, ExS-2 and ExS-3 in the 3rd to 5th layers were replaced by I-16, I-24 and S-3, respectively. By adjusting the proportions and the amounts of the sensitizing dyes to be added, sample 7-2 was made to have almost the same spectral sensitivity distribution as that of sample 7-1.

These samples each were exposed to white light through a continuous optical wedge and then processed according to the process mentioned below. The magenta density and the cyan density of the thus-processed samples were measured. The green sensitivity, which is the reciprocal of the amount of exposure that gave a magenta density of 2.5, and the red sensitivity, which is the reciprocal of the amount of exposure that gave a cyan density of 2.0, were obtained for these samples. From the data thus obtained, it was confirmed that the sample (7-2) of the present invention had higher green sensitivity and red sensitivity both by 80% or more than the comparative sample (7-1). Accordingly, it has been confirmed that the present invention is significantly effective also for multi-layered photographic materials. In addition, the storage stability of these samples was evaluated in the same manner as in Example 3. As a result, it was confirmed that the storage stability of the sample (7-2) of the present invention was much higher than that of the comparative sample (7-1).

The process for developing the samples employed herein is mentioned below.

Processing Steps:

| Step | Time | Temperature | Amount of Replenisher* | Tank Capacity |
|---|---|---|---|---|
| Color Development | 3 min 15 sec | 38° C. | 45 ml | 10 liters |
| Bleaching | 1 min 00 sec | 38° C. | 20 ml | 4 liters |
| Bleach-fix | 3 min 15 sec | 38° C. | 30 ml | 8 liters |
| Washing (1) | 40 sec | 35° C. | countercurrent cascade system from (2) to (1) | 4 liters |
| Washing (2) | 1 min 00 sec | 35° C. | 30 ml | 4 liters |
| Stabilization | 40 sec | 3° C. | 20 ml | 4 liters |
| Drying | 1 min 15 sec | 55° C. | | |

Amount of replenisher was per 1 m of the 35 mm-wide sample.

The compositions of the processing solutions used above are mentioned below.

Color Developer:

| | Tank Solution | Replenisher |
|---|---|---|
| Diethylenetriamine-pentaacetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.7 g |
| Potassium Iodide | 1.5 mg | — |
| Hydroxylamine Sulfate | 2.4 g | 2.8 g |
| 4-(N-ethyl-N-β-hydroxy-ethylamino)-2-methylaniline sulfate | 4.5 g | 5.5 g |
| Water to make | 1.0 liter | 1.0 liter |
| pH | 10.05 | 10.10 |

Bleaching Solution:

| | |
|---|---|
| The tank solution and the replenisher were the same. | |
| Ammonium Ethylenediaminetetraacetato Ferrate Dihydrate | 120.0 g |
| Disodium Ethylenediaminetetraacetate | 10.0 g |
| Ammonium Bromide | 100.0 g |
| Ammonium Nitrate | 10.0 g |
| Bleaching Accelerator, $[(CH_3)_2N—CH_2CH_2—S]_2.2HCl$ | 0.005 mol |
| Aqueous Ammonia (27%) | 15.0 ml |
| Water to make | 1.0 liter |
| pH | 6.3 |

Bleach-fixing Soluton:

| | |
|---|---|
| The tank solution and the replenisher were the same | |
| Ammonium Ethylenediaminetetraacetato Ferrate Dihydrate | 50.0 g |
| Disodium Ethylenediaminetetraacetate | 5.0 g |
| Sodium Sulfite | 12.0 g |
| Aqueous Solution of Ammonium Thiosulfate (70%) | 240.0 ml |
| Aqueous Ammonia (27%) | 6.0 ml |
| Water to make | 1.0 liter |
| pH | 7.2 |

Washing Water:

The tank solution and the replenisher were the same.

A city water was passed through a mixed bed type column as filled with an H-type strong acidic cation-exchange resin (Amberlite IR-120B, produced by Rhom & Haas Co.) and an OH-type anion-exchange resin (Amberlite IR-400, produced by Rhom & Haas Co.) so that both the calcium ion concentration and the magnesium ion concentration in the water were reduced to 3 mg/liter, individually. Next, 20 ml/liter of sodium dichloroisocyanurate and 0.15 g/liter of sodium sulfate were added to the resulting water, which had a pH value falling within the range of from 6.5 to 7.5. This was used as the washing water.

Stabilizing Solution:

The tank solution and the replenisher were the same.

| | |
|---|---|
| Formalin (37%) | 2.0 ml |
| Polyoxyethylene p-Monononylphenyl Ether (mean degree of polymerization: 10) | 0.3 g |
| Disodium Ethylenediaminetetraacetate | 0.05 g |
| Water to make | 1.0 liter |

According to the present invention that has been described in detail hereinabove, it has become possible to subject a silver halide emulsion that has been color-sensitized with a large amount of sensitizing dye(s) having an absorption peak wavelength longer than 545, to reduction sensitization to thereby greatly increase the sensitivity of the emulsion. Thus, the photographic material of the present invention containing the emulsion has a much elevated sensitivity while having good storage stability.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one silver halide emulsion layer comprising a substantially surface-latent-image silver halide emulsion which comprises hole-injection sensitizing dye(s) in an amount of $4\times10^{-4}$ mol or more per mol of silver in the emulsion and further comprises supersensitizing compound(s), wherein one of the hole-injection sensitizing dye(s) and one of the supersensitizing compound(s) satisfy the following requirements:

(1) when both said one of the hole-injection sensitizing dye(s) and said one of the supersensitizing compound (s) have been adsorbed onto the silver halide grains constituting the emulsion, the emulsion has a maximum absorption wavelength of longer than 545 nm;

(2) when said one of the hole-injection sensitizing dye(s) is singly adsorbed onto a standard, negative silver iodobromide emulsion which is employed for the intended evaluation and which gives a surface negative image by exposure, the relative quantum yield of the negative sensitivity of the emulsion is smaller than 0.6;

(3) when both said one of the hole-injection sensitizing dye(s) and said one of the supersensitizing compound (s) are adsorbed onto a standard, internally fogged reversal silver iodobromide emulsion which is employed for the intended evaluation and which gives an internal reversal image by exposure, the degree of intrinsic desensitization of the reversal sensitivity of the emulsion is smaller than 0.2 as log E; and (4) when both said one of the hole-injection sensitizing dye(s) and said one of the supersensitizing compound (s) are adsorbed onto the standard, internally fogged reversal silver iodobromide emulsion referred to in (3), the relative quantum yield of the reversal sensitivity of the emulsion is 0.8 or more.

2. The silver halide photographic material as claimed in claim 1, wherein the silver halide emulsion has been subjected to reduction sensitization.

3. The silver halide photographic material as claimed in claim 1, wherein the silver halide emulsion comprises tabular silver halide grains having a mean thickness of 0.3 $\mu$m or less.

4. The silver halide photographic material as claimed in claim 1, wherein the molar ratio of the supersensitizing compound(s) to the hole-injection sensitizing dye(s) in the silver halide emulsion is from 0.003/1 to 0.3/1.

5. The silver halide photographic material as claimed in claim 1, wherein the hole-injection sensitizing dye(s) satisfying the defined requirements account(s) for 70 mol % or more of all the sensitizing dyes in the silver halide emulsion.

6. The silver halide photographic material as claimed in claim 1, wherein the hole-injection sensitizing dye(s) and the supersensitizing compound(s) in the silver halide emulsion are chosen such that the increase in the relative quantum yield of the negative sensitivity of the standard surface-latent-image silver iodobromide emulsion, $\Delta\phi r$ (=$\phi r$ of the negative image formed on the surface of the emulsion onto which both the hole-injection sensitizing dye(s) and the supersensitizing compound(s) have been adsorbed—$\phi r$ of the negative image formed on the surface of the emulsion onto which only the hole-injection sensitizing dye(s) has been adsorbed) is larger than 0.2.

7. The silver halide photographic material as claimed in claim 6, in which $\Delta\phi r$ is larger than 0.4.

8. The silver halide photographic material as claimed in claim 1, wherein the silver halide emulsion comprises silver halide grains having a grain size of 0.5 $\mu$m or more as the diameter of the sphere corresponding to the grain.

9. The silver halide photographic material as claimed in claim 1, wherein the silver halide emulsion has been subjected to reduction sensitization during the process of producing it and at least one compound of the following formula (1), (2) or (3) has been added to the emulsion:

$$R_{21}—SO_2—S—M \quad (1)$$

$$R_{21}—SO_2—S—R_{22} \quad (2)$$

$$R_{21}—SO_2—S—L_m—S—SO_2—R_{23} \quad (3)$$

wherein $R_{21}$, $R_{22}$ and $R_{23}$ may be the same or different and each represents an aliphatic group, an aromatic group or a heterocyclic group; M represents a cation; L represents a divalent linking group; m represents 0 or 1; the compounds of formula (1), (2) or (3) being optionally polymers each containing repeating units of the divalent group to be derived from any of the structures of formula (1), (2) or (3).

10. The silver halide photographic material as claimed in claim 9, wherein the aliphatic group is an unsubstituted or substituted alkyl group, said unsubstituted alkyl group having from 1 to 22 carbon atoms, or an unsubstituted or substituted alkynyl group, said unsubstituted alkynyl group having from 2 to 22 carbon atoms.

11. The silver halide photographic material as claimed in claim 9, wherein the aromatic group is a substituted or unsubstituted monocyclic or condensed-cyclic aromatic group, said unsubstituted monocyclic or condensed-cyclic aromatic group having from 6 to 20 carbon atoms.

12. The silver halide photographic material as claimed in claim 9, wherein the heterocyclic group is a 3–15 membered ring having at least one element selected from the group consisting of nitrogen, oxygen, sulfur, selenium and tellurium, and has at least one carbon atom.

13. The silver halide photographic material as claimed in claim 9, wherein $R_{21}$, $R_{22}$ or $R_{23}$ is substituted with a substituent selected from the group consisting of an alkyl group, an alkoxy group, an aryl group, a hydroxyl group, a halogen atom, an aryloxy group, an alkylthio group, an arylthio group, an acyl group, a sulfonyl group, an acylamino group, a sulfonylamino group, an acyloxy group, a carboxyl group, a cyano group, a sulfo group, an amino group, an —$SO_2SM$ group where M is a monovalent cation, and an —$SO_2R$ group where R is an alkyl group.

14. The silver halide photographic material as claimed in claim 9, wherein the divalent linking group comprises at least one atom or atomic group selected from the group consisting of C, N, S and O.

15. The silver halide photographic material as claimed in claim 9, wherein M is a metal ion or an organic cation.

16. The silver halide photographic material as claimed in claim 9, wherein the repeating units are as follows:

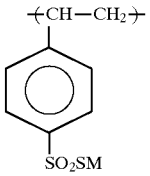

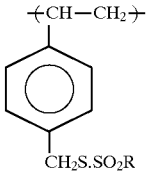

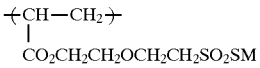

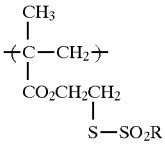

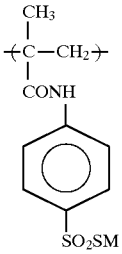

17. The silver halide photographic material as claimed in claim 9, wherein the compound of formula (1), (2) or (3) is selected from the group consisting of (II-1)–(II-33), (III-1)–(III-25) and (IV-1)–(IV-9)

$CH_3SO_2SNa$ (II-1)
$C_2H_5SO_2SNa$ (II-2)
$C_3H_7SO_2SK$ (II-3)
$C_4H_9SO_2SLi$ (II-4)
$C_6H_{13}SO_2SNa$ (II-5)
$C_8H_{17}SO_2SNa$ (II-6)

$CH_3(CH_2)_3CH(C_2H_5)CH_2SO_2S.NH_4$ (II-7)

$C_{10}H_{21}SO_2SNa$ (II-8)
$C_{12}H_{25}SO_2SNa$ (II-9)
$C_{16}H_{33}SO_2SNa$ (II-10)

$(CH_3)_2CH-SO_2SK$ (II-11)

$t\text{-}C_4H_9SO_2SNa$ (II-12)

-continued $CH_3OCH_2CH_2SO_2S.Na$ (II-13)

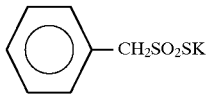
(II-14)

$CH_2{=}CHCH_2SO_2SNa$ (II-15)

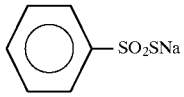
(II-16)

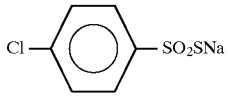
(II-17)

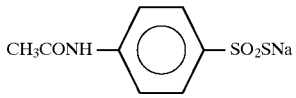
(II-18)

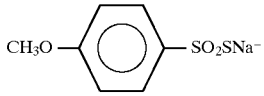
(II-19)

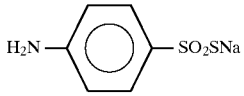
(II-20)

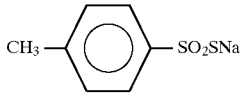
(II-21)

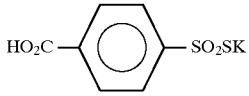
(II-22)

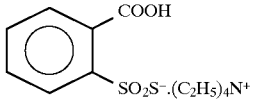
(II-23)

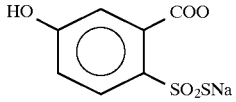
(II-24)

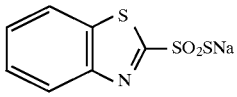
(II-25)

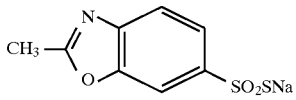
(II-26)

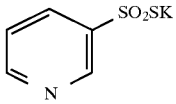
(II-27)

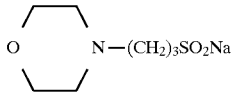
(II-28)

$NSSO_2(CH_2)_2SO_2SK$ (II-29)
$NaSSO_2(CH_2)_4SO_2SNa$ (II-30)

-continued
$NaSSO_2(CH_2)_4S(CH_2)_4SO_2SNa$ (II-31)
(II-32)
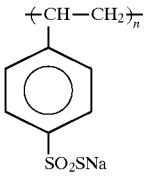
n = an integer
(II-33)
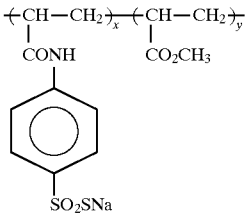
x/y = 1/1 (by mol)
$C_2H_5SO_2S-CH_3$ (III-1)
$C_8H_{17}SO_2SCH_2CH_3$ (III-2)
(III-3)
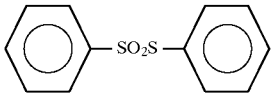
(III-4)
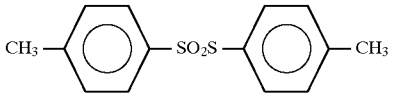
$C_2H_5SO_2SCH_2CH_2CN$ (III-5)
(III-6)
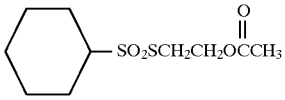
(III-7)
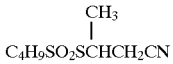
(III-8)
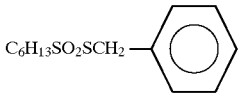
(III-9)
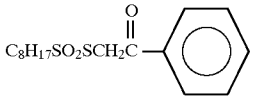
(III-10)
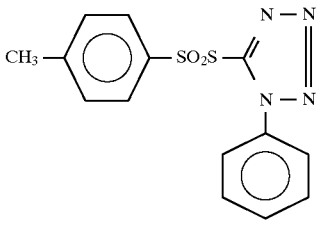
(III-11)
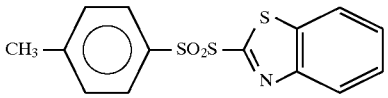
(III-12)
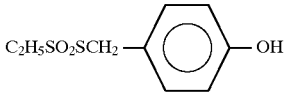
-continued
(III-13)
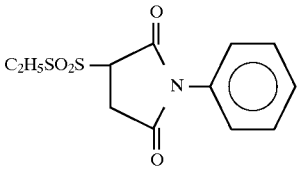
(III-14)
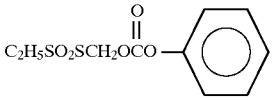
(III-15)
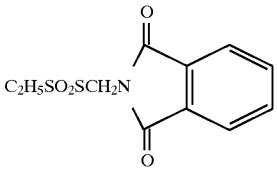
(III-16)
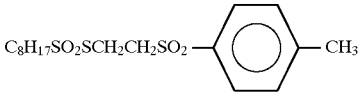
(III-17)
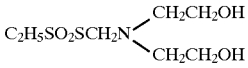
$C_2H_5SO_2SCH_2CH_2CH_2CH_2OH$ (III-18)
(III-19)
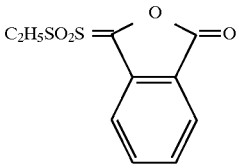
(III-20)
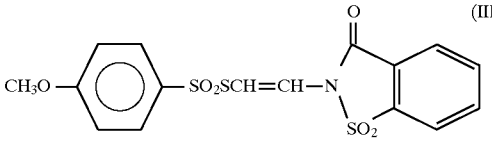
$CH_3SSO_2(CH_2)_4SO_2SCH_3$ (III-21)
$CH_3SSO_2(CH_2)_2SO_2SCH_3$ (III-22)
(III-23)
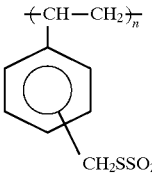
n = an integer
(III-24)
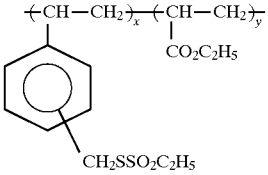
x/y = 2/1 (by mol)
(III-25)
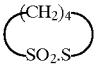
(IV-1)
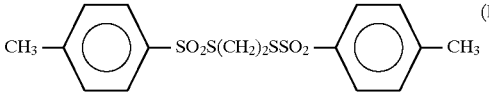

-continued $C_2H_5SO_2SCH_2CH_2SO_2CH_2CH_2SSO_2C_2H_5$ (IV-2)

(IV-3)

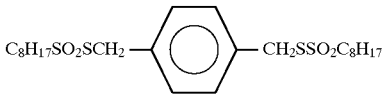

$C_2H_5SO_2SCH_2N(CH_2CH_2OH)CH_2CH_2N(CH_2CH_2OH)CH_2SSO_2C_2H_5$ (IV-4)

(IV-5)

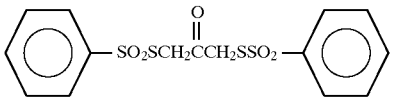

-continued (IV-6)

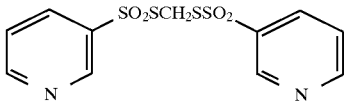

$C_2H_5SO_2SSSO_2C_2H_5$ (IV-7)

$(n)C_3H_7SO_2SSSO_2C_3H_7(n)$ (IV-8)

and (IV-9)

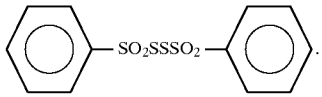

18. The silver halide photographic material as claimed in claim 1, wherein the hole-injection sensitizing dye(s) is selected from the group consisting of Formulas (I-1)–(I-34):

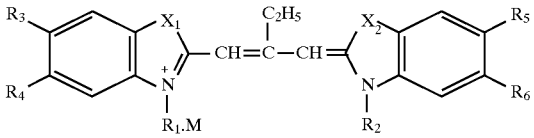

| | $X_1$ | $X_2$ | $R_1$ | $R_2$ | $R_3$ | $R_4$ | $R_5$ | $R_6$ | M |
|---|---|---|---|---|---|---|---|---|---|
| I-1 | O | O | $(CH_2)_3SO_3^-$ | $(CH_2)_3SO_3^-$ | Cl | Cl | Cl | Cl | Na |
| I-2 | O | O | $(CH_2)_3SO_3^-$ | $(CH_2)_3SO_3^-$ | Br | Br | Br | Br | Na |
| I-3 | O | O | $(CH_2)_3SO_3^-$ | $(CH_2)_3SO_3^-$ | H | $COCH_3$ | H | $COCH_3$ | Na |
| I-4 | O | O | $(CH_2)_3SO_3^-$ | $(CH_2)_3SO_3^-$ | H | $COOCH_3$ | H | $COOCH_3$ | Na |
| I-5 | O | O | $(CH_2)_3SO_3^-$ | $(CH_2)_3SO_3^-$ | H | $CF_3$ | H | $CF_3$ | Na |
| I-6 | O | O | $(CH_2)_3SO_3^-$ | $(CH_2)_3SO_3^-$ | H | $NO_2$ | H | $NO_2$ | Na |
| I-7 | O | O | $(CH_2)_3SO_3^-$ | $(CH_2)_3SO_3^-$ | H | $SOCH_3$ | H | $SOCH_3$ | Na |
| I-8 | O | O | $CH_2CF_2CF_2H$ | $CH_2CF_2CF_2H$ | H | Cl | H | Cl | I |
| I-9 | O | O | $(CH_2)_3SO_3^-$ | $CH_2CF_2CF_2H$ | H | $COCH_3$ | H | $COCH_3$ | |
| I-10 | O | O | $(CH_2)_3SO_3^-$ | $(CH_2)_3SO_3^-$ | H | CN | H | CN | Na |
| I-11 | O | O | $(CH_2)_2-CH=CHSO_3^-$ | $(CH_2)_2-CH=CHSO_3^-$ | H | Cl | H | Cl | Na |
| I-12 | O | O | $(CH_2)_3SO_3^-$ | $(CH_2)_3SO_3^-$ | H | $COCH_3$ | H | $COCH_3$ | Na |
| I-13 | O | S | $(CH_2)_3SO_3^-$ | $(CH_2)_3SO_3^-$ | H | $CF_3$ | H | $CF_3$ | Na |
| I-14 | O | S | $(CH_2)_3SO_3^-$ | $(CH_2)_3SO_3^-$ | H | Cl | H | CN | Na |
| 1-15 | O | S | $(CH_2)_3SO_3^-$ | $CH_2CF_2CF_2H$ | H | $CF_3$ | H | $CF_3$ | — |
| I-16 | O | S | $(CH_2)_2-CH=CHSO_3^-$ | $(CH_2)_2-CH=CHSO_3^-$ | H | Cl | H | Cl | Na |
| I-17 | O | S | $(CH_2)_3SO_3^-$ | $(CH_2)_3SO_3^-$ | H | $COCH_3$ | H | $COCH_3$ | Na |
| I-18 | S | S | $(CH_2)_3SO_3^-$ | $(CH_2)_3SO_3^-$ | H | $CF_3$ | H | $CF_3$ | Na |
| I-19 | S | S | $(CH_2)_3SO_3^-$ | $(CH_2)_3SO_3^-$ | H | CN | H | CN | Na |
| I-20 | S | S | $(CH_2)_2SO_3^-$ | $(CH_2)_3SO_3^-$ | H | $NO_3$ | H | $NO_3$ | Na |
| 1-21 | S | S | $(CH_2)_2SO_3^-$ | $(CH_2)_3SO_3^-$ | H | $SOCH_3$ | H | $SOCH_3$ | Na |
| 1-22 | S | S | $(CH_2)_2-CH=CHSO_3^-$ | $(CH_2)_2-CH=CHSO_3^-$ | H | Cl | H | Cl | Na |
| I-23 | S | S | $(CH_2)_2SO_3^-$ | $(CH_2)_3SO_3^-$ | H | $COCH_3$ | H | $COCH_3$ | Na |
| I-24 | S | S | $CH_2CF_2CF_2H$ | $CH_2CF_2CF_2H$ | H | $COCH_3$ | H | $COCH_3$ | I |

I-25

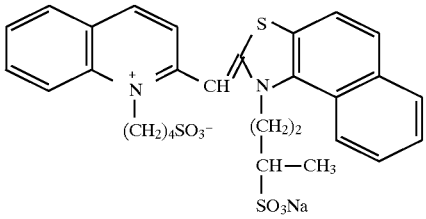

I-26

-continued
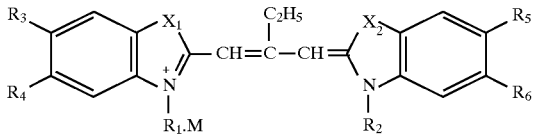
| $X_1$ | $X_2$ | $R_1$ | $R_2$ | $R_3$ | $R_4$ | $R_5$ | $R_6$ | M |
|---|---|---|---|---|---|---|---|---|
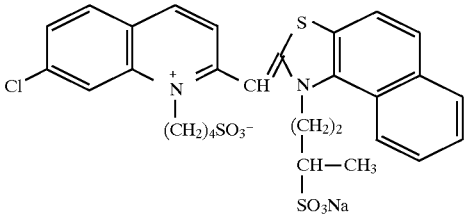
I-27
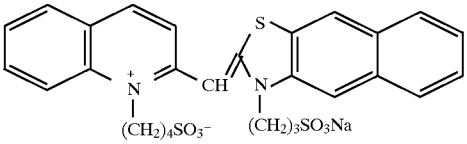
I-28
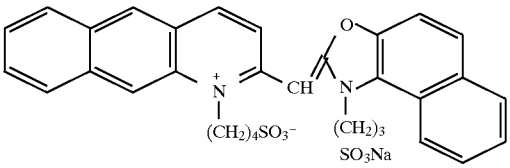
I-29
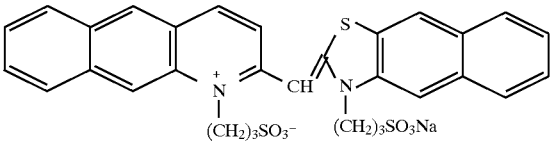
I-30
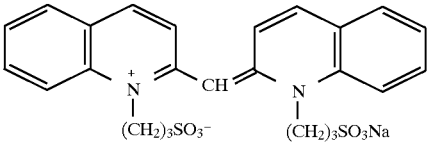
I-31
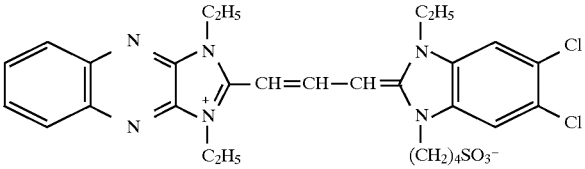
I-32
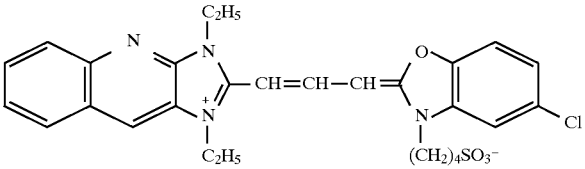

-continued

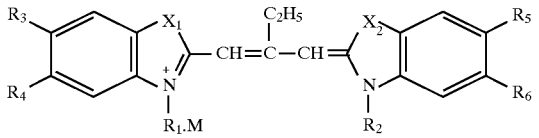

| $X_1$ | $X_2$ | $R_1$ | $R_2$ | $R_3$ | $R_4$ | $R_5$ | $R_6$ | M |
|---|---|---|---|---|---|---|---|---|

I-33

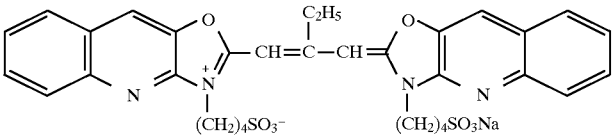

and

I-34

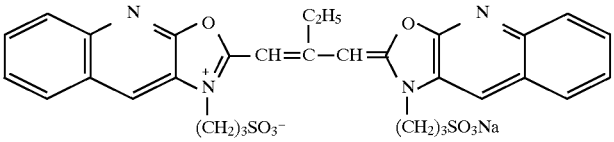

19. A silver halide photographic material comprising a support having provided thereon at least one silver halide emulsion layer comprising a substantially surface-latent-image silver halide emulsion which comprises at least one hole-injection sensitizing dye in an amount of $4\times10^{-4}$ mol or more per mol of silver in the emulsion and further comprises at least one supersensitizing compound, wherein one of the at least one hole-injection sensitizing dye and one of the at least one supersensitizing compound satisfy the following requirements:

(1) when both said one of the at least one hole-injection sensitizing dye and said one of the at least one supersensitizing compound have been adsorbed onto the silver halide grains constituting the emulsion, the emulsion has a maximum absorption wavelength of longer than 545 nm;

(2) when said one of the at least one hole-injection sensitizing dye is singly adsorbed onto a standard, negative silver iodobromide emulsion which is employed for the intended evaluation and which gives a surface negative image by exposure, the relative quantum yield of the negative sensitivity of the emulsion is smaller than 0.6;

(3) when both said one of the at least one hole-injection sensitizing dye and said one of the at least one supersensitizing compound are adsorbed onto a standard, internally fogged reversal silver iodobromide emulsion which is employed for the intended evaluation and which gives an internal reversal image by exposure, the degree of intrinsic desensitization of the reversal sensitivity of the emulsion is smaller than 0.2 as log E; and (4) when both said one of the at least one hole-injection sensitizing dye and said one of the at least one supersensitizing compound are adsorbed onto the standard, internally fogged reversal silver iodobromide emulsion referred to in (3), the relative quantum yield of the reversal sensitivity of the emulsion is 0.8 or more.

* * * * *